US008641383B2

(12) United States Patent
Meza et al.

(10) Patent No.: US 8,641,383 B2
(45) Date of Patent: Feb. 4, 2014

(54) PUMP AND PUMP CONTROL CIRCUIT APPARATUS AND METHOD

(75) Inventors: Humberto V. Meza, Tustin, CA (US); Nikhil Jitendra Gandhi, Anaheim, CA (US); Quang Minh Truong, West Covina, CA (US)

(73) Assignee: SHURflo, LLC, Cypress, CA (US)

( * ) Notice: Subject to any disclaimer, the term of this patent is extended or adjusted under 35 U.S.C. 154(b) by 0 days.

(21) Appl. No.: 11/981,527

(22) Filed: Oct. 31, 2007

(65) Prior Publication Data

US 2008/0181788 A1 Jul. 31, 2008

Related U.S. Application Data

(60) Division of application No. 11/355,662, filed on Feb. 16, 2006, which is a continuation-in-part of application No. 10/453,874, filed on Jun. 3, 2003, now Pat. No. 7,083,392, which is a continuation-in-part of application No. 09/994,378, filed on Nov. 26, 2001, now Pat. No. 6,623,245.

(51) Int. Cl.
*F04B 49/00* (2006.01)
*F04B 49/06* (2006.01)

(52) U.S. Cl.
USPC ..... 417/43; 417/44.2; 417/53

(58) Field of Classification Search
USPC ..... 417/53, 43, 44.2, 44.11; 318/481, 482, 318/430–434
See application file for complete search history.

(56) References Cited

U.S. PATENT DOCUMENTS

| | | | |
|---|---|---|---|
| 3,613,805 | A | 10/1971 | Linstad |
| 3,778,804 | A | 12/1973 | Adair |
| 3,787,882 | A | 1/1974 | Fillmore |
| 4,353,220 | A | 10/1982 | Curwen |
| 4,494,180 | A | 1/1985 | Streater |
| 4,610,605 | A | 9/1986 | Hartley |
| 4,678,409 | A | 7/1987 | Kurokawa |
| 4,703,387 | A | 10/1987 | Miller |
| 4,767,280 | A | 8/1988 | Markuson |
| 4,795,314 | A | 1/1989 | Prybella |
| 4,834,624 | A | 5/1989 | Jensen |

(Continued)

FOREIGN PATENT DOCUMENTS

| | | |
|---|---|---|
| DE | 19645129 | 5/1998 |
| DE | 19938490 | 3/2001 |

(Continued)

OTHER PUBLICATIONS

"Better, Stronger, Faster;" Pool & Spa News, Sep. 3, 2004; pp. 52-54, 82-84, USA.

*Primary Examiner* — Charles Freay
(74) *Attorney, Agent, or Firm* — Quarles & Brady LLP

(57) ABSTRACT

Embodiments of the invention provide a method of controlling a pump. The method includes sensing a pressure in the pump and entering a low-flow mode when the sensed pressure in the pump is greater than a low pressure threshold. The method also includes reducing power to the pump when the sensed pressure is greater than a shut-off pressure during the low-flow mode and there is flow through the pump until the sensed pressure is less than the shut-off pressure. The method further includes turning the pump off when in the low-flow mode the sensed pressure is greater than the shut-off pressure and there is no flow through the pump.

5 Claims, 38 Drawing Sheets

(56) References Cited

U.S. PATENT DOCUMENTS

| | | | | |
|---|---|---|---|---|
| 4,912,936 | A | 4/1990 | Denpou | |
| 4,963,778 | A | 10/1990 | Jensen | |
| 5,026,256 | A | 6/1991 | Kuwabara | |
| 5,099,181 | A | 3/1992 | Canon | |
| 5,123,080 | A | 6/1992 | Gillett | |
| 5,156,535 | A | 10/1992 | Budris | |
| 5,158,436 | A | 10/1992 | Jensen | |
| 5,167,041 | A | 12/1992 | Burkitt | |
| 5,240,380 | A | 8/1993 | Mabe | |
| 5,342,176 | A | 8/1994 | Redlich | |
| 5,471,125 | A | 11/1995 | Wu | |
| 5,512,883 | A | 4/1996 | Lane | |
| 5,518,371 | A | 5/1996 | Wellstein | |
| 5,519,848 | A | 5/1996 | Wloka | |
| 5,520,517 | A | 5/1996 | Sipin | |
| 5,571,000 | A | 11/1996 | Zimmerman | |
| 5,580,221 | A | 12/1996 | Triezenberg | |
| 5,598,080 | A | 1/1997 | Jensen | |
| 5,614,812 | A | 3/1997 | Wagoner | |
| 5,626,464 | A | 5/1997 | Schoenmyr | |
| 5,628,896 | A | 5/1997 | Klingenberger | |
| 5,711,483 | A | 1/1998 | Hays | |
| 5,727,933 | A | 3/1998 | Laskaris et al. | |
| 5,740,783 | A * | 4/1998 | Learman et al. | 123/497 |
| 5,791,882 | A | 8/1998 | Stucker | |
| 5,804,080 | A | 9/1998 | Klingenberger | |
| 5,819,848 | A | 10/1998 | Rasmusson | |
| 5,883,489 | A * | 3/1999 | Konrad | 318/807 |
| 5,909,372 | A | 6/1999 | Thybo | |
| 5,941,690 | A | 8/1999 | Lin | |
| 5,969,958 | A | 10/1999 | Nielsen | |
| 5,973,465 | A | 10/1999 | Rayner | |
| 6,024,072 | A * | 2/2000 | Hamada | 123/497 |
| 6,037,742 | A | 3/2000 | Rasmussen | |
| 6,046,492 | A | 4/2000 | Machida | |
| 6,048,183 | A | 4/2000 | Meza | |
| 6,072,291 | A | 6/2000 | Pedersen | |
| 6,091,604 | A | 7/2000 | Plougsgaard et al. | |
| 6,102,665 | A | 8/2000 | Centers | |
| 6,125,481 | A | 10/2000 | Sicilano | |
| 6,142,741 | A | 11/2000 | Nishihata | |
| 6,208,112 | B1 | 3/2001 | Jensen | |
| 6,254,353 | B1 | 7/2001 | Polo | |
| 6,264,431 | B1 | 7/2001 | Triezenberg | |
| 6,290,043 | B1 * | 9/2001 | Ginder et al. | 192/21.5 |
| 6,299,414 | B1 | 10/2001 | Schoenmyr | |
| 6,326,752 | B1 | 12/2001 | Jensen | |
| 6,351,359 | B1 | 2/2002 | Jaeger | |
| 6,354,805 | B1 | 3/2002 | Moller | |
| 6,373,728 | B1 | 4/2002 | Aarestrup | |
| 6,380,707 | B1 | 4/2002 | Rosholm | |
| 6,406,265 | B1 | 6/2002 | Hahn | |
| 6,416,295 | B1 | 7/2002 | Nagai | |
| 6,426,633 | B1 | 7/2002 | Thybo | |
| 6,450,771 | B1 | 9/2002 | Centers | |
| 6,464,464 | B2 | 10/2002 | Sabim | |
| 6,468,042 | B2 | 10/2002 | Moller | |
| 6,468,052 | B2 | 10/2002 | McKain et al. | |
| 6,474,949 | B1 | 11/2002 | Arai | |
| 6,481,973 | B1 | 11/2002 | Struthers | |
| 6,483,278 | B2 | 11/2002 | Harvest | |
| 6,548,976 | B2 | 4/2003 | Jensen | |
| 6,623,245 | B2 | 9/2003 | Meza | |
| 6,676,831 | B2 | 1/2004 | Wolfe | |
| 6,690,250 | B2 | 2/2004 | Moller | |
| 6,715,996 | B2 | 4/2004 | Moeller | |
| 6,717,318 | B1 | 4/2004 | Mathiassen | |
| 6,747,367 | B2 | 6/2004 | Cline et al. | |
| 6,774,664 | B2 | 8/2004 | Godbersen | |
| 6,925,823 | B2 | 8/2005 | Lifson | |
| 7,005,818 | B2 | 2/2006 | Jensen | |
| 7,050,278 | B2 | 5/2006 | Poulsen | |
| 7,083,392 | B2 | 8/2006 | Meza | |
| 7,221,121 | B2 | 5/2007 | Skaug | |
| 7,878,766 | B2 * | 2/2011 | Meza et al. | 417/44.2 |
| 8,249,826 | B1 * | 8/2012 | Anderson et al. | 702/182 |
| 2001/0041139 | A1 | 11/2001 | Sabini et al. | |
| 2002/0050490 | A1 | 5/2002 | Pittman | |
| 2002/0070875 | A1 | 6/2002 | Crumb | |
| 2002/0136642 | A1 | 9/2002 | Moller | |
| 2003/0017055 | A1 | 1/2003 | Fong | |
| 2003/0099548 | A1 | 5/2003 | Meza | |
| 2003/0196942 | A1 | 10/2003 | Jones | |
| 2004/0009075 | A1 | 1/2004 | Meza | |
| 2004/0013531 | A1 | 1/2004 | Curry et al. | |
| 2005/0123408 | A1 | 6/2005 | Koehl | |
| 2005/0190094 | A1 | 9/2005 | Anderson | |
| 2005/0226731 | A1 | 10/2005 | Mehlhorn | |
| 2006/0045750 | A1 | 3/2006 | Stiles | |
| 2006/0045751 | A1 * | 3/2006 | Beckman et al. | 417/44.2 |
| 2006/0090255 | A1 | 5/2006 | Cohen | |
| 2006/0127227 | A1 | 6/2006 | Mehlhorn | |
| 2006/0204367 | A1 | 9/2006 | Meza | |
| 2007/0114162 | A1 | 5/2007 | Stiles | |
| 2007/0154319 | A1 | 7/2007 | Stiles | |
| 2007/0154320 | A1 | 7/2007 | Stiles | |
| 2007/0154321 | A1 | 7/2007 | Stiles et al. | |
| 2007/0154322 | A1 | 7/2007 | Stiles | |
| 2007/0154323 | A1 | 7/2007 | Stiles | |
| 2007/0163929 | A1 | 7/2007 | Stiles | |
| 2007/0183902 | A1 | 8/2007 | Stiles | |
| 2008/0063535 | A1 | 3/2008 | Koehl | |
| 2008/0131286 | A1 | 6/2008 | Koehl | |
| 2008/0131289 | A1 | 6/2008 | Koehl | |
| 2008/0131291 | A1 | 6/2008 | Koehl | |
| 2008/0131294 | A1 | 6/2008 | Koehl | |
| 2008/0131295 | A1 | 6/2008 | Koehl | |
| 2008/0131296 | A1 | 6/2008 | Koehl | |
| 2008/0140353 | A1 | 6/2008 | Koehl | |
| 2008/0152508 | A1 | 6/2008 | Meza | |
| 2008/0181785 | A1 | 7/2008 | Koehl | |
| 2008/0181786 | A1 | 7/2008 | Meza | |
| 2008/0181787 | A1 | 7/2008 | Koehl | |
| 2008/0181789 | A1 | 7/2008 | Koehl | |
| 2008/0181790 | A1 | 7/2008 | Meza | |

FOREIGN PATENT DOCUMENTS

| | | |
|---|---|---|
| DE | 10231773 | 2/2004 |
| EP | 0314249 | 5/1989 |
| EP | 0709575 | 5/1996 |
| EP | 0735273 | 10/1996 |
| EP | 0978657 | 2/2000 |
| FR | 2529965 | 6/1983 |
| FR | 2703409 | 10/1994 |
| JP | 5010270 | 1/1993 |
| WO | 98/04835 | 2/1998 |
| WO | 0147099 | 6/2001 |
| WO | 2004/006416 | 1/2004 |
| WO | 2004/088694 | 10/2004 |
| WO | 2006/069568 | 7/2006 |

* cited by examiner

PUMP AND PUMP CONTROL CIRCUIT APPARATUS AND METHOD

RELATED APPLICATIONS

This application is a divisional of pending U.S. application Ser. No. 11/355,662, filed on Feb. 16, 2006; which is a continuation-in-part of U.S. application Ser. No. 10/453,874 filed on Jun. 3, 2003, which issued as U.S. Pat. No. 7,083,392; which is a continuation-in-part of U.S. application Ser. No. 09/994,378 filed on Nov. 26, 2001, which issued as U.S. Pat. No. 6,623,245, all of which are incorporated herein by reference.

FIELD OF THE INVENTION

This invention relates generally to pumps and pumping methods, and more particularly to wobble plate pumps and pump controls.

BACKGROUND OF THE INVENTION

Wobble-plate pumps are employed in a number of different applications and operate under well-known principals. In general, wobble-plate pumps typically include pistons that move in a reciprocating manner within corresponding pump chambers. In many cases, the pistons are moved by a cam surface of a wobble plate that is rotated by a motor or other driving device. The reciprocating movement of the pistons pumps fluid from an inlet port to an outlet port of the pump.

In many conventional wobble plate pumps, the pistons of the pump are coupled to a flexible diaphragm that is positioned between the wobble plate and the pump chambers. In such pumps, each one of the pistons is an individual component separate from the diaphragm, requiring numerous components to be manufactured and assembled. A convolute is sometimes employed to connect each piston and the diaphragm so that the pistons can reciprocate and move with respect to the remainder of the diaphragm. Normally, the thickness of each portion of the convolute must be precisely designed for maximum pump efficiency without risking rupture of the diaphragm.

Many conventional pumps (including wobble plate pumps) have an outlet port coupled to an outlet chamber located within the pump and which is in communication with each of the pump chambers. The outlet port is conventionally positioned radially away from the outlet chamber. As the fluid is pumped out of each of the pump chambers sequentially, the fluid enters the outlet chamber and flows along a circular path. However, in order to exit the outlet chamber through the outlet port, the fluid must diverge at a relatively sharp angle from the circular path. When the fluid is forced to diverge from the circular path, the efficiency of the pump is reduced, especially at lower pressures and higher flow rates.

Many conventional pumps include a mechanical pressure switch that shuts off the pump when a certain pressure (i.e., the shut-off pressure) is exceeded. The pressure switch is typically positioned in physical communication with the fluid in the pump. When the pressure of the fluid exceeds the shut-off pressure, the force of the fluid moves the mechanical switch to open the pump's power circuit. Mechanical pressure switches have several limitations. For example, during the repeated opening and closing of the pump's power circuit, arcing and scorching often occurs between the contacts of the switch. Due to this arcing and scorching, an oxidation layer forms over the contacts of the switch, and the switch will eventually be unable to close the pump's power circuit. In addition, most conventional mechanical pressure switches are unable to operate at high frequencies, which results in the pump being completely "on" or completely "off." The repeated cycling between completely "on" and completely "off" results in louder operation. Moreover, since mechanical switches are either completely "on" or completely "off," mechanical switches are unable to precisely control the power provided to the pump.

Wobble-plate pumps are often designed to be powered by a battery, such as an automotive battery. In the pump embodiments employing a pressure switch as described above, power from the battery is normally provided to the pump depending upon whether the mechanical pressure switch is open or closed. If the switch is closed, full battery power is provided to the pump. Always providing full battery power to the pump can cause voltage surge problems when the battery is being charged (e.g., when an automotive battery in a recreational vehicle is being charged by another automotive battery in another operating vehicle). Voltage surges that occur while the battery is being charged can damage the components of the pump. Conversely, voltage drop problems can result if the battery cannot be mounted in close proximity to the pump (e.g., when an automotive battery is positioned adjacent to a recreational vehicle's engine and the pump is mounted in the rear of the recreational vehicle). Also, the voltage level of the battery drops as the battery is drained from use. If the voltage level provided to the pump by the battery becomes too low, the pump may stall at pressures less than the shut-off pressure. Moreover, when the pump stalls at pressures less than the shut-off pressure, current is still being provided to the pump's motor even through the motor is unable to turn. If the current provided to the pump's motor becomes too high and the pump's temperature becomes too high, the components of the pump's motor can be damaged.

In light of the problems and limitations described above, a need exists for a pump apparatus and method employing a diaphragm that is easy to manufacture and is reliable (whether having integral pistons or otherwise). A need also exists for a pump having an outlet port that is positioned for improved fluid flow from the pump outlet port. Furthermore, a need further exists for a pump control system designed to better control the power provided to the pump, to provide for quiet operation of the pump, to prevent pump cycling, to maintain the temperature of the pump, to protect against reverse polarity, to provide a "kick" current, and to prevent voltage surges, voltage drops, and excessive currents from damaging the pump. Each embodiment of the present invention achieves one or more of these results.

SUMMARY OF THE INVENTION

Some embodiments of the present invention provide a diaphragm for use with a pump having pistons driving the diaphragm to pump fluid through the pump. The pistons can be integrally formed in a body portion of the diaphragm, thereby resulting in fewer components for the manufacture and assembly of the pump. Also, each of the pistons can be coupled (i.e., attached to or integral therewith) to the body portion of the diaphragm by a convolute. Each of the pistons can have a top surface lying generally in a single plane. In some embodiments, each convolute is comprised of more material at its outer perimeter so that the bottom surface of each convolute lies at an angle with respect to the plane of the piston top surfaces. The angled bottom surface of the convolutes allows the pistons a greater range of motion with respect to the outer perimeter of the convolute, and can reduce diaphragm stresses for longer diaphragm life.

In some embodiments of the present invention, an outlet port of the pump is positioned tangentially with respect to the perimeter of an outlet chamber. The tangential outlet port allows fluid flowing in a circular path within the outlet chamber to continue along the circular path as the fluid exits the outlet chamber. This results in better pump efficiency, especially at lower pressures and higher flow rates.

Some embodiments of the present invention further provide a pump having a non-mechanical pressure sensor coupled to a pump control system. However, some embodiments of the pump do not include a pressure sensor or a pump control system. The pressure sensor provides a signal representative of the changes in pressure within the pump to a microcontroller within the pump control system. Based upon the sensed pressure, the microcontroller can provide a pulse-width modulation control signal to an output power stage coupled to the pump. The output power stage selectively provides power to the pump based upon the control signal. Due to the pulse-width modulation control signal, the speed of the pump gradually increases or decreases rather than cycling between completely "on" and completely "off," resulting in more efficient and quieter operation of the pump.

The pump control system can also include an input power stage designed to be coupled to a battery. The microcontroller is coupled to the input power stage in order to sense the voltage level of the battery. If the battery voltage is above a high threshold (e.g., when the battery is being charged), the microcontroller can prevent power from being provided to the pump. If the battery voltage is below a low threshold (e.g., when the voltage available from the battery will only allow the pump to stall below the shut-off pressure), the microcontroller can also prevent power from being provided to the pump. In some embodiments, the microprocessor only generates a control signal if the sensed battery voltage is less than the high threshold and greater than the low threshold.

In some embodiments, the pump control system is also capable of adjusting the pump's shut-off pressure based upon the sensed battery voltage in order to prevent the pump from stalling when the battery is not fully charged. The microprocessor can compare the sensed pressure to the shut-off pressure value. If the sensed pressure is less than the shut-off pressure value, the microprocessor generates a high control signal so that the output power stage provides power to the pump. If the sensed pressure is greater than the shut-off pressure value, the microprocessor generates a low control signal so that the output power stage does not provide power to the pump.

In some embodiments, the pump control system limits the current provided to the pump in order to prevent high currents from damaging the pump's components. The pump control system is capable of adjusting a current limit value based upon the sensed pressure of the fluid within the pump. The pump control system can include a current-sensing circuit capable of sensing the current being provided to the pump. If the sensed current is less than the current limit value, the microcontroller can generate a high control signal so that the output power stage provides power to the pump. If the sensed current is greater than the current limit value, the microcontroller can generate a low control signal until the sensed current is less than the current limit value.

According to a method of the invention, the microcontroller can sense the voltage level of the battery and determine whether the voltage level is between a high threshold and a low threshold. The microcontroller only allows the pump to operate if the voltage level of the battery is between the high threshold and the low threshold. In some embodiments, the microcontroller can estimate the length of the cable between the battery and the pump by sensing the difference between the voltage level when the pump is "off" and when the pump is "on." The microprocessor adjusts the shut-off pressure for the pump based on the sensed voltage and, in some embodiments, based on the length of the battery cable.

The microcontroller can also sense the pressure of the fluid within the pump and can determine whether the pressure is greater than the shut-off pressure value. If the sensed pressure is greater than the shut-off pressure value, the microprocessor can adjust a pulse-width modulation control signal in order to provide less power to the pump. If the sensed pressure is less than the shut-off pressure value, the microprocessor can determine whether the pump is turned off. If the pump is not turned off, the microprocessor adjusts the pulse-width modulation control signal in order to provide more power to the pump.

If the sensed pressure is less than the shut-off pressure value and the pump is turned off, the microprocessor can generate a pulse-width modulation control signal to re-start the pump. The microcontroller can sense the pressure of the fluid within the pump and adjust the current limit value based on the sensed pressure. The microcontroller can also sense the current being provided to the pump. If the sensed current is greater than the current limit value, the microcontroller can adjust the pulse-width modulation control signal in order to provide less power to the pump. If the sensed current is less than the current limit value, the microcontroller can adjust the pulse-width modulation control signal in order to provide more power to the pump.

The pump control system can also include a temperature sensor capable of producing a signal representative of changes in a temperature of the pump, such as the surface temperature of the pump. The microcontroller can be coupled to receive the signal from the temperature sensor and can provide a current to the pump based on the sensed temperature. An output power stage can be coupled to receive the control signal from the microcontroller and can be capable of controlling the application of current to the pump in response to the control signal in order to stabilize the temperature of the pump.

In one embodiment of the method of the invention, the pressure sensor senses a pressure in the pump, the microcontroller compares the sensed pressure to a shut-off pressure value and provides an increased or "kick" current to the pump when the sensed pressure is approaching the shut-off pressure value.

In some embodiments, the a microcontroller operates the pump according to a high-flow mode and a low-flow mode. For example, the high-flow mode can have a high-flow current limit value that is not dependent on the sensed pressure, and the low-flow mode can have a low-flow current limit value that is less than the high-flow current limit value and that is dependent on the sensed pressure.

In another embodiment, the microcontroller is programmed to generate an oscillating control signal if the sensed pressure is approaching a shut-off pressure and the pump is operating in a low-flow mode, and the microprocessor is programmed to generate a shut-off control signal if the sensed pressure is equal to or greater than the shut-off pressure and there is no flow through the pump. The output power stage receives the oscillating control signal and the shut-off control signal. The output power stage provides power to the pump until flow through the pump has stopped.

In one embodiment, the pump control circuit includes a first cable designed to connect to the positive terminal of the battery and a second cable designed to connect to the negative terminal of the battery. An input power stage is connected to the pump. The input power stage has a positive input connected to the first cable and a negative input connected to the second cable. The input power stage can include a power temperature control device so that the pump will operate if the first cable is connected to the negative terminal of the battery and the second cable is connected to the positive terminal of the battery.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show some embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Before one embodiment of the invention is explained in full detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including" and "comprising" and variations thereof herein is meant to encompass the items listed thereafter and equivalents thereof as well as additional items.

Figure 1:
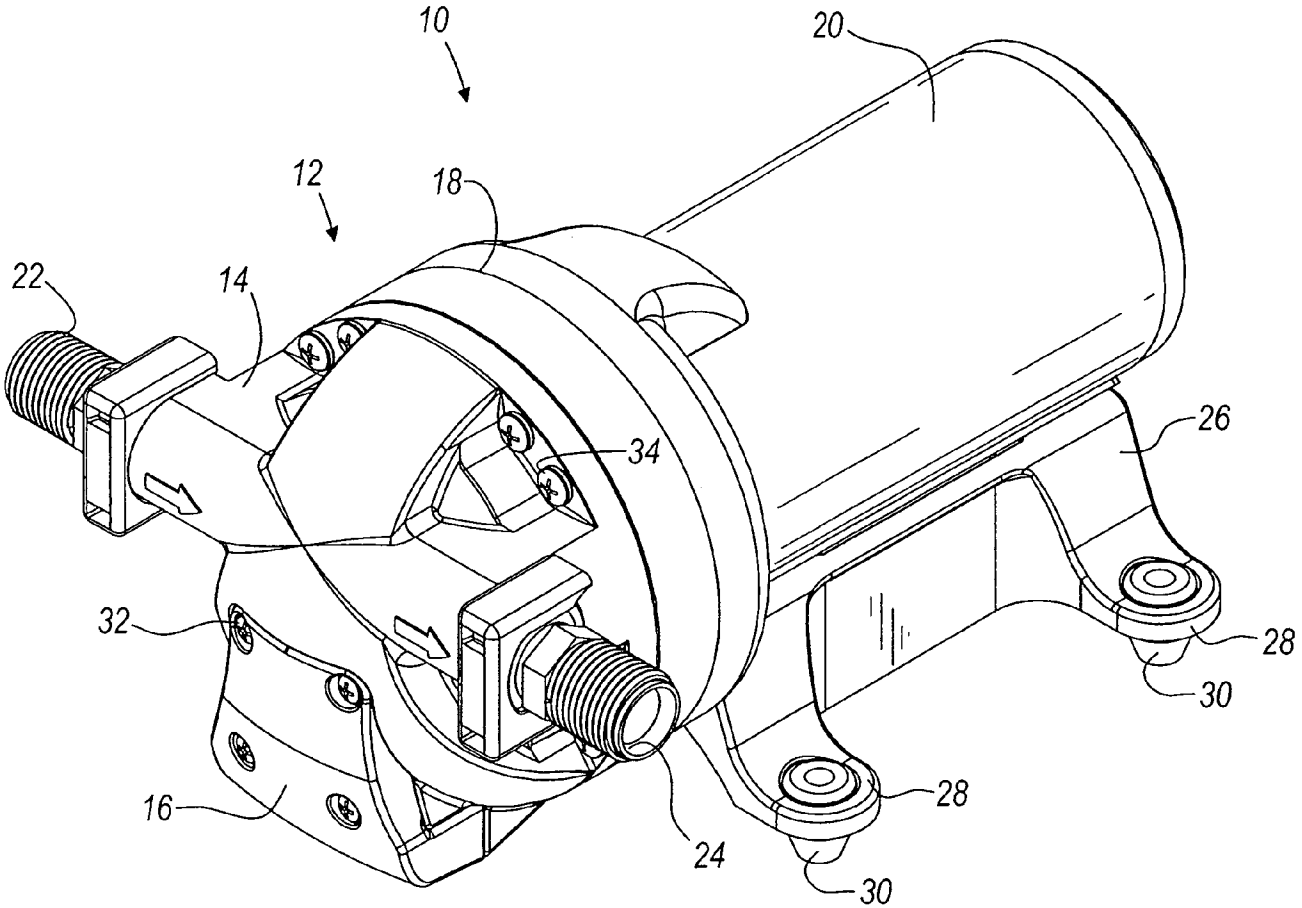
FIG. 1 is a perspective view of a pump according to an embodiment of the present invention.
Figure 2:
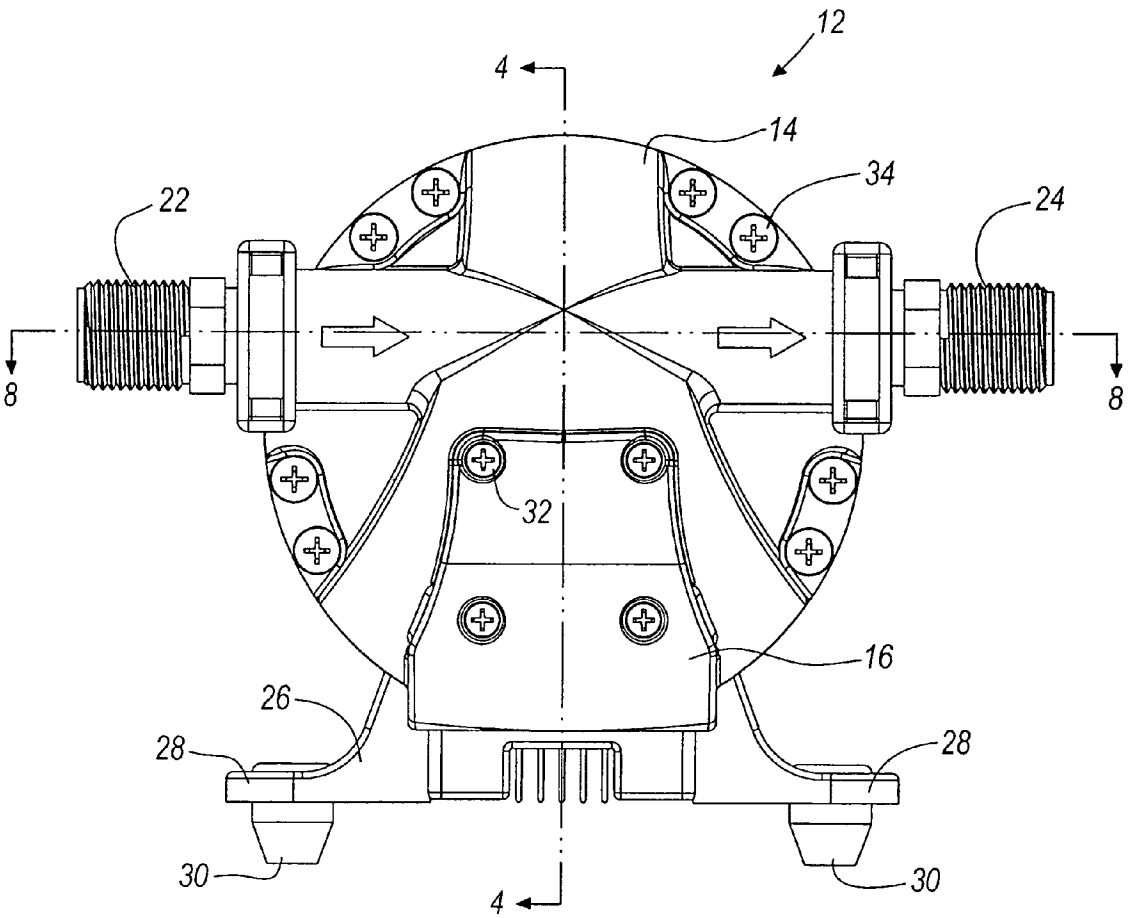
FIG. 2 is a front view of the pump illustrated in FIG. 1.
Figure 3:
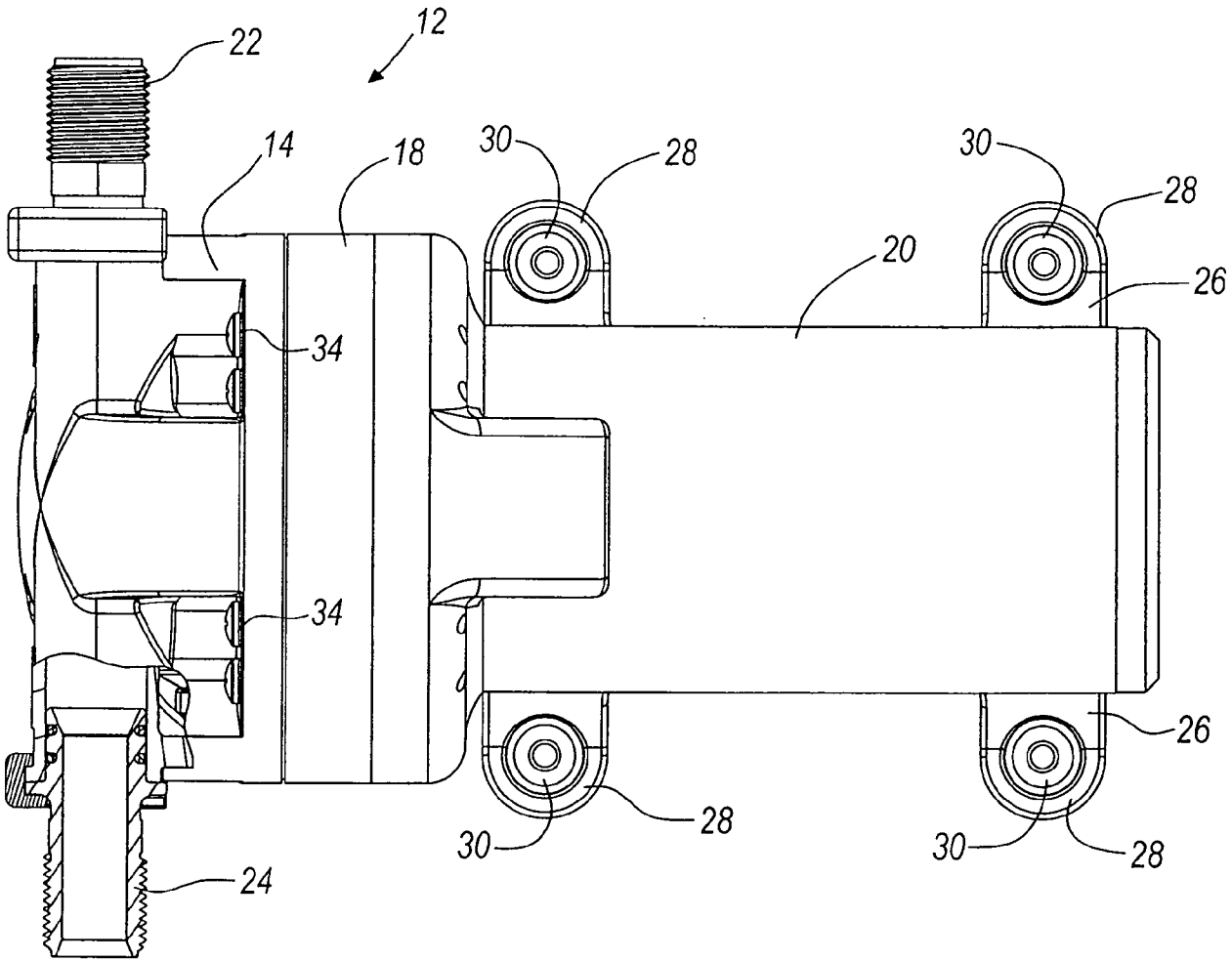
FIG. 3 is a top view of the pump illustrated in FIGS. 1 and 2.

FIGS. 1-3 illustrate the exterior of a pump 10 according to one embodiment of the present invention. In some embodiments such as that shown in the figures, the pump 10 includes a pump head assembly 12 having a front housing 14, a sensor housing 16 coupled to the front housing 14 via screws 32, and a rear housing 18 coupled to the front housing 14 via screws 34. Although screws 32, 34 are employed to connect the sensor housing 16 and rear housing 18 to the front housing 14 as just described, any other type of fastener can instead be used (including without limitation bolt and nut sets or other threaded fasteners, rivets, clamps, buckles, and the like). It should also be noted that reference herein and in the appended claims to terms of orientation (such as front and rear) are provided for purposes of illustration only and are not intended as limitations upon the present invention. The pump 10 and various elements of the pump 10 can be oriented in any manner desired while still falling within the spirit and scope of the present invention.

The pump 10 can be connected to a motor assembly 20, and can be connected thereto in any conventional manner such as those described above with reference to the connection between the front and rear housings 14, 18. The pump 10 and motor assembly 20 can have a pedestal 26 with legs 28 adapted to support the weight of the pump 10 and motor assembly 20. Alternatively, the pump 10 and/or motor assembly 20 can have or be connected to a bracket, stand, or any other device for mounting and supporting the pump 10 and motor assembly 20 upon a surface in any orientation. The legs 28 each include cushions 30 constructed of a resilient material (such as rubber, urethane, and the like), so that vibration from the pump 10 to the surrounding environment is reduced.

The front housing 14 can include an inlet port 22 and an outlet port 24. The inlet port 22 can be connected to an inlet fluid line (not shown) and the outlet port 24 is connected to an outlet fluid line (not shown). The inlet port 22 and the outlet port 24 can each be provided with fittings for connection to inlet and outlet fluid lines (not shown). In some embodiments, the inlet port 22 and outlet port 24 are provided with quick disconnect fittings, although threaded ports can instead be used as desired. Alternatively, any other type of conventional fluid line connector can instead be used, including compression fittings, swage fittings, and the like. In some embodiments of the present invention, the inlet and outlet ports are provided with at least one (and in some embodiments, two) gaskets, O-rings, or other seals to help prevent inlet and outlet port leakage.

The pump head assembly 12 has front and rear housing portions 14, 18 as illustrated in the figures. Alternatively, the pump head assembly 12 can have any number of body portions connected together in any manner (including the manners of connection described above with reference to the connection between the front and rear housing portions 14, 18). In this regard, it should be noted that the housing of the pump head assembly 12 can be defined by housing portions arranged in any other manner, such as by left and right housing portions, upper and lower housing portions, multiple housing portions connected together in various manners, and the like. Accordingly, the inlet and outlet ports 22, 24 of the pump head assembly 12 and the inlet and outlet chambers 92, 94 (described in greater detail below) can be located in other portions of the pump housing determined at least partially upon the shape and size of the housing portions 14, 18 and upon the positional relationship of the inlet and outlet ports 22, 24 and the inlet and outlet chambers 92, 94 to components within the pump head assembly 12 (described in greater detail below).

Figure 4:
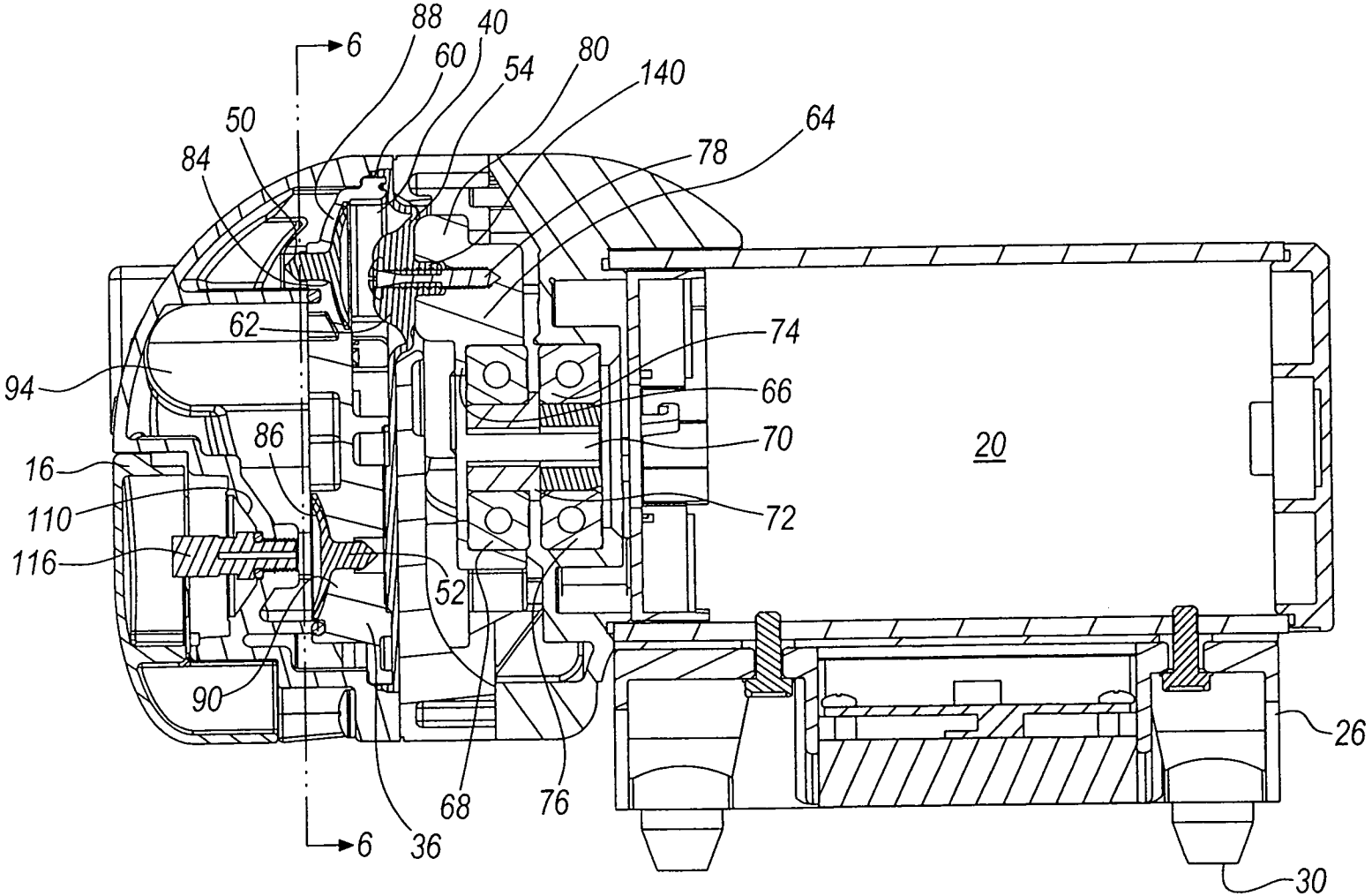
FIG. 4 is a cross-sectional view of the pump illustrated in FIGS. 1-3, taken along line 4-4 of FIG. 2.
Figure 5:
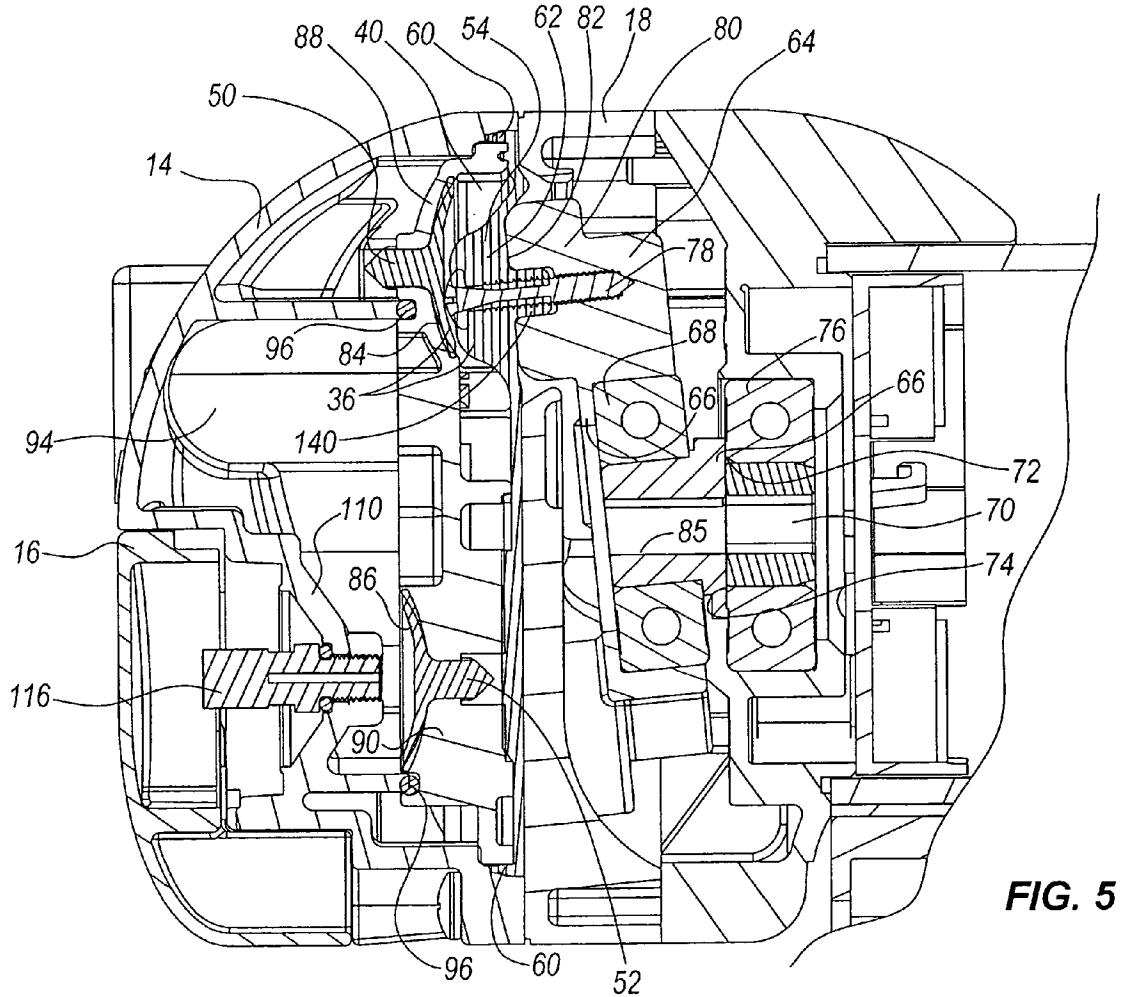
FIG. 5 is a detail view of FIG. 4.
Figure 6:
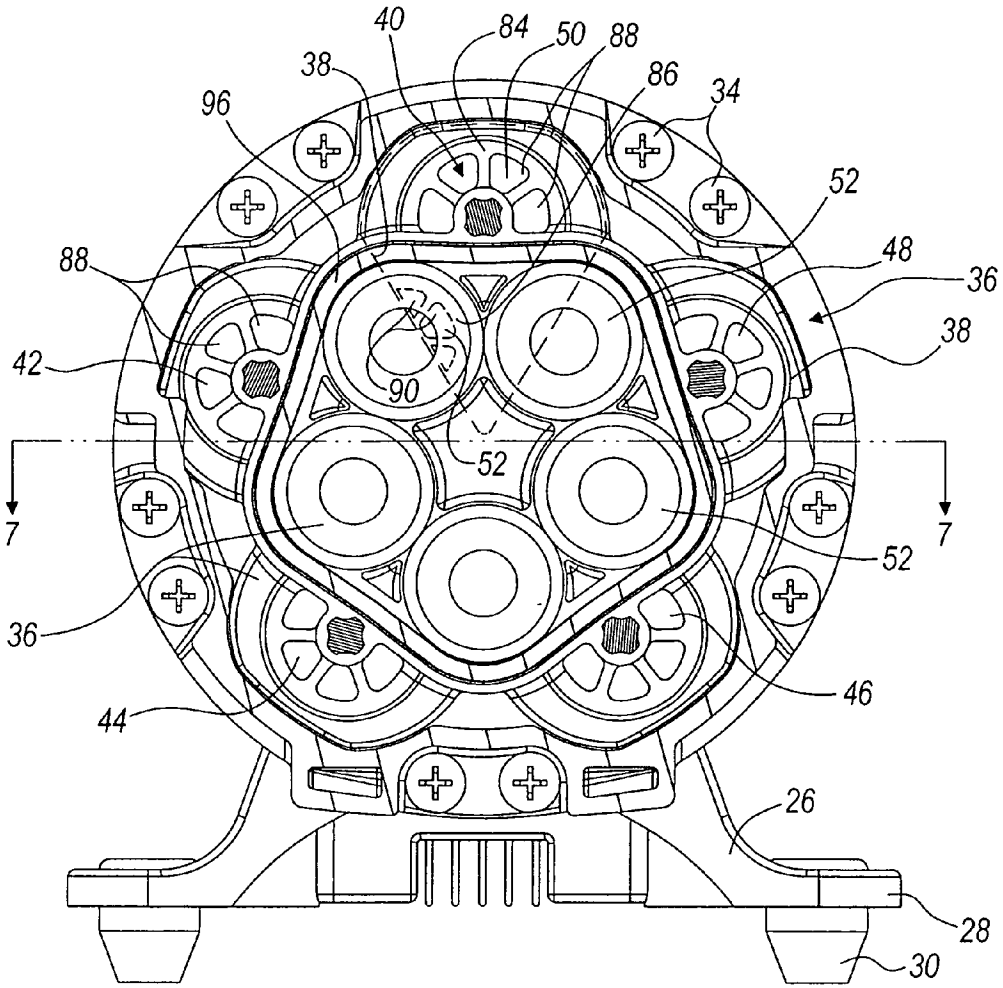
FIG. 6 is cross-sectional view of the pump illustrated in FIGS. 1-5, taken along line 6-6 of FIG. 4.
Figure 7:
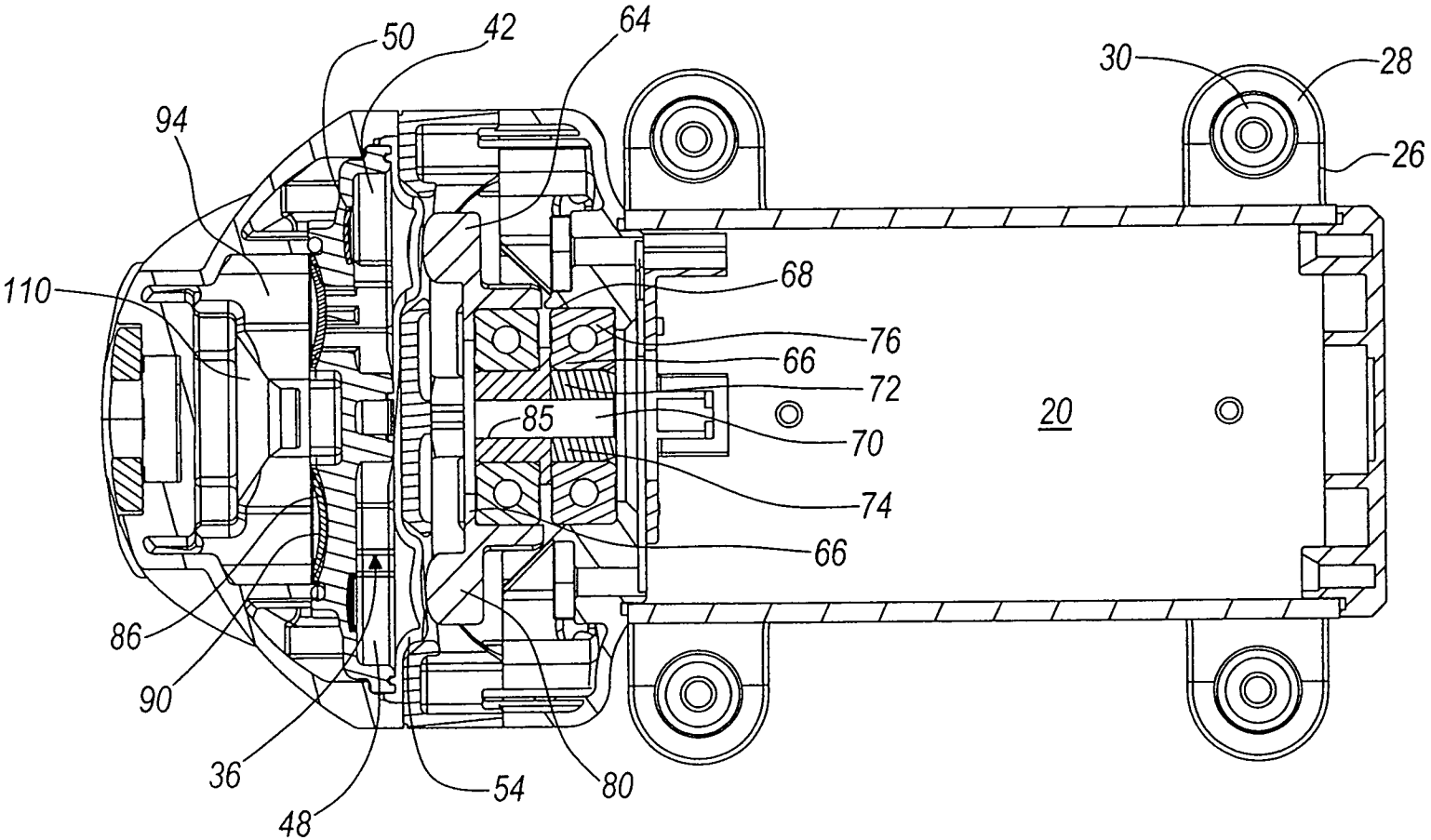
FIG. 7 is a cross-sectional view of the pump illustrated in FIGS. 1-6, taken along line 7-7 of FIG. 6.

FIGS. 4-9 illustrate various aspects of the interior of the pump 10 according to one embodiment of the present invention. A valve assembly 36 is coupled between the front housing 14 and the rear housing 18. As best shown in FIG. 6, the valve assembly 36 defines one or more chambers 38 within the pump 10. In FIG. 6, the shape of one of the chambers 38 (located on the reverse side of the valve assembly 36 as viewed in FIG. 6) is shown in dashed lines. The chambers 38 in the pump 10 are tear-drop shaped as shown in the figures, but can take any other shape desired, including without limitation round, rectangular, elongated, and irregular shapes.

In some embodiments, the pump 10 includes five chambers 38, namely a first chamber 40, a second chamber 42, a third chamber 44, a fourth chamber 46, and a fifth chamber 48. Although the pump 10 is described herein as having five chambers 38, the pump 10 can have any number of chambers 38, such as two chambers 38, three chambers 38, or six chambers 38.

For each one of the chambers 38, the valve assembly 36 includes an inlet valve 50 and an outlet valve 52. The inlet valve 50 is positioned within an inlet valve seat 84 defined by the valve assembly 36 within each one of the chambers 38, while the outlet valve 52 is positioned within an outlet valve seat 86 defined by the valve assembly 36 corresponding to each one of the chambers 38. The inlet valve 50 is positioned within the inlet valve seat 84 so that fluid is allowed to enter the chamber 38 through inlet apertures 88, but fluid cannot exit the chamber 38 through inlet apertures 88. Conversely, the outlet valve 52 is positioned within the outlet valve seat 86 so that fluid is allowed to exit the chamber 38 through outlet apertures 90, but fluid cannot enter the chamber 38 through outlet apertures 90. With reference to FIG. 6, fluid therefore enters each chamber 38 through inlet apertures 88 (i.e., into the plane of the page) of a one-way inlet valve 50, and exits each chamber 38 through outlet apertures 90 (i.e., out of the plane of the page) of a one-way outlet valve 52. The valves 50, 52 are conventional in nature and in the illustrated embodiment are disc-shaped flexible elements secured within the valve seats 84, 86 by a snap fit connection between a headed extension of each valve 50, 52 into a central aperture in a corresponding valve seat 84, 86.

Figure 8:
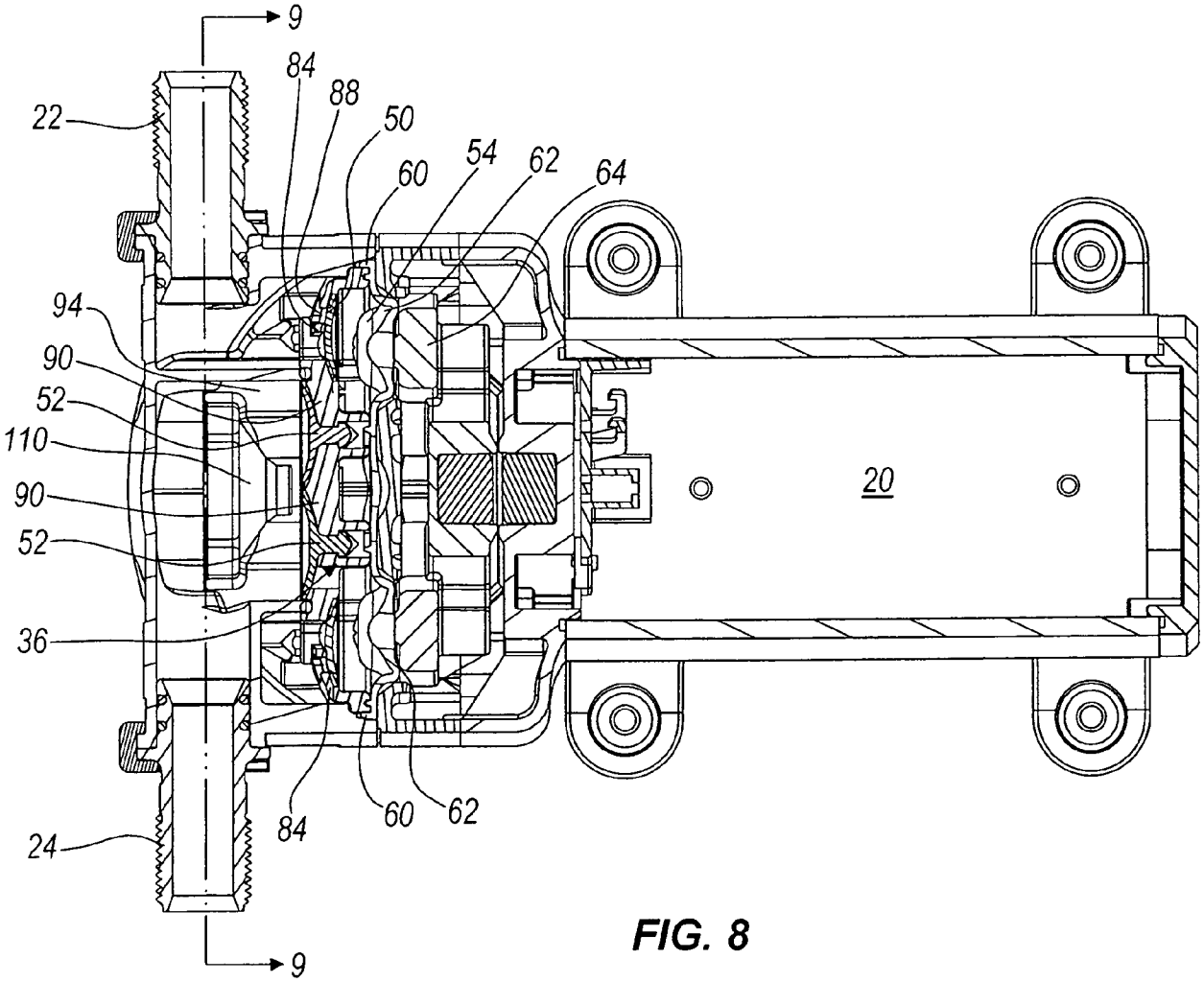
FIG. 8 is a cross-sectional view of the pump illustrated in FIGS. 1-7, taken along line 8-8 of FIG. 2.
Figure 9:
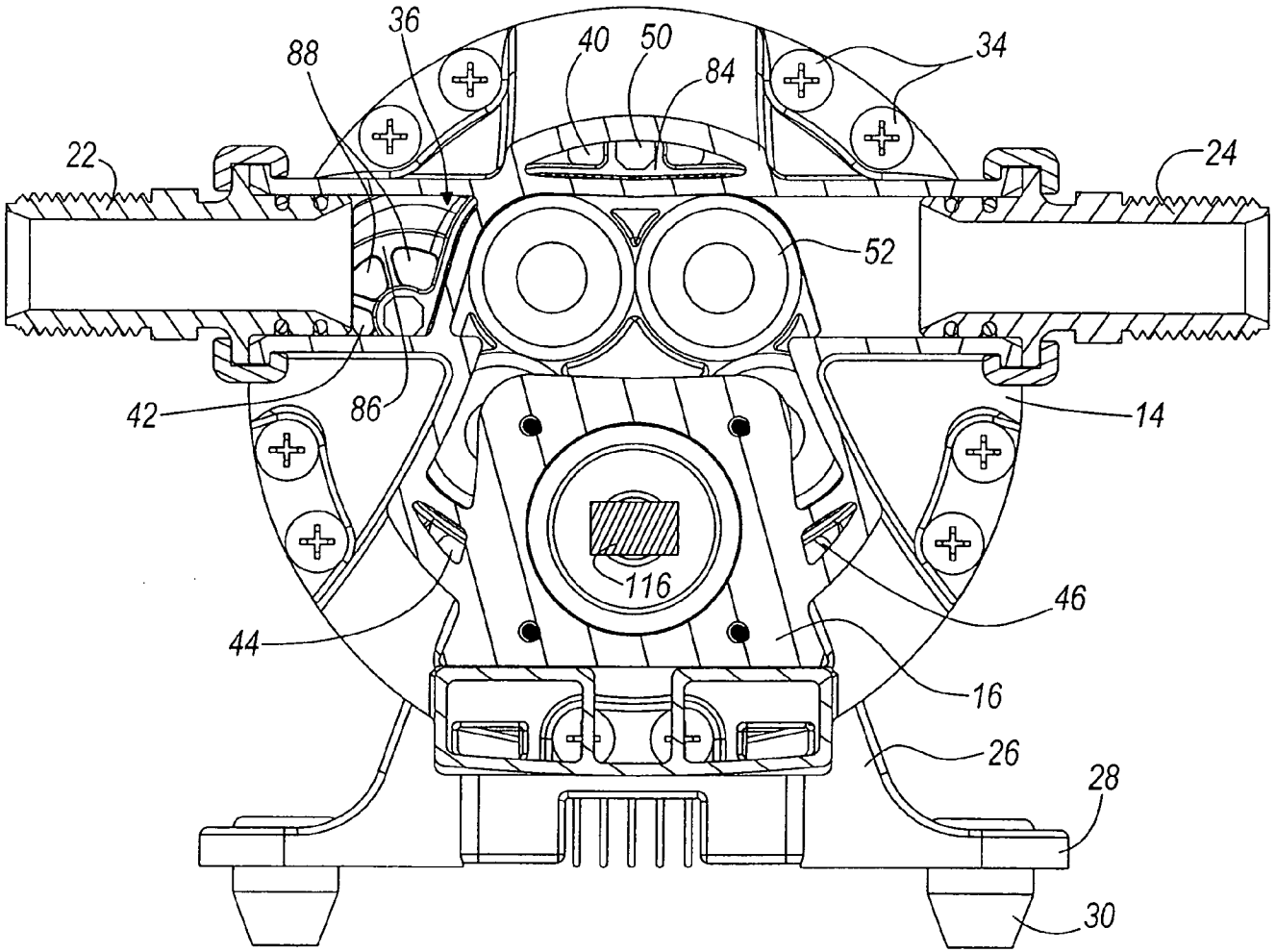
FIG. 9 is a cross-sectional view of the pump illustrated in FIGS. 1-8, taken along line 9-9 of FIG. 8.
Figure 10A:
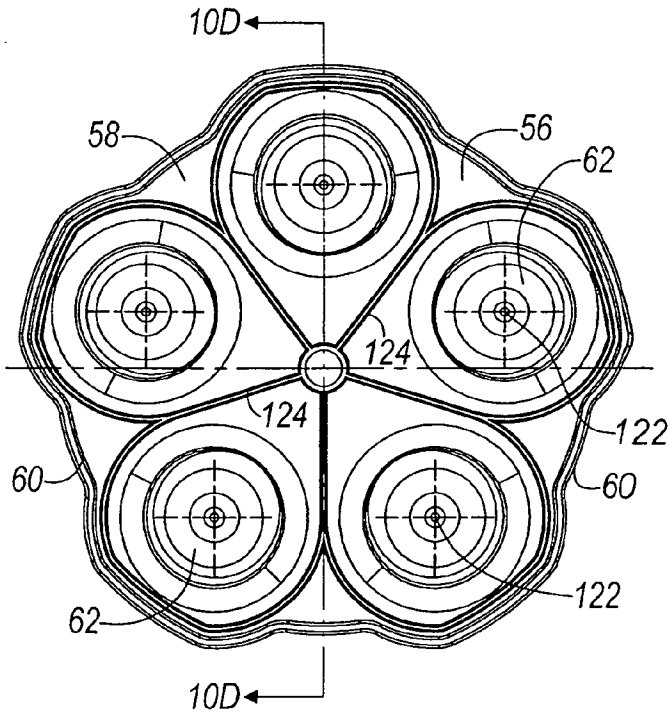
FIGS. 10A-10E illustrate a pump diaphragm according to an embodiment of the present invention.
Figure 10C:
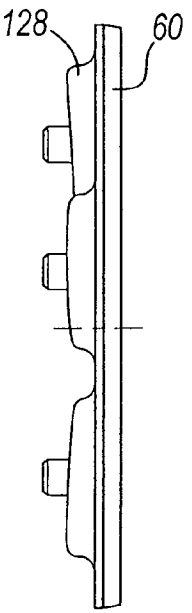
Figure 10B:
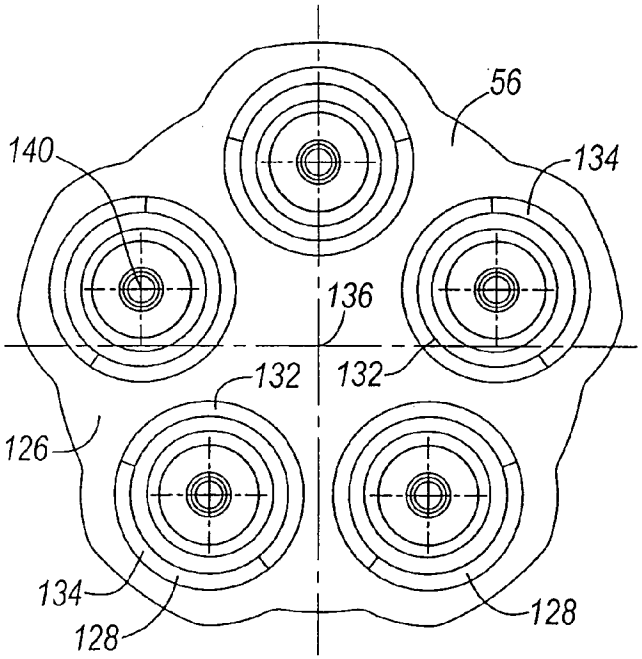
Figure 10D:
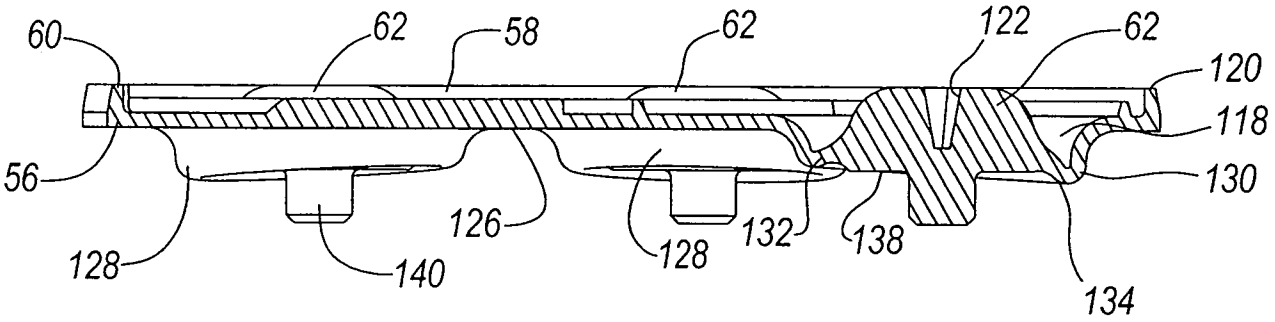
Figure 10E:
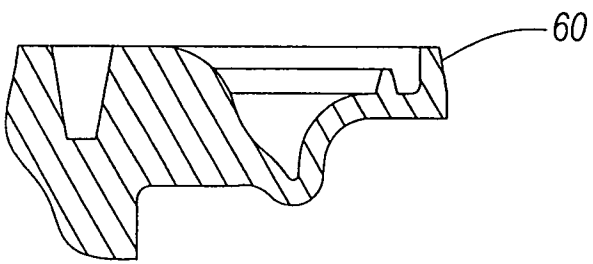

As best shown in FIGS. 4, 5, and 8, a diaphragm 54 is located between the valve assembly 36 and the rear housing 18. Movement of the diaphragm 54 causes fluid in the pump 10 to move as described above through the valves 50, 52. With reference again to FIG. 6, the diaphragm 54 in the illustrated embodiment is located over the valves 50, 52 shown in FIG. 6. The diaphragm 54 is positioned into a sealing relationship with the valve assembly 36 (e.g., over the valves 50, 52 as just described) via a lip 60 that extends around the perimeter of the diaphragm 54. The diaphragm 54 includes one or more pistons 62 corresponding to each one of the chambers 38. The diaphragm 54 in the illustrated embodiment has one piston 62 corresponding to each chamber 38.

The pistons 62 are connected to a wobble plate 66 so that the pistons 62 are actuated by movement of the wobble plate 66. Any wobble plate arrangement and connection can be employed to actuate the pistons 62 of the diaphragm 54. In the illustrated embodiment, the wobble plate 66 has a plurality of rocker arms 64 that transmit force from the center of the wobble plate 66 to locations adjacent to the pistons 62. Any number of rocker arms 64 can be employed for driving the pistons 62, depending at least partially upon the number and arrangement of the pistons 62. Although any rocker arm shape can be employed, the rocker arms 64 in the illustrated embodiment have extensions 80 extending from the ends of the rocker arms 64 to the pistons 62 of the diaphragm 54. The pistons 62 of the diaphragm 54 are connected to the rocker arms, and can be connected to the extensions 80 of the rocker arms 64 in those embodiments having such extensions 80. The center of each piston 62 is secured to a corresponding rocker arm extension 80 via a screw 78. The pistons 62 can instead be attached to the wobble plate 66 in any other manner, such as by nut and bolt sets, other threaded fasteners, rivets, by adhesive or cohesive bonding material, by snap-fit connections, and the like.

The rocker arm 64 is coupled to a wobble plate 66 by a first bearing assembly 68, and can be coupled to a rotating output shaft 70 of the motor assembly 20 in any conventional manner. In the illustrated embodiment, the wobble plate 66 includes a cam surface 72 that engages a corresponding surface 74 of a second bearing assembly 76 (i.e., of the motor assembly 20). The wobble plate 66 also includes an annular wall 85 which is positioned off-center within the wobble plate 66 in order to engage the output shaft 70 in a camming action. Specifically, as the output shaft 70 rotates, the wobble plate 66 turns and, due to the cam surface 72 and the off-center position of the annular wall 84, the pistons 62 are individually engaged in turn. One having ordinary skill in the art will appreciate that other arrangements exist for driving the wobble plate 66 in order to actuate the pistons 62, each one of which falls within the spirit and scope of the present invention.

When the pistons 62 are actuated by the wobble plate 66, the pistons 62 move within the chambers 38 in a reciprocating manner. As the pistons 62 move away from the inlet valves 50, fluid is drawn into the chambers 38 through the inlet apertures 88. As the pistons 62 move toward the inlet valves 50, fluid is pushed out of the chambers 28 through the outlet apertures 90 and through the outlet valves 52. The pistons 62 can be actuated sequentially. For example, the pistons 62 can be actuated so that fluid is drawn into the first chamber 40, then the second chamber 42, then the third chamber 44, then the fourth chamber 46, and finally into the fifth chamber 48.

FIGS. 10A-10E illustrate the structure of a diaphragm 54 according to an embodiment of the present invention. The diaphragm 54 is comprised of a single piece of resilient material with features integral with and molded into the diaphragm 54. Alternatively, the diaphragm 54 can be constructed of multiple elements connected together in any conventional manner, such as by fasteners, adhesive or cohesive bonding material, by snap-fit connections, and the like. The diaphragm 54 includes a body portion 56 lying generally in a first plane 118. The diaphragm 54 has a front surface 58 which includes the pistons 62. The pistons 62 lie generally in a second plane 120 parallel to the first plane 118 of the body portion 56.

In some embodiments, each piston 62 includes an aperture 122 at its center through which a fastener (e.g., a screw 78 as shown in FIGS. 4 and 5) is received for connecting the fastener to the wobble plate 66. The front surface 58 of the diaphragm 54 can also include raised ridges 124 extending around each of the pistons 62. The raised ridges 124 correspond to recesses (not shown) in the valve assembly 36 that extend around each one of the chambers 38. The raised ridges 124 and the recesses are positioned together to form a sealing relationship between the diaphragm 54 and the valve assembly 36 in order to define each one of the chambers 38. In other embodiments, the diaphragm 54 does not have raised ridges 124 as just described, but has a sealing relationship with the valve assembly 54 to isolate the chambers 38 in other manners. For example, the valve assembly 36 can have walls that extend to and are in flush relationship with the front surface 58 of the diaphragm 54. Alternatively, the chambers 38 can be isolated from one another by respective seals, one or more gaskets, and the like located between the valve assembly 36 and the diaphragm 54. Still other manners of isolating the chambers 38 from one another between the diaphragm 54 and the valve assembly 36 are possible, each one of which falls within the spirit and scope of the present invention.

The diaphragm 54 includes a rear surface 126 which includes convolutes 128 corresponding to each one of the pistons 62. The convolutes 128 couple the pistons 62 to the body portion 56 of the diaphragm 54. The convolutes 128 function to allow the pistons 62 to move reciprocally without placing damaging stress upon the diaphragm 54. Specifically, the convolutes 128 permit the pistons 62 to move with respect to the plane 118 of the body portion 56 without damage to the diaphragm 54. The convolutes 128 lie generally in a third plane 130.

In some embodiments, each convolute 128 includes an inner perimeter portion 132 positioned closer to a center point 136 of the diaphragm 54 than an outer perimeter portion 134. The outer perimeter portion 134 of each convolute 128 can be comprised of more material than the inner perimeter portion 132. In other words, the depth of the convolute 128 at the outer perimeter portion 134 can be larger than the depth of the convolute 128 at the inner perimeter portion 132. This arrangement therefore provides the piston 62 with greater range of motion at the outer perimeter than at the inner perimeter. In this connection, a bottom surface 138 of each convolute 128 can be oriented at an angle sloping away from the center point 136 of the diaphragm 54 and away from the second plane in which the pistons 62 lie. When this angle of the convolutes is between 2 and 4 degrees, stress on the diaphragm is reduced. In some embodiments, this angle can be between 2.5 and 3.5 degrees. In one embodiment, an angle of approximately 3.5 degrees can be employed to reduce stress in the diaphragm 54. By reducing diaphragm stress in this manner, the life of the diaphragm 54 is significantly increased, thereby improving pump reliability.

In some embodiments of the present invention, the pistons 62 have rearwardly extending extensions 140 for connection of the diaphragm 54 to the wobble plate 66. The extensions 140 can be separate elements connected to the diaphragm 54 in any conventional manner, but can be integral with the bottom surfaces 138 of the convolutes 128. With reference to the illustrated embodiment, the screws 78 are received in the apertures 122, through the cylindrical extensions 140, and into the extensions 80 of the rocker arms 64 as best shown in FIGS. 4 and 5. If desired, bushings 82 can also be coupled around the cylindrical extensions 140 between the convolutes 128 and the extensions 80 of the rocker arm 64.

Figure 12B:
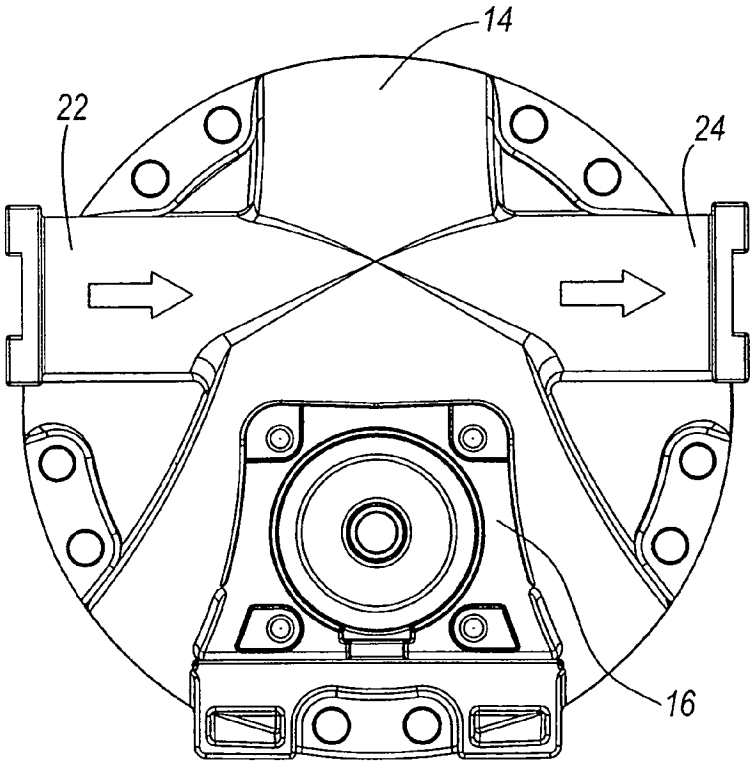
FIG. 12B is an exterior view of the pump front housing illustrated in FIG. 12A.
Figure 12A:
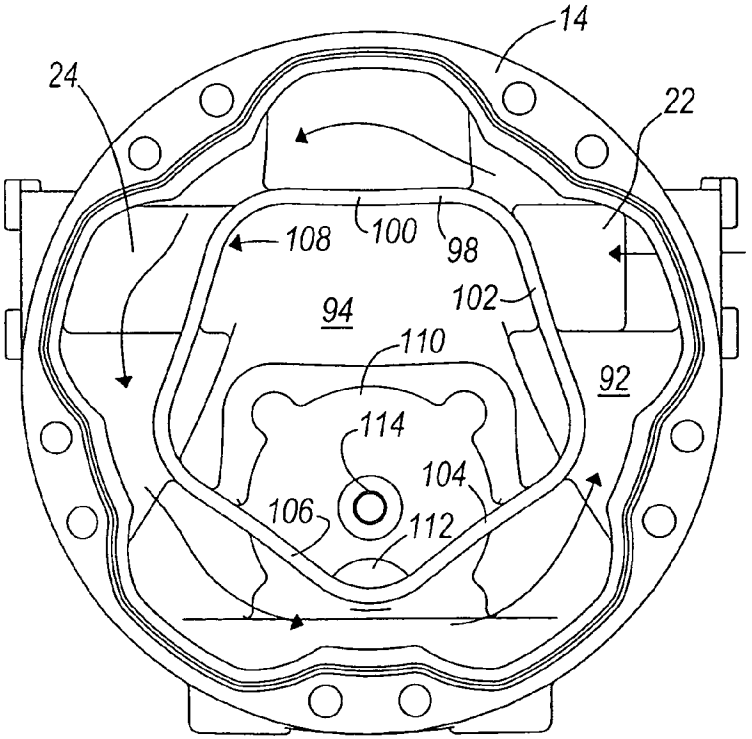
FIG. 12A is an interior view of a pump front housing according to an embodiment of the present invention.

With reference next to FIG. 12A, the interior of the front housing 14 includes an inlet chamber 92 and an outlet chamber 94. The inlet chamber 92 is in communication with the inlet port 22 and the outlet chamber 94 is in communication with the outlet port 24. The inlet chamber 92 is separated from the outlet chamber 94 by a seal 96 (as shown in FIG. 6). The seal 96 can be retained within the pump 10 in any conventional manner, such as by being received within a recess in the valve assembly 36 or pump housing, by adhesive or cohesive bonding material, by one or more fasteners, and the like.

When the valve assembly 36 of the illustrated embodiment is positioned within the front housing 14, the seal 96 engages wall 98 formed within the front housing 14 in order to prevent fluid from communicating between the inlet chamber 92 and the outlet chamber 94. Thus, the inlet port 22 is in communication with the inlet chamber 92, which is in communication with each of the chambers 38 via the inlet apertures 88 and the inlet valves 50. The chambers 38 are also in communication with the outlet chamber 94 via the outlet apertures 90 and the outlet valves 52.

Figure 11B:
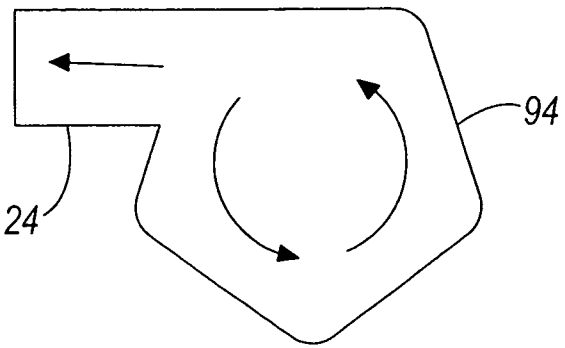
FIG. 11B is a schematic illustration of an outlet chamber and an outlet port of a pump according to an embodiment of the present invention.
Figure 11A:
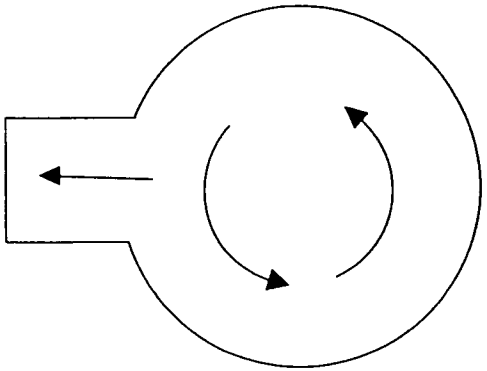
FIG. 11A PRIOR ART
FIG. 11A is a schematic illustration of an outlet chamber and an outlet port of a prior art pump.

As shown schematically in FIG. 11A, the outlet ports in pumps of the prior art are often positioned non-tangentially with respect to the circumference of an outlet chamber. In these pumps, as the pistons sequentially push the fluid into the outlet chamber, the fluid flows along a circular path in a counter-clockwise rotation within the outlet chamber. However, in order to exit through the outlet port, the fluid must diverge from the circular path at a relatively sharp angle. Conversely, as shown schematically in FIG. 11B, the outlet port 24 of the pump 10 in some embodiments of the present invention is positioned tangentially to the outlet chamber 94. Specifically, as shown in FIG. 12A, the outlet port 24 is positioned tangentially with respect to the wall 98 and the outlet chamber 94. In the pump 10, the fluid also flows in a circular path and in a counter-clockwise rotation within the outlet chamber 94, but the fluid is not forced to diverge from the circular path to exit through the outlet port 24 at a sharp angle. Rather, the fluid continues along the circular path and transitions into the outlet port 24 by exiting tangentially from flow within the outlet chamber 94. Having the outlet port 24 tangential to the outlet chamber 94 can also help to evacuate air from the pump 10 at start-up. Having the outlet port 24 tangential to the outlet chamber 94 can also improve the efficiency of the pump 10 during low pressure/high flow rate conditions.

Although the wall 98 defining the outlet chamber 94 is illustrated as being pentagon-shaped, the wall 98 can be any suitable shape for the configuration of the chambers 38 (e.g., three-sided for pumps having three chambers, four-sided for pumps having four chambers 38, and the like), and is shaped so that the outlet port 24 is positioned tangentially with respect to the outlet chamber 94.

With continued reference to the illustrated embodiment of the pump 10, the inlet port 22 and the outlet port 24 are positioned parallel to a first side 100 of the pentagon-shaped wall 98. The pentagon-shaped wall 98 includes a second side 102, a third side 104, a fourth side 106, and a fifth side 108. As shown in FIG. 12A, the front housing 14 includes a raised portion 110 positioned adjacent an angle 112 between the third side 104 and the fourth side 106 of the pentagon-shaped wall 98. The raised portion 110 includes a threaded aperture 114 within which a pressure sensor 116 having a threaded exterior is positioned. Alternatively, the pressure sensor 116 can be positioned in an aperture that is not threaded and secured within the aperture with a fastener, such as a hexagonal nut. Thus, the pressure sensor 116 is in communication with the outlet chamber 94. In some embodiments, the pressure sensor 116 is a silicon semiconductor pressure sensor. In some embodiments, the pressure sensor 116 is a silicon semiconductor pressure sensor manufactured by Honeywell (e.g., model 22PCFEM1A). The pressure sensor 116 is comprised of four resistors or gauges in a bridge configuration in order to measure changes in resistance corresponding to changes in pressure within the outlet chamber 94.

Figure 13:
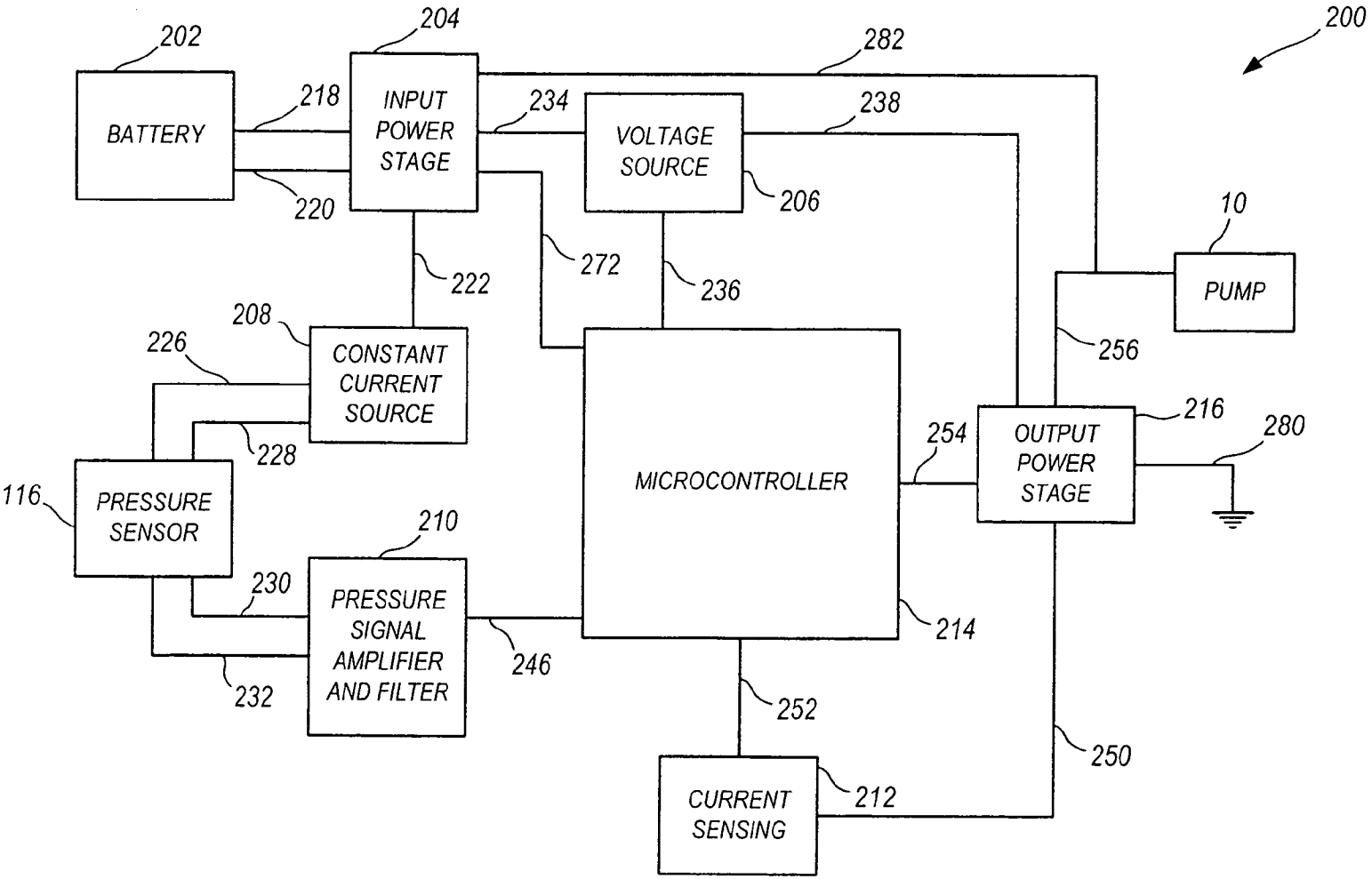
FIG. 13 is a schematic illustration of a pump control system according to an embodiment of the present invention.

FIG. 13 is a schematic illustration of an embodiment of a pump control system 200 according to the present invention. However, in some embodiments, the pump 10 as described above does not include a pump control system. As shown in FIG. 13, the pressure sensor 116 is included in the pump control system 200. The pump control system 200 can include a battery 202 or an AC power line (not shown) coupled to an analog-to-digital converter (not shown), an input power stage 204, a voltage source 206A or 206B, a constant current source 208, a pressure signal amplifier and filter 210, a current sensing circuit 212, a microcontroller 214, and an output power stage 216A or 216B coupled to the pump 10. The components of the pump control system 200 can be made with integrated circuits mounted on a circuit board (not shown) that is positioned within the motor assembly 20.

The battery 202 can be a standard 12-volt automotive battery or a 24-volt or 32-volt battery, such as those suitable for recreational vehicles or marine craft. However, the battery 202 can be any suitable battery or battery pack. A 12-volt automotive battery generally has a fully-charged voltage level of 13.6 volts. However, the voltage level of the battery 202 will vary during the life of the battery 202. In some embodiments, the pump control system 200 provides power to the pump as long as the voltage level of the battery 202 is between a low threshold and a high threshold. In the illustrated embodiment, the low threshold is approximately 8 volts to accommodate for voltage drops between a battery harness (e.g., represented by connections 218 and 220) and the pump 10. For example, a significant voltage drop may occur between a battery harness coupled to an automotive battery adjacent a recreational vehicle's engine and a pump 10 mounted in the rear of the recreational vehicle. Also in the illustrated embodiment, the high threshold is approximately 14 volts to accommodate for a fully-charged battery 202, but to prevent the pump control system 200 from being subjected to voltage spikes, such as when an automotive battery is being charged by another automotive battery.

Figure 14:
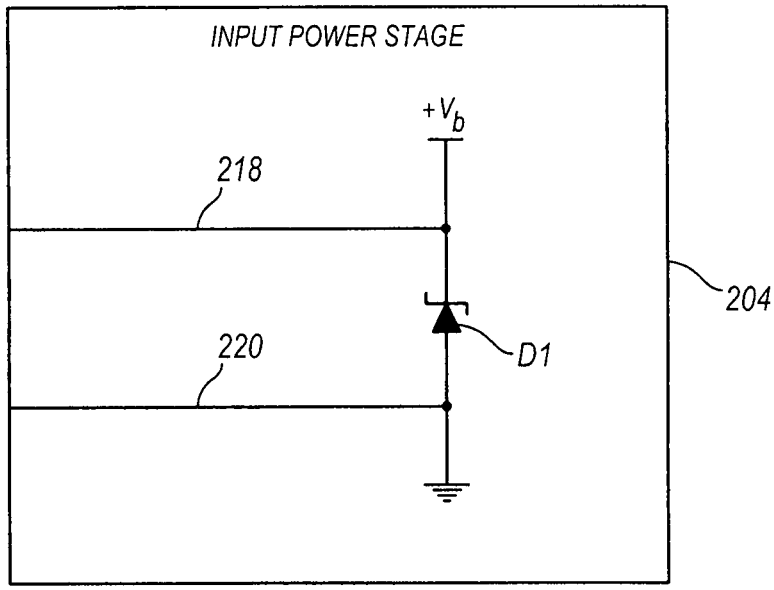
FIG. 14 is a schematic illustration of the input power stage illustrated in FIG. 13.

The battery 202 is connected to the input power stage 204 via the connections 218 and 220. As shown in FIG. 14, the connection 218 is coupled to a positive input of the input power stage 204 and to the positive terminal of the battery 202 in order to provide a voltage of +V.sub.b to the pump control system 200. The connection 220 is coupled to a negative input of the input power stage 204 and to the negative terminal of the battery 202, which behaves as an electrical ground. A zener diode D1 is coupled between the connections 218 and 220 in order to suppress any transient voltages, such as noise from an alternator that is also coupled to the battery 202. In some embodiments, the zener diode D1 is a generic model 1.5KE30CA zener diode available from several manufacturers. In some embodiments, a capacitor (e.g., a 330 uF capacitor with a maximum working voltage of 40V.sub.dc) is coupled between the connections 218 and 220 in parallel with the zener diode D1.

Figure 15:
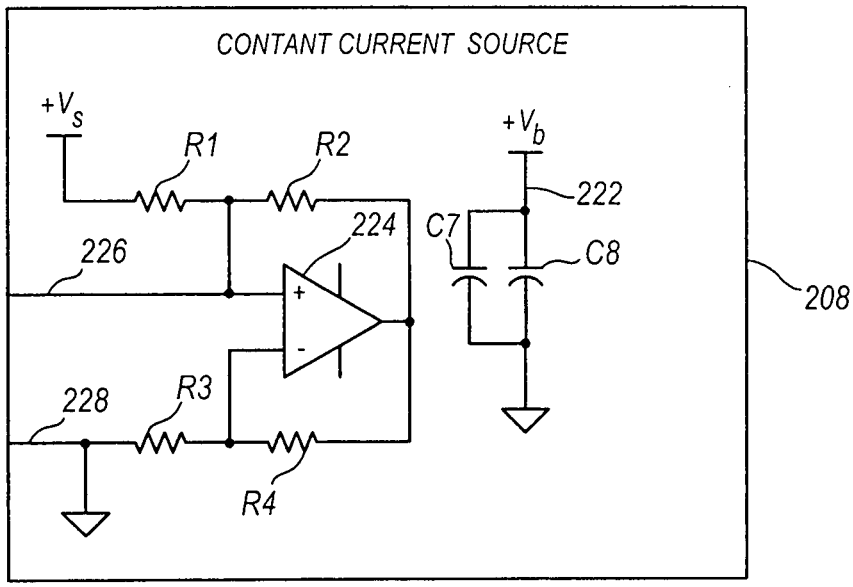
FIG. 15 is a schematic illustration of the constant current source illustrated in FIG. 13.

The input power stage 204 can be coupled to a constant current source 208 via a connection 222, and the constant current source 208 is coupled to the pressure sensor 116 via a connection 226 and a connection 228. As shown in FIG. 15, the constant current source 208 includes a pair of decoupling and filtering capacitors C7 and C8 (or, in some embodiments, a single capacitor), which prevent electromagnetic emissions from other components of the pump control circuit 200 from interfering with the constant current source 208. In some embodiments, the capacitance of C7 is 100 nF and the capacitance of C8 is 100 pF. In some embodiments, the capacitance of the single capacitor is 100 nF.

The constant current source 208 includes an operational amplifier 224 coupled to a resistor bridge, including resistors R1, R2, R3, and R4. The operational amplifier 224 can be one of four operational amplifiers within a model LM324/SO or a model LM2904/SO integrated circuit manufactured by National Semiconductor, among others. The resistor bridge can be designed to provide a constant current and so that the output of the pressure sensor 116 is a voltage differential value that is reasonable for use in the pump control system 200. The resistances of resistors R1, R2, R3, and R4 can be equal to one another, and can be 5 k.OMEGA. By way of example only, for a 5 k.OMEGA. resistor bridge, if the constant current source 208 provides a current of 1 mA to the pressure sensor 116, the voltages at the inputs 230 and 232 to the pressure signal amplifier and filter circuit 210 are between approximately 2 volts and 3 volts. In addition, the absolute value of the voltage differential between the inputs 230 and 232 can range from a non-zero voltage to approximately 100 mV, or between 20 mV and 80 mV. The absolute value of the voltage differential between the inputs 230 and 232 can be designed to be approximately 55 mV. The voltage differential between the inputs 230 and 232 can be a signal that represents the pressure changes in the outlet chamber 94.

Figure 17:
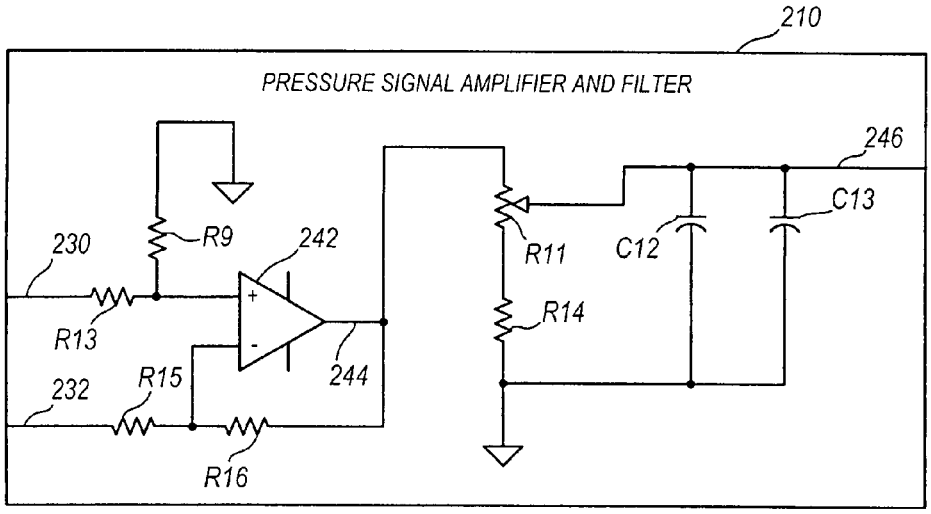
FIG. 17 is a schematic illustration of the pressure signal amplifier and filter illustrated in FIG. 13.

As shown in FIG. 17, the pressure signal amplifier and filter circuit 210 can include an operational amplifier 242 and a resistor network including R9, R13, R15, and R16. In some embodiments, the operational amplifier 242 is a second of the four operational amplifiers within the integrated circuit. The resistor network can be designed to provide a gain of 100 for the voltage differential signal from the pressure sensor 116 (e.g., the resistance values are 1 k.OMEGA. for R13 and R15 and 100 k.OMEGA. or 120 k.OMEGA. for R9 and R16). The output 244 of the operational amplifier 242 can be coupled to a potentiometer R11 and a resistor R14. The potentiometer R11 for each individual pump 10 can be adjusted during the manufacturing process in order to calibrate the pressure sensor 116 of each individual pump 10. The maximum resistance of the potentiometer R11 can be 5 k.OMEGA. or 50 k.OMEGA., the resistance of the resistor R14 can be 1 k.OMEGA., and the potentiometer R11 can be adjusted so that the shut-off pressure for each pump 10 is 65 PSI at 12 volts. The potentiometer R11 can be coupled to a pair of noise-filtering capacitors C12 and C13 (or, in some embodiments, a single capacitor of 10 uF at a maximum working voltage of 16V.sub.dc), having capacitance values of 100 nF and 100 pF, respectively. An output 246 of the pressure signal amplifier and filter circuit 210 can be coupled to the microcontroller 214, providing a signal representative of the pressure within the outlet chamber 94 of the pump 10.

Figure 16A:
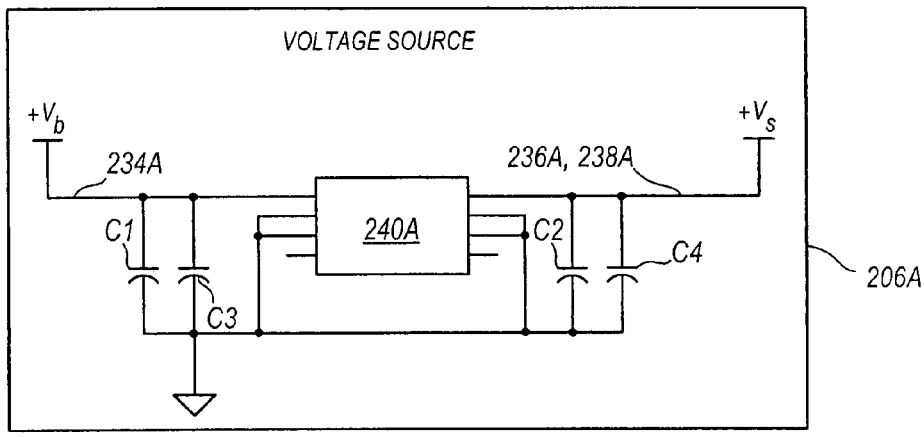
FIGS. 16A and 16B are schematic illustrations of a voltage source as illustrated in FIG. 13.

The input power stage 204 can also be connected to a voltage source 206A or 206B via a connection 234A or 234B. As shown in FIG. 16A, the voltage source 206A can convert the voltage from the battery (i.e., +V.sub.b) to a suitable voltage +V.sub.s (e.g., +5 volts) for use by the microcontroller 214 via a connection 236A and the output power stage 216 via a connection 238A. The voltage source 206A can include an integrated circuit 240A (e.g., model LM78L05 ACM manufactured by National Semiconductor, among others) for converting the battery voltage to +V.sub.s. The integrated circuit 240A can be coupled to capacitors C1, C2, C3, and C4. The capacitance of the capacitors can be designed to provide a constant, suitable voltage output for use with the microcontroller 214 and the output power stage 216. In some embodiments, the capacitance values are 680 uF for C1, 10 uF for C2, 100 nF for C3, and 100 nf for C4. In addition, the maximum working-voltage rating of the capacitors C1-C4 can be 35V.sub.dc.

Figure 16B:
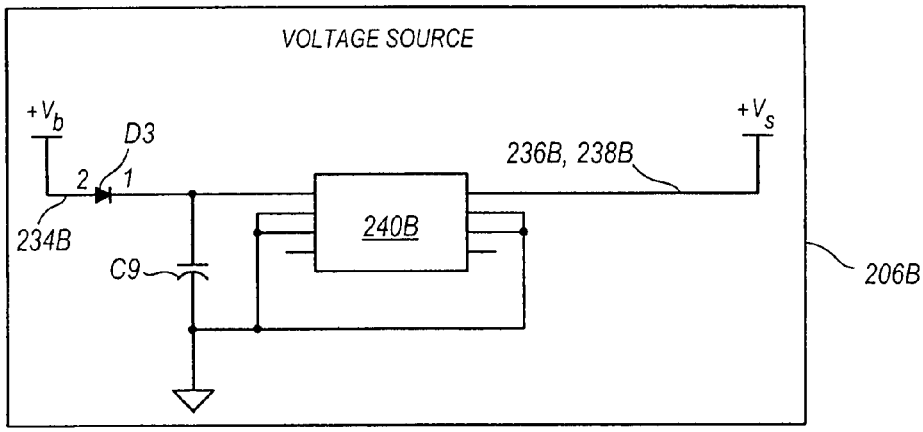

FIG. 16B illustrates the voltage source 206B which is an alternative embodiment of the voltage source 206A shown in FIG. 16A. As shown in FIG. 16B, the voltage source 206B converts the voltage from the battery (i.e., +V.sub.b) to a suitable voltage +V.sub.s (e.g., +5 volts) for use by the microcontroller 214 via a connection 236B and the output power stage 216 via a connection 238B. The voltage source 206B can include an integrated circuit 240B (e.g., Model No. LM7805 manufactured by National Semiconductor, among others) for converting and regulating the battery voltage to +V.sub.s. The integrated circuit 240B can be coupled to a diode D3 and a capacitor C9, which can be designed to provide a constant, suitable voltage output for use with the microcontroller 214 and the output power stage 216. In some embodiments, the diode D3 is a Model No. DL4001 diode. In some embodiments, the capacitance value of C9 is 47 uF with a maximum working-voltage rating of 50 V.sub.dc. The capacitor C9 can be capable of storing enough voltage so that the microcontroller 214 will operate even if the battery voltage is below the level necessary to start the pump 10. The diode D3 can prevent the capacitor C9 from discharging. In some embodiments, a capacitor (e.g., a 100 nF capacitor) is connected between connection 236B, 238B and ground.

A battery cable or harness (e.g., represented by connections 218 and 220 of FIG. 13) that is longer than a standard battery cable can be connected between the battery 202 and the remainder of the pump control circuit 200. For example, in some embodiments, a battery cable of 14# to 16# AWG (American wire gauge) can be up to 200 feet long. In some embodiments, a typical battery cable is between about 50 feet and about 75 feet long.

Figure 18:
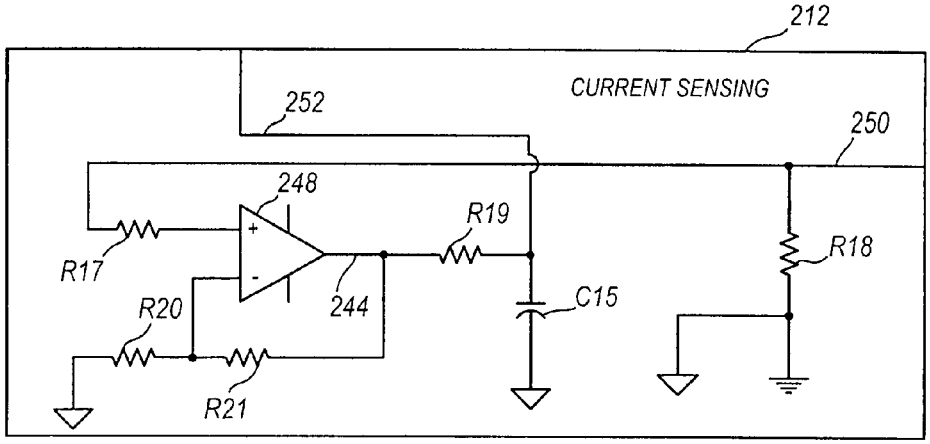
FIG. 18 is a schematic illustration of the current sensing circuit illustrated in FIG. 13.

As shown in FIG. 18, the current sensing circuit 212 can be coupled to the output power stage 216 via a connection 250 and to the microcontroller 214 via a connection 252. The current sensing circuit 212 can provide the microcontroller 214 a signal representative of the level of current being provided to the pump 10. The current sensing circuit 212 can include a resistor R18, which has a low resistance value (e.g., 0.01.OMEGA. or 0.005.OMEGA.) in order to reduce the value of the current signal being provided to the microcontroller 214. The resistor R18 can be coupled to an operational amplifier 248 and a resistor network, including resistors R17, R19, R20, and R21 (e.g., having resistance values of 1 k.OMEGA. for R17, R19, and R20 and 20 k.OMEGA. for R21). The output of the amplifier 248 can be also coupled to a filtering capacitor C15, having a capacitance of 10 uF and a maximum working-voltage rating of 16V.sub.dc or 35V.sub.dc. In some embodiments, the operational amplifier 248 is the third of the four operational amplifiers within the integrated circuit. The signal representing the current can be divided by approximately 100 by the resistor R18 and then amplified by approximately 20 by the operational amplifier 248, as biased by the resistors R17, R19, R20, and R21, so that the signal representing the current provided to the microcontroller 214 has a voltage amplitude of approximately 2 volts.

Figure 19A:
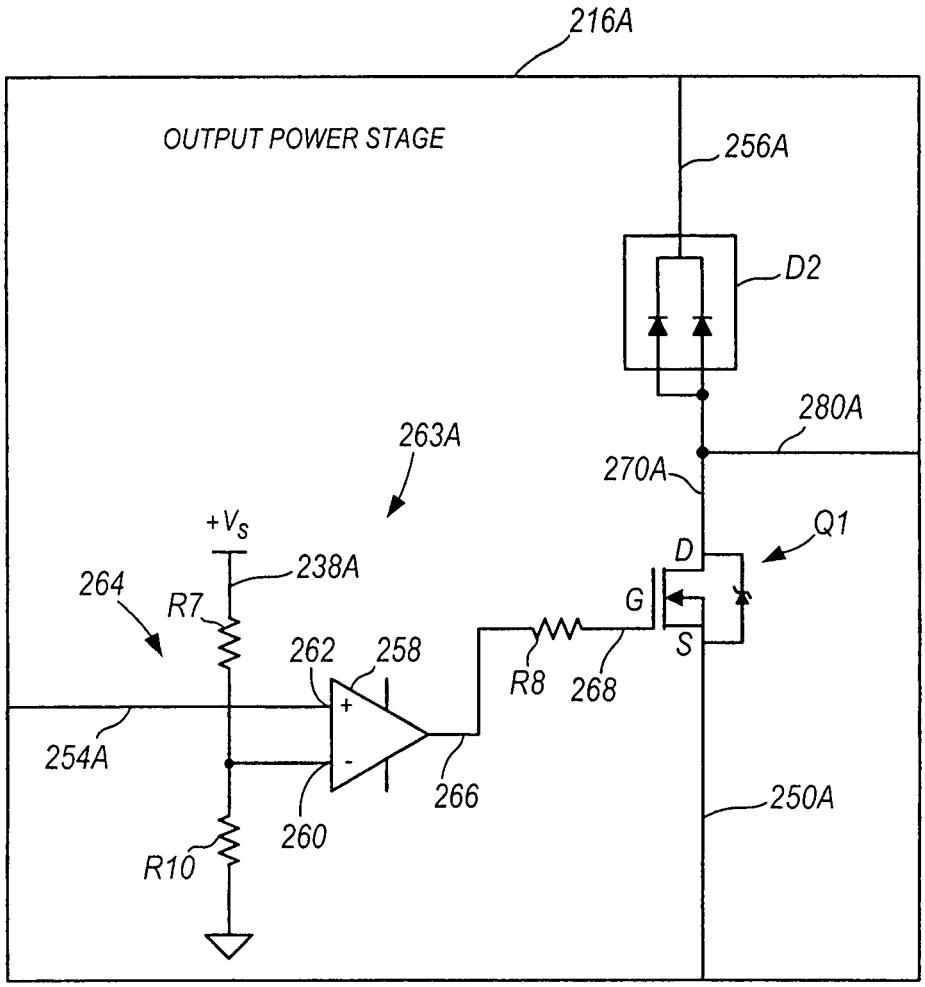
FIGS. 19A and 19B are schematic illustrations of an output power stage illustrated in FIG. 13.

As shown in FIG. 19A, an output power stage 216A can be coupled to the voltage source 206A or 206B via the connection 238A, to the current sensing circuit 212 via the connection 250A, to the microcontroller 214 via a connection 254A, and to the pump via a connection 256A. The output power stage 216A can receive a control signal from the microcontroller 214. As will be described in greater detail below, the control signal can cycle between 0 volts and 5 volts.

The output power stage 216 can include a comparator circuit 263A. The comparator circuit 263A can include an operational amplifier 258 coupled to the microcontroller 214 via the connection 254 in order to receive the control signal. A first input 260 to the operational amplifier 258 can be coupled directly to the microcontroller 214 via the connection 254. A second input 262 to the operational amplifier 258 can be coupled to the voltage source 206A or 206B via a voltage divider circuit 264, including resistors R7 and R10. In some embodiments, the voltage divider circuit 264 is designed so that the +5 volts from the voltage source 206A or 206B is divided by half to provide approximately +2.5 volts at the second input 262 of the operational amplifier 258 (e.g., the resistances of R7 and R10 are 5 k.OMEGA.). The comparator circuit 263A can be used to compare the control signal, which can be either 0 volts or 5 volts, at the first input 260 of the operational amplifier 258 to the +2.5 volts at the second input 262 of the operational amplifier 258. If the control signal is 0 volts, an output 266 of the operational amplifier 258 can be positive. If the control signal is 5 volts, the output 266 of the operational amplifier 258 can be close to zero. In some embodiments, such as when the battery 502 is a 12-volt battery, the output power stage 216 can include a metal-oxide semiconductor field-effect transistor (MOSFET) (not shown), rather than the comparator circuit 263, in order to increase a 5 volt signal from the microprocessor 578 to a 12 volt signal.

The output 266 of the operational amplifier 258 can be coupled to a resistor R8, the signal output by resistor R8 acts as a driver for a gate 268 of a transistor Q1. In some embodiments, the transistor Q1 can be a single-gate, n-channel MOSFET capable of operating at a frequency of 1 kHz (e.g., model IRLI3705N manufactured by International Rectifier or NDP7050L manufactured by Fairchild Semiconductors). The transistor Q1 can act like a switch in order to selectively provide power to the motor assembly 20 of the pump 10 when an appropriate signal is provided to the gate 268. For example, if the voltage provided to the gate 268 of the transistor Q1 is positive, the transistor Q1 is "on" and provides power to the pump 10 via a connection 270A. Conversely, if the voltage provided to the gate 268 of the transistor Q1 is negative, the transistor Q1 is "off" and does not provide power to the pump 10 via the connection 270A.

The drain of the transistor Q1 can be connected to a free-wheeling diode circuit D2 via the connection 270A. The diode circuit D2 can release the inductive energy created by the motor of the pump 10 in order to prevent the inductive energy from damaging the transistor Q1. In some embodiments, the diodes in the diode circuit D2 are model number MBRB3045 manufactured by International Rectifier or model number SBG3040 manufactured by Diodes, Inc. The diode circuit D2 can be connected to the pump 10 via the connection 256.

The drain of the transistor Q1 can be connected to a ground via a connection 280A. The input power stage 204 can be coupled between the diode circuit D2 and the pump 10 via a connection 282. By way of example only, if the control signal is 5 volts, the transistor Q1 is "on" and approximately +V.sub.b is provided to the pump 10 from the input power stage 204. However, if the control signal is 0 volts, the transistor Q1 is "off" and +V.sub.b is not provided to the pump 10 from the input power stage 204.

Figure 19B:
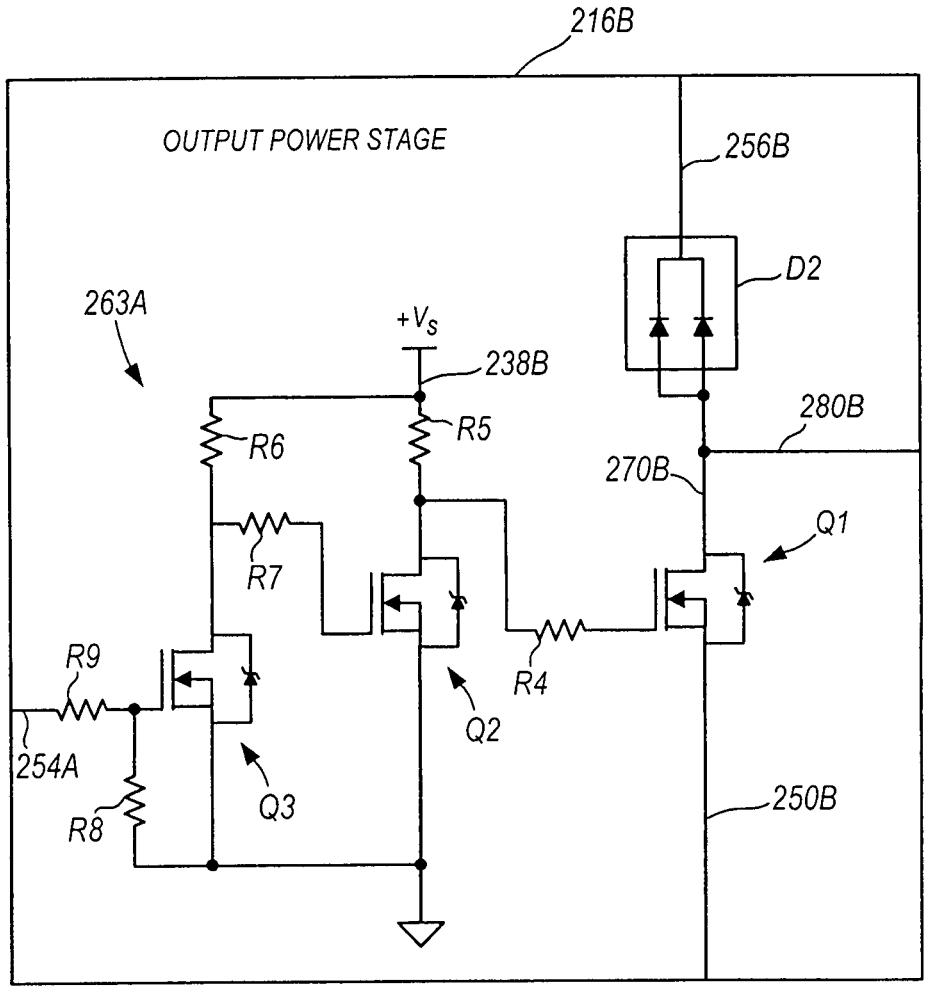

FIG. 19B illustrates an alternative embodiment of an output power stage 216B. As shown in FIG. 19B, the output power stage 216B can be coupled to the voltage source 206A or 206B via the connection 238B, to the current sensing circuit 212 via the connection 250B, to the microcontroller 214 via a connection 254B, and to the pump via a connection 256B. The output power stage 216B can receive a control signal from the microcontroller 214. The output power stage 216 can include a comparator circuit 263A. The comparator circuit 263B can include two transistors Q2 and Q3 (rather than an operational amplifier 258) coupled to the microcontroller 214 via the connection 254B in order to receive the control signal. The comparator circuit 263B can also include a resistor network including R4 (e.g., 22.OMEGA.), R5 (e.g., 5 k .OMEGA.), R6 (e.g., 5 k .OMEGA.), R7 (e.g., 1 k .OMEGA.), R8 (e.g., 100 k .OMEGA.) and R9 (e.g., 22 .OMEGA.).

Figure 20:
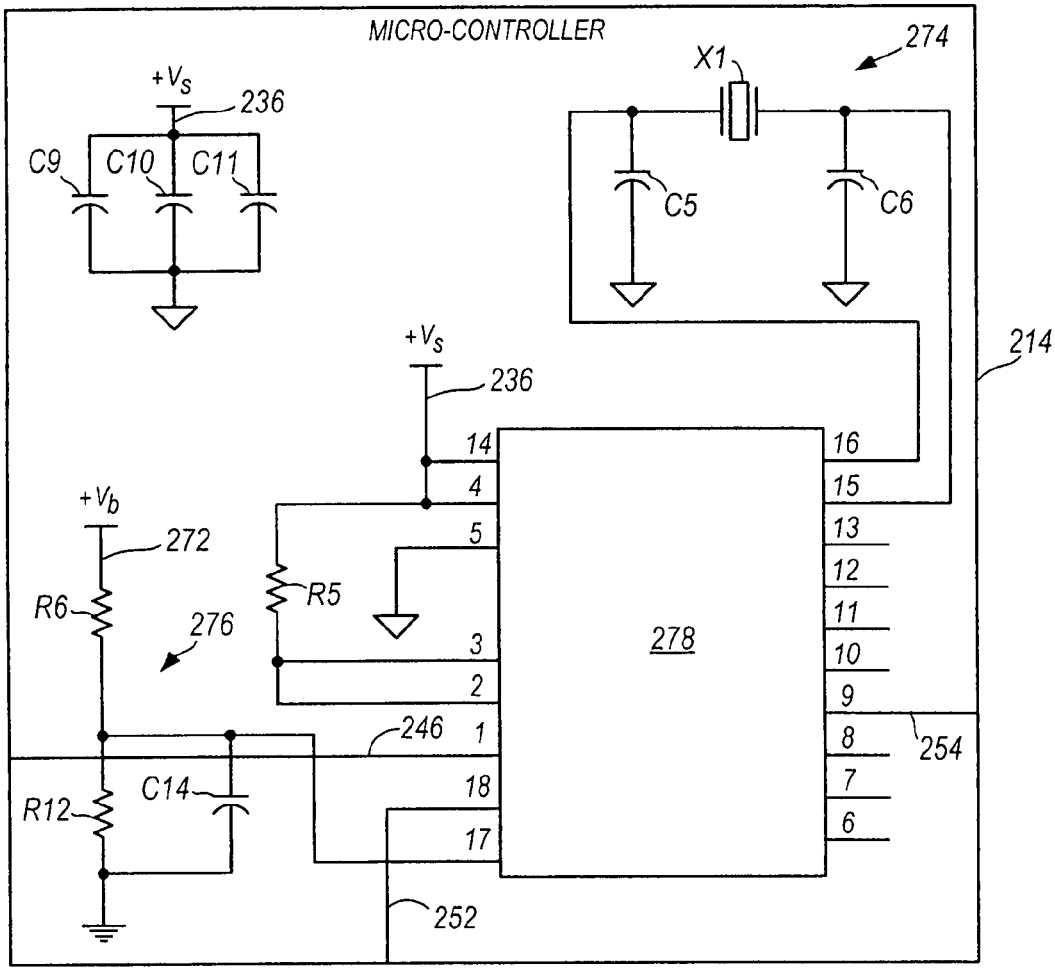
FIG. 20 is a schematic illustration of the microcontroller illustrated in FIG. 13.

As shown in FIG. 20, the microcontroller 214 can include a microprocessor integrated circuit 278, which can be programmed to perform various functions, as will be described in detail below. As used herein and in the appended claims, the term "microcontroller" is not limited to just those integrated circuits referred to in the art as microcontrollers, but broadly refers to one or more microcomputers, processors, application-specific integrated circuits, or any other suitable programmable circuit or combination of circuits. In some embodiments, the microprocessor 278 is a model number PIC16C711 manufactured by Microchip Technology, Inc. In other embodiments, the microprocessor 578 is a model number PIC16C715 manufactured by Microchip Technology, Inc. The microcontroller 214 can include decoupling and filtering capacitors C9, C10, and C11 (e.g., in some embodiments having capacitance values of 100 nF, 10 nF, and 100 pF, respectively, and in other embodiments a single capacitor having a capacitance value of 1 uF), which connect the voltage source 206A or 206B to the microprocessor 278 (at pin 14). The microcontroller 214 can include a clocking signal generator 274 comprised of a crystal or oscillator X1 and loading capacitors C5 and C6. In some embodiments, the crystal X1 can operate at 20 MHz and the loading capacitors C5 and C6 can each have a capacitance value of 22 pF. The clocking signal generator 274 can provide a clock signal input to the microprocessor 278 and can be coupled to pin 15 and to pin 16.

The microprocessor 278 can be coupled to the input power stage 204 via the connection 272 in order to sense the voltage level of the battery 202. A voltage divider circuit 276, including resistors R6 and R12 and a capacitor C14, can be connected between the input power stage 204 and the microprocessor 278 (at pin 17). The capacitor C14 filters out noise from the voltage level signal from the battery 202. In some embodiments, the resistances of the resistors R6 and R12 are 5 k.OMEGA. and 1 k.OMEGA., respectfully, the capacitance of the capacitor C14 is 100 nF, and the voltage divider circuit 276 reduces the voltage from the battery 202 by one-sixth.

The microprocessor 278 (at pin 1) can be connected to the pressure signal amplifier and filter 210 via the connection 246. The microprocessor 278 (at pin 18) can be connected to the current sensing circuit 212 via the connection 252. The pins 1, 17, and 18 can be coupled to internal analog-to-digital converters. Accordingly, the voltage signals representing the pressure in the outlet chamber 94 (at pin 1), the voltage level of the battery 202 (at pin 17), and the current being supplied to the motor assembly 20 via the transistor Q1 (at pin 18) can each be converted into digital signals for use by the microprocessor 278. Based on the voltage signals at pins 1, 17, and 18, the microprocessor 278 can provide a control signal (at pin 9) to the output power stage 216 via the connection 254.

Figure 21A:
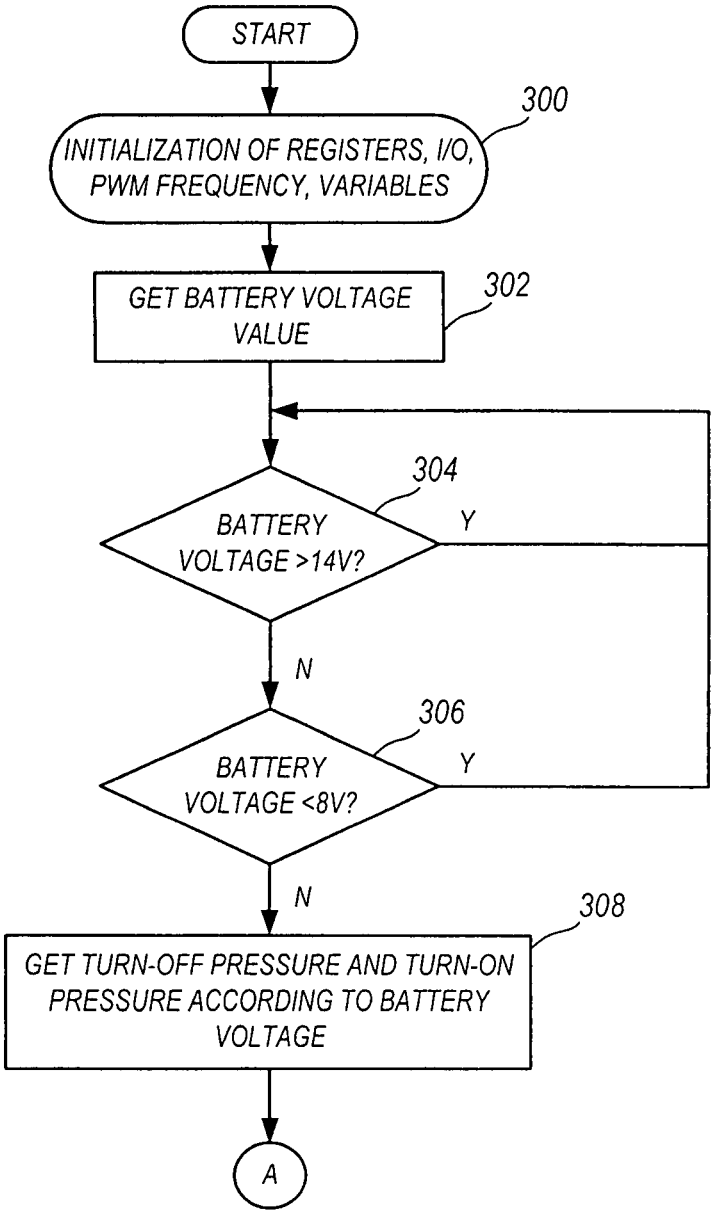
FIGS. 21A-21F are flow charts illustrating the operation of the pump control system of FIG. 13.

Referring to FIGS. 21A-21F, the microprocessor 278 can be programmed to operate the pump control system 200 as follows. Referring first to FIG. 21A, the microprocessor 278 can be initialized (at 300) by setting various registers, inputs/outputs, and variables. Also, an initial pulse-width modulation frequency is set in one embodiment at 1 kHz. The microprocessor 278 reads (at 302) the voltage signal representing the voltage level of the battery 202 (at pin 17). In some embodiments, the microcontroller 214 can estimate the length of the battery cable and can calculate the voltage available to the microcontroller 214 when the pump 10 is running. The microcontroller 214 estimates the length of the battery cable by measuring the battery voltage when the pump 10 is OFF (pump-OFF voltage) and when the pump 10 is ON (pump-ON voltage). The difference between the pump-ON voltage and the pump-OFF voltage is the voltage drop that occurs when the pump 10 is turned on. This voltage drop is proportional to the length of the battery cable.

The microprocessor 278 determines (at 304 and 306) whether the voltage level of the battery 202 is greater than a low threshold (e.g., 8 volts) but less than a high threshold (e.g., 14 volts). In some embodiments, when the battery cable is up to 200 feet long, the low threshold is 7 volts and the high threshold is 13.6 volts. If the voltage level of the battery 202 is not greater than the low threshold and less than the high threshold, the microprocessor 278 attempts to read the voltage level of the battery 202 again. In some embodiments, the microprocessor 287 does not allow the pump control system 200 to operate until the voltage level of the battery 202 is greater than the low threshold but less than the high threshold.

Once the sensed voltage level of the battery 202 is greater than the low threshold but less than the high threshold, the microprocessor 278 obtains (at 308) a turn-off or shut-off pressure value and a turn-on pressure value, each of which correspond to the sensed voltage level of the battery 202, from a look-up table stored in memory (not shown) accessible by the microprocessor 278. The microprocessor 278 can, in some embodiments, adjust the shut-off pressure according to the length of the battery cable in order to allow the pump 10 to shut-off more easily. The shut-off pressure value represents the pressure at which the pump 10 will stall if the pump 10 is not turned off or if the pump speed is not reduced. In some embodiments, the shut-off pressure ranges from about 38 PSI to about 65 PSI for battery cables up to 200 feet long. The pump 10 will stall when the pressure within the pump 10 becomes too great for the rotor of the motor within the motor assembly 20 to turn given the power available from the battery 202. Rather than just allowing the pump 10 to stall, the pump 10 can be turned off or the speed of the pump 10 can be reduced so that the current being provided to the pump 10 does not reach a level at which the heat generated will damage the components of the pump 10. The turn-on pressure value represents the pressure at which the fluid in the pump 10 must reach before the pump 10 is turned on.

Figure 21B:
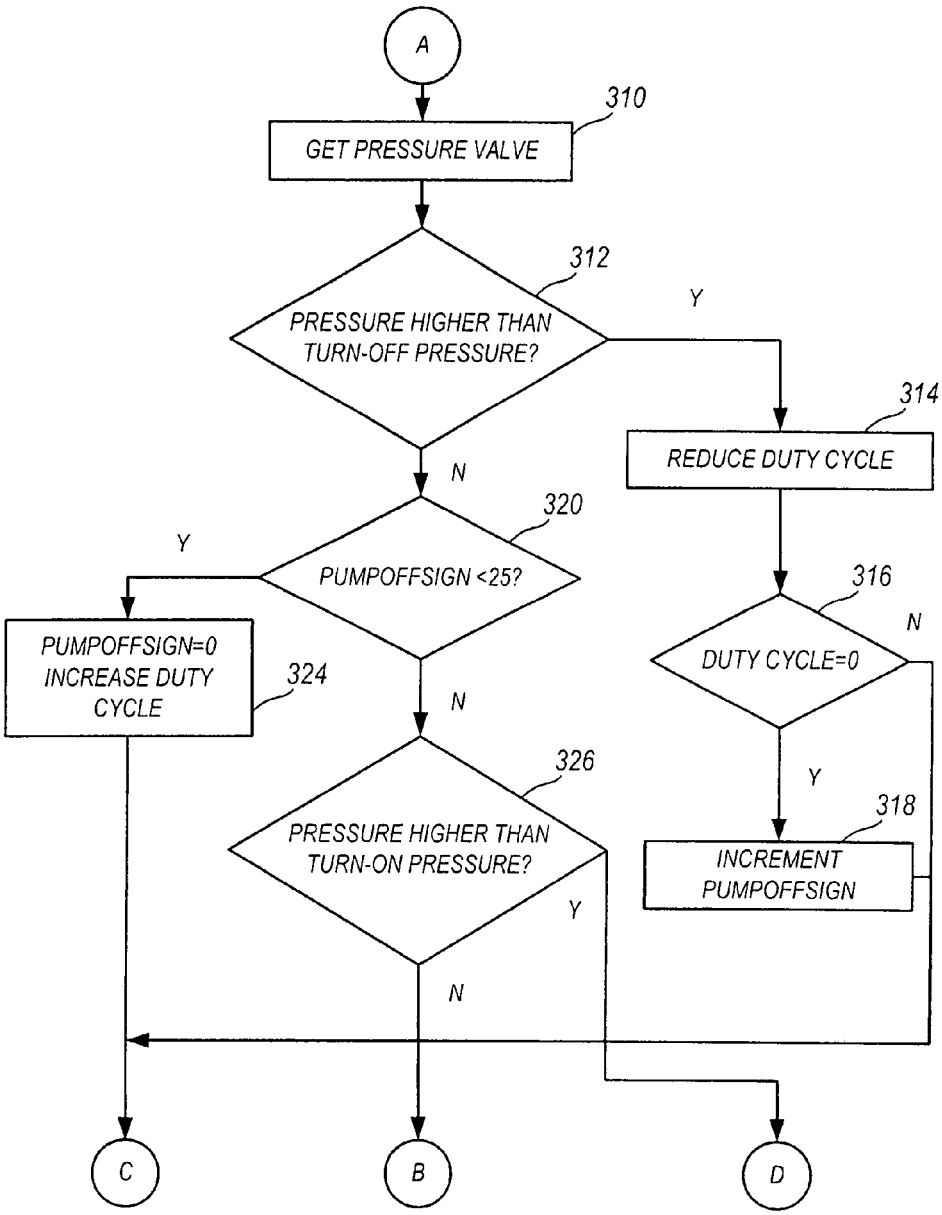

Referring to FIG. 21B, the microprocessor 278 reads (at 310) the voltage signal (at pin 1) representing the pressure within the outlet chamber 94 as sensed by the pressure sensor 116. The microprocessor 278 determines (at 312) whether the sensed pressure is greater than the shut-off pressure value. If the sensed pressure is greater than the shut-off pressure value, the microprocessor 278 reduces the speed of the pump 10. The microprocessor 278 reduces the speed of the pump 10 by reducing (at 314) the duty cycle of a pulse-width modulation (PWM) control signal being transmitted to the output power stage 216 via the connection 254. The duty cycle of a PWM control signal is generally defined as the percentage of the time that the control signal is high (e.g., +5 volts) during the period of the PWM control signal.

The microprocessor 278 also determines (at 316) whether the duty cycle of the PWM control signal has already been reduced to zero, so that the pump 10 is already being turned off. If the duty cycle is already zero, the microprocessor 278 increments (at 318) a "Pump Off Sign" register in the memory accessible to the microprocessor 278 in order to track the time period for which the duty cycle has been reduced to zero. If the duty cycle is not already zero, the microprocessor 278 proceeds to a current limiting sequence, as will be described below with respect to FIG. 21D.

If the microprocessor 278 determines (at 312) that the sensed pressure is not greater than the shut-off pressure value, the microprocessor then determines (at 320) whether the "Pump Off Sign" register has been incremented more than, for example, 25 times. In other words, the microprocessor 278 determines (at 320) whether the pump has already been completely shut-off. If the microprocessor 278 determines (at 320) that the "Pump Off Sign" has not been incremented more than 25 times, the microprocessor 278 clears (at 324) the "Pump Off Sign" register and increases (at 324) the duty cycle of the PWM control signal. If the "Pump Off Sign" has not been incremented more than 25 times, the pump 10 has not been completely turned-off, fluid flow through the pump has not completely stopped, and the pressure of the fluid within the pump 10 is relatively low. The microprocessor 278 continues to the current limiting sequence described below with respect to FIG. 21D.

However, if the microprocessor 278 determines (at 320) that the "Pump Off Sign" has been incremented more than 25 times, the pump 10 has been completely turned-off, fluid flow through the pump has stopped, and the pressure of the fluid in the pump 10 is relatively high. The microprocessor 278 then determines (at 322) whether the sensed pressure is greater then the turn-on pressure value. If the sensed pressure is greater than the turn-on pressure value, the microprocessor 278 proceeds directly to a PWM sequence, which will be described below with respect to FIG. 21E. If the sensed pressure is less than the turn-on pressure value, the microprocessor 278 proceeds to a pump starting sequence, as will be described with respect to FIG. 21C.

Figure 21C:
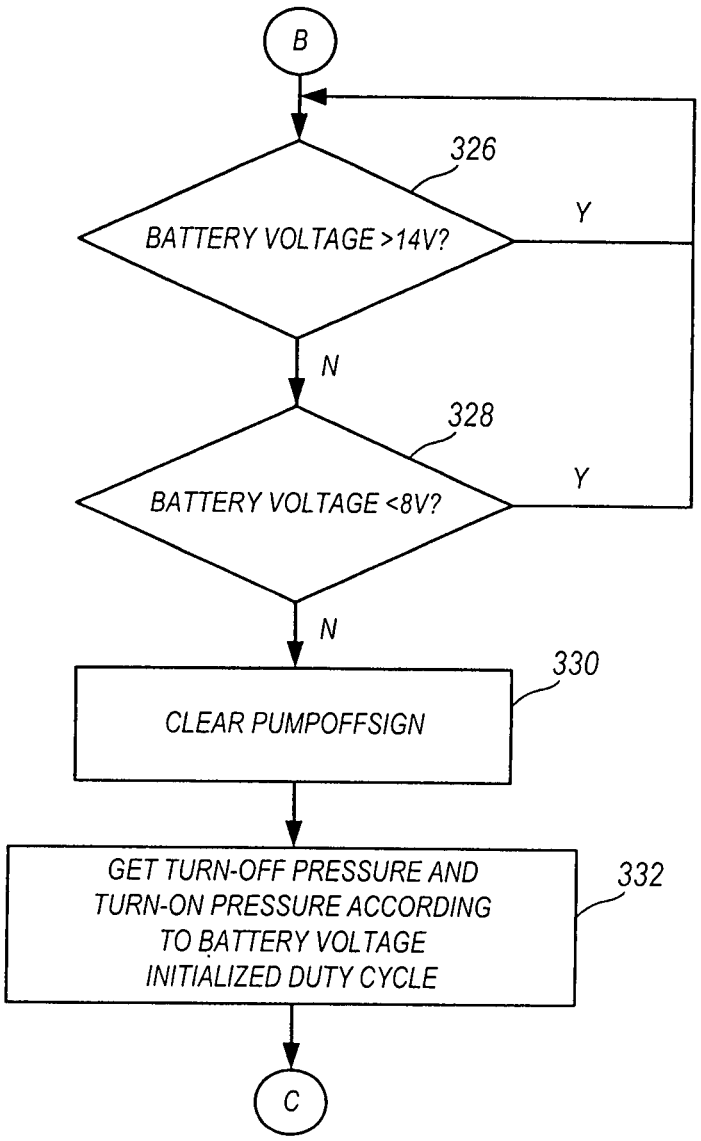

Referring to FIG. 21C, before starting the pump 10, the microprocessor 278 verifies (at 326 and 328) that the voltage of the battery 202 is still between the low threshold and the high threshold. If the voltage of the battery 202 is between the low threshold and the high threshold, the microprocessor 278 clears (at 330) the "Pump Off Sign" register. The microprocessor 278 then obtains (at 332) the shut-off pressure value and the turn-on pressure value from a look-up table for the current voltage level reading for the battery 202.

Figure 21D:
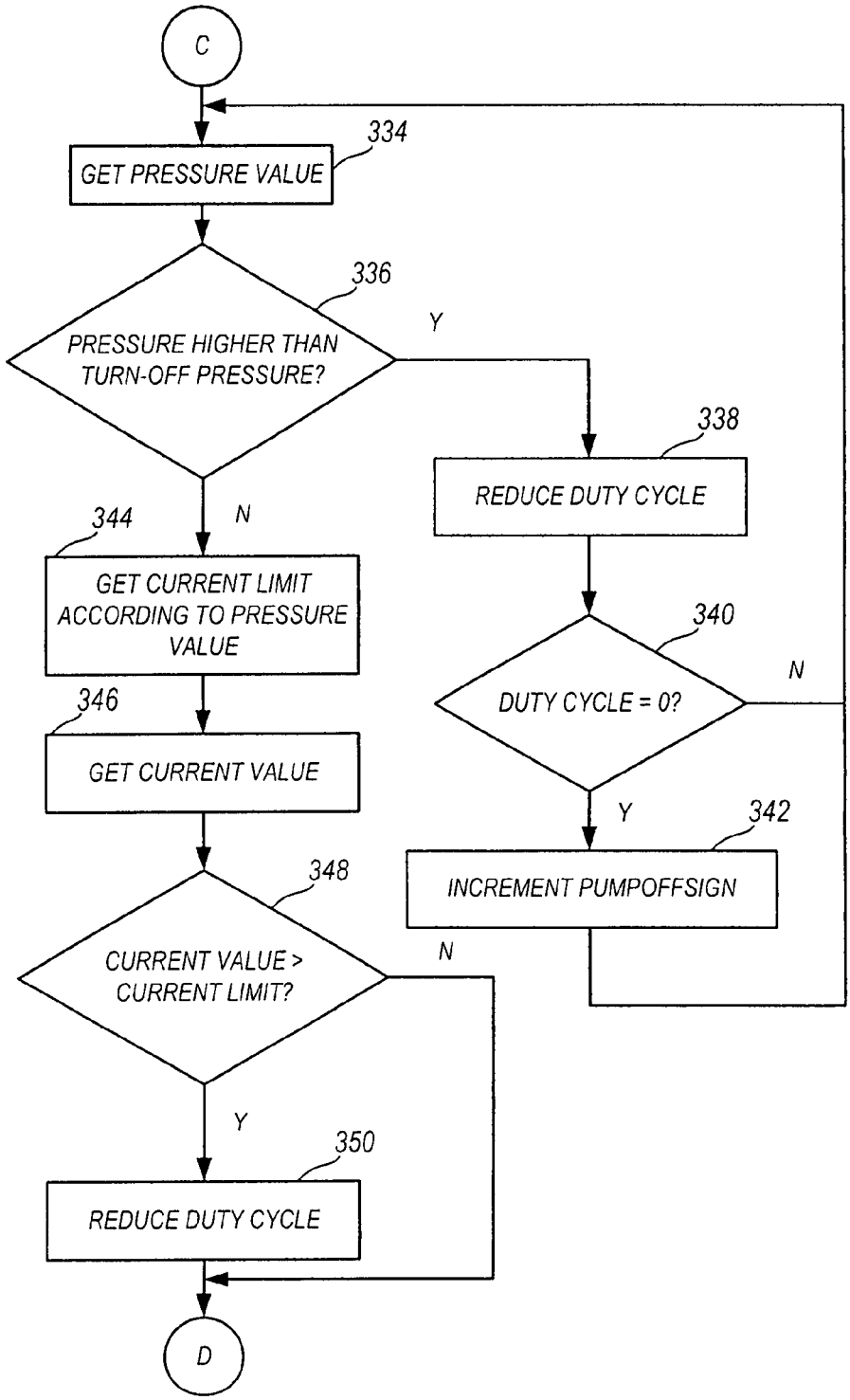

The microprocessor 278 then proceeds to the current limiting sequence as shown in FIG. 21D. The microprocessor 278 again reads (at 334) the voltage signal (at pin 1) representing the pressure within the outlet chamber 94 as sensed by the pressure sensor 116. The microprocessor 278 again determines (at 336) whether the sensed pressure is greater than the shut-off pressure value.

If the sensed pressure is greater than the shut-off pressure, the microprocessor 278 can reduce the speed of the pump 10 by reducing (at 338) the duty cycle of the PWM control signal being transmitted to the output power stage 216 via the connection 254. The microprocessor 278 also determines (at 340) whether the duty cycle of the PWM control signal has already been reduced to zero, so that the pump 10 is already being turned off. If the duty cycle is already zero, the microprocessor 278 increments (at 342) the "Pump Off Sign" register. If the duty cycle is not already zero, the microprocessor 278 returns to the beginning of the current limiting sequence (at 334).

In some embodiments, if the sensed pressure is less than but approaching the shut-off pressure, the microcontroller 214 can provide a "kick" current to shut off the pump 10. The microcontroller 214 can generate a control signal when the sensed pressure is approaching the shut-off pressure (e.g., within about 2 PSI of the shut-off pressure) and the output power stage 216 can provide an increased current to the pump 10 as the sensed pressure approaches the shut-off pressure. The microcontroller 214 can determine the current that is necessary to turn off the pump 10 by accessing a look-up table that correlates the sensed pressures to the current available from the battery 202. In some embodiments, the "kick" or increased current is a current that increases from about 10 amps to about 15 amps within about 2 seconds. The time period for the increased current can be relatively short (i.e., only a few seconds) so that less current is drawn from the battery 202 to shut off the pump 10. In one embodiment, the increased current is provided when the sensed pressure is about 55 PSI to about 58 PSI and the shut-off pressure is about 60 PSI.

If the sensed pressure is less than the shut-off pressure value, the pump 10 is generally operating at an acceptable pressure, but the microprocessor 278 must determine whether the current being provided to the pump 10 is acceptable. Accordingly, the microprocessor 278 obtains (at 344) a current limit value from a look-up table stored in memory accessible by the microprocessor 278. The current limit value corresponds to the maximum current that will be delivered to the pump 10 for each particular sensed pressure. The microprocessor 278 also reads (at 346) the voltage signal (at pin 18) representing the current being provided to the pump 10 (i.e., the signal from the current sensing circuit 212 transmitted by connection 252). The microprocessor 278 determines (at 348) whether the sensed current is greater than the current limit value. If the sensed current is greater than the current limit, the microprocessor 278 can reduce the speed of the pump 10 so that the pump 10 does not stall by reducing (at 350) the duty cycle of the PWM control signal until the sensed current is less than the current limit value. The microprocessor 278 then proceeds to the PWM sequence, as shown in FIG. 21E.

Figure 21E:
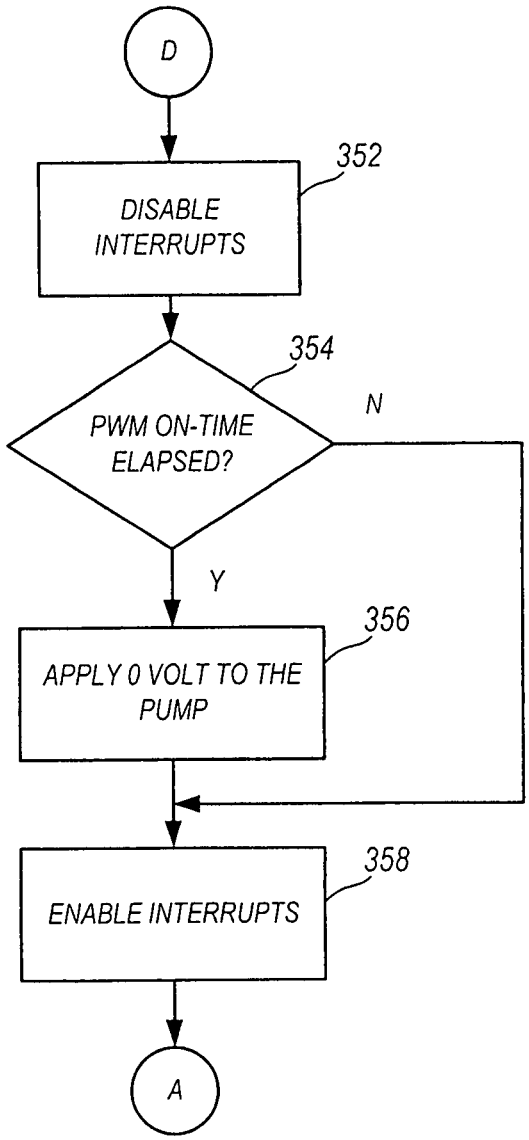

Referring to FIG. 21E, the microprocessor 278 first disables (at 352) an interrupt service routine (ISR), the operation of which will be described with respect to FIG. 21F, in order to start the PWM sequence. The microprocessor 278 then determines (at 354) whether the on-time for the PWM control signal (e.g., the +5 volts portion of the PWM control signal at pin 9) has elapsed. If the on-time has not elapsed, the microprocessor 278 continues providing a high control signal to the output power stage 216. If the on-time has elapsed, the microprocessor 278 applies (at 356) zero volts to the pump 10 (e.g., by turning off the transistor Q1, so that power is not provided to the pump 10). The microprocessor 278 then enables (at 358) the interrupt service routine that was disabled (at 352). Once the interrupt service routine is enabled, the microprocessor 278 returns to the beginning of the start pump sequence, as was shown and described with respect to FIG. 21B.

Figure 21F:
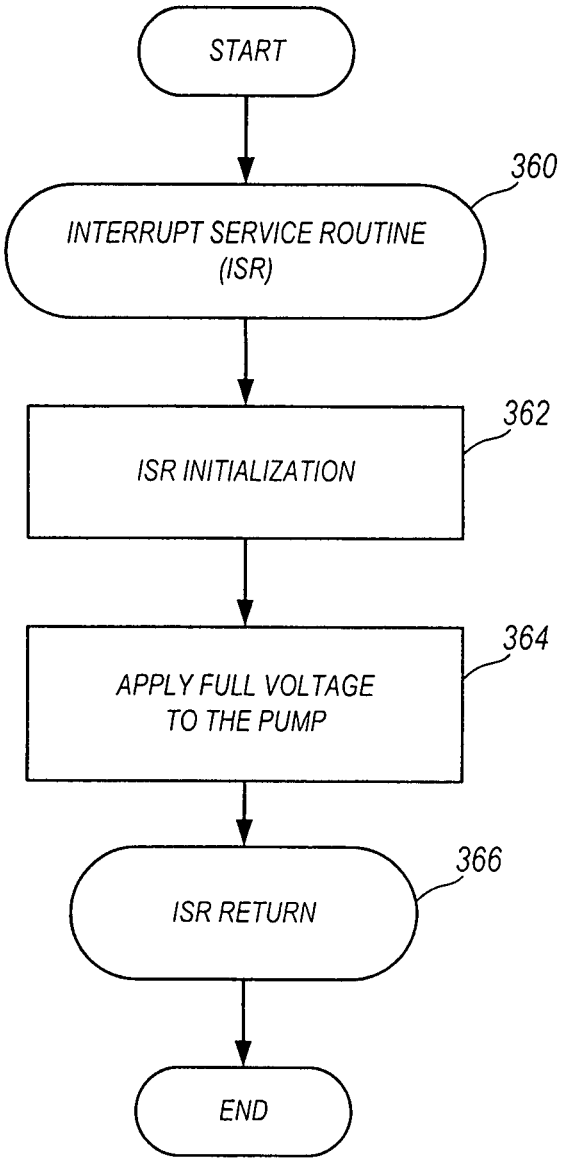

Referring to FIG. 21F, the microprocessor 278 runs (at 360) an interrupt service routine concurrently with the sequences of the pump shown and described with respect to FIGS. 21A-21E. The microprocessor 278 initializes (at 362) the interrupt service routine. The microprocessor 278 then applies (at 364) a full voltage to the pump 10 (e.g., by turning on the transistor Q1). Finally, the microprocessor returns (at 366) from the interrupt service routine to the sequences of the pump shown and described with respect to FIGS. 21A-21E. The interrupt service routine can be cycled every 1 msec in order to apply a full voltage to the pump 10 at a frequency of 1 kHz.

In some embodiments, the microprocessor 278 operates according to two running modes in order to eliminate pump cycling—a high-flow mode and a low-flow mode. In the high-flow mode, a faucet is generally wide open (i.e., a shower is on). Also, the pump is generally operating in the high-flow mode when a faucet is turned on and off one or more times, but the pressure in the system remains above a low threshold (e.g., 28 PSI.+−0.2 PSI in one embodiment). In the low-flow mode, a faucet is generally slightly or tightly open (i.e., a faucet is only open enough to provide a trickle of water). Also, the pump is generally in a low-flow mode when a faucet is turned on and the pressure drops to below a low threshold (e.g., 28 PSI.+−0.2 PSI in one embodiment).

In some embodiments, in the high-flow mode, the microprocessor 278 limits the current provided to the pump 10 to a high-flow current limit value (e.g., approximately 10 amps). This high-flow current limit value generally does not depend on the actual flow rate through the pump 10 or the actual pressure sensed by the pressure sensor 116. In the low-flow mode, the microprocessor 278 can lower the low-flow current limit value to less than the high-flow current limit value. In addition, the low-flow current limit value can be dependent on the actual pressure sensed by the pressure sensor 116. In some embodiments, the low-flow mode can prevent the pump 10 from cycling under low-flow conditions. In some embodiments, the microprocessor 278 switches from the high-flow mode to the low-flow mode when the flow rate decreases from a high-flow rate to a low-flow rate (e.g., when the pressure drops below a low threshold). Conversely, the microprocessor 278 switches from the low-flow mode to the high-flow mode when the flow rate increases from a low-flow rate to a high-flow rate.

Figure 22A:
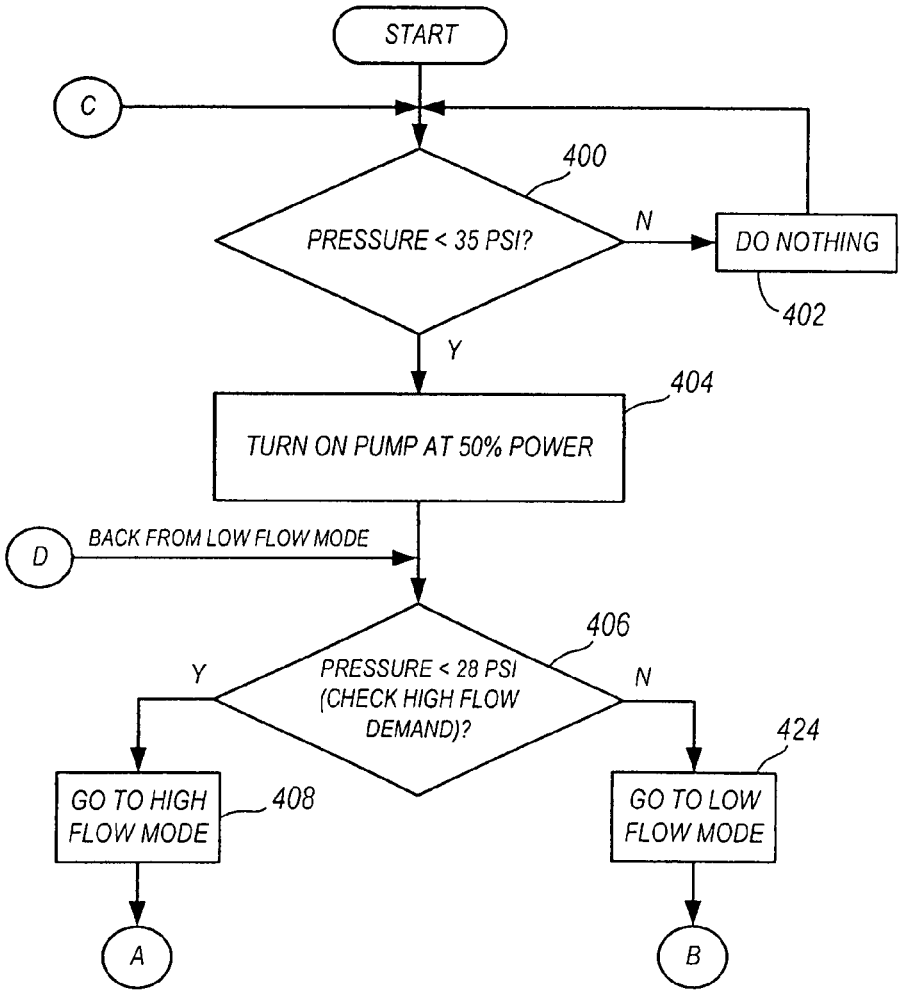
FIGS. 22A-22C are flow charts also illustrating the operation of the pump control system of FIG. 13.
Figure 22B:
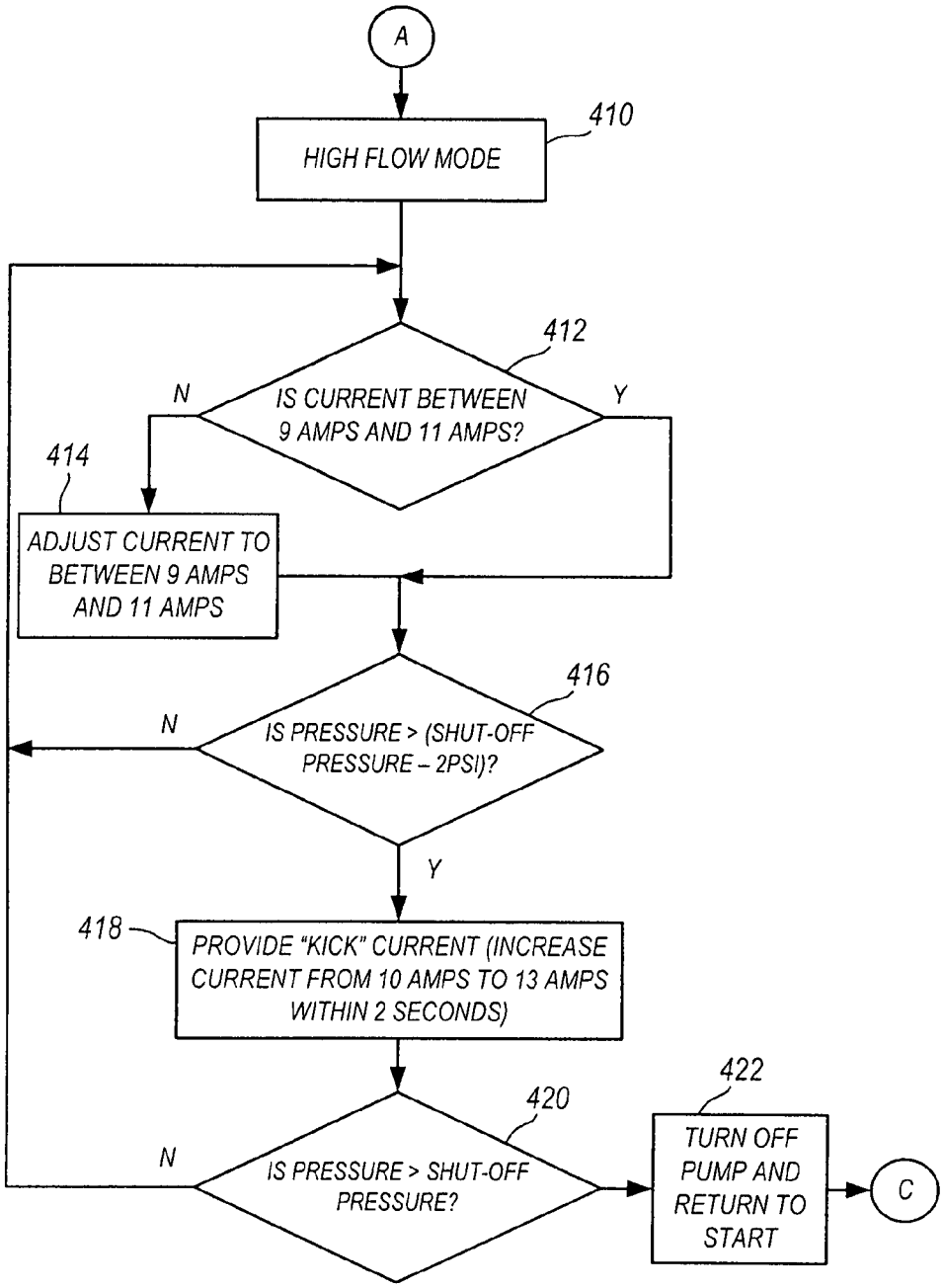
Figure 22C:
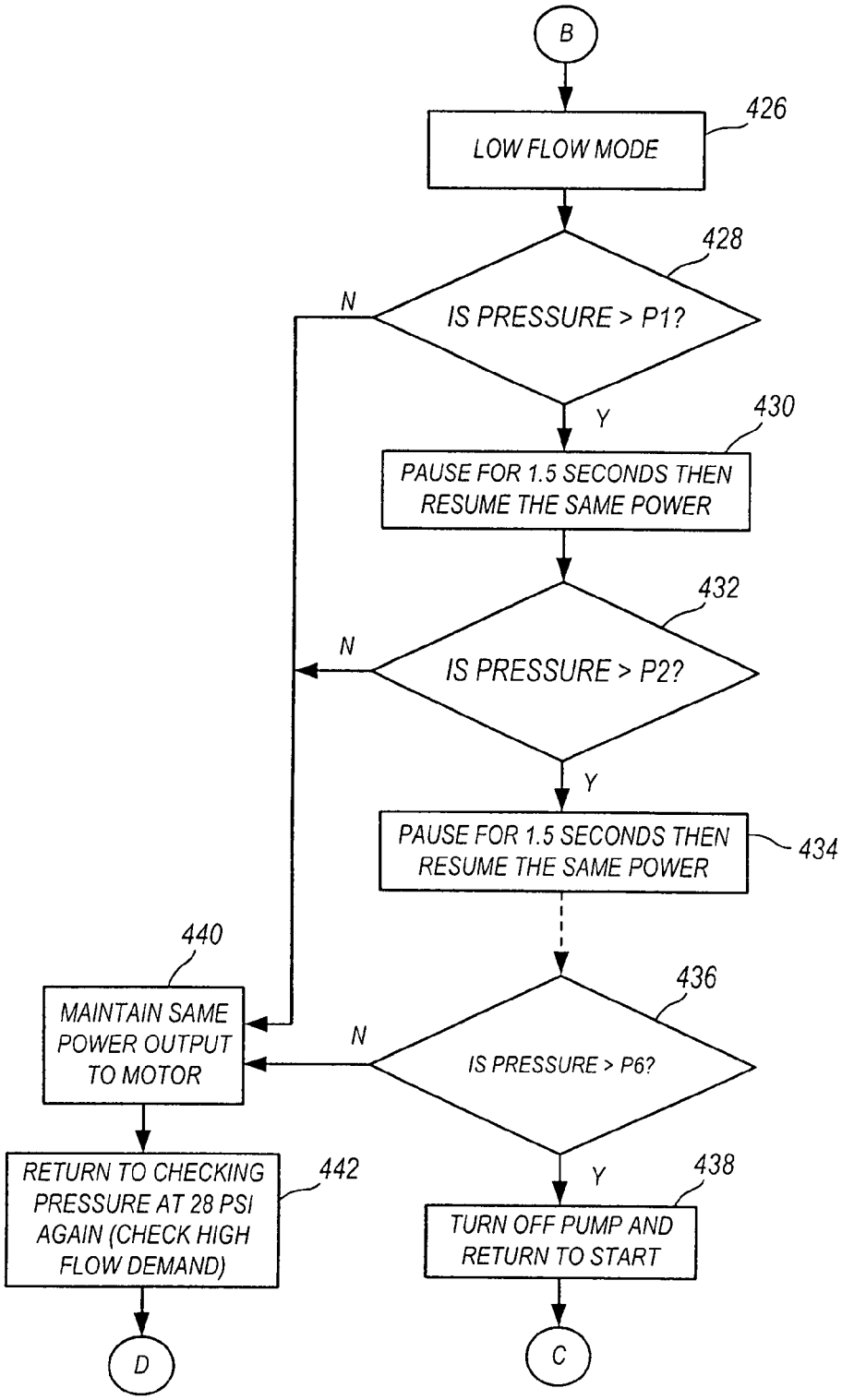

Referring to FIGS. 22A to 22C, the microprocessor 278 can be programmed, in some embodiments, to operate the pump control system 200 in the high-flow and low-flow modes discussed above. Referring first to FIG. 22A, the microprocessor 278 determines (at 400) whether the pressure within the outlet chamber 94 as sensed by the pressure sensor 116 is less than a first threshold (e.g., about 35 PSI). If the pressure is greater than about 35 PSI, the microprocessor 278 does nothing (at 402) and the pump continues to operate in the current mode. If the pressure is less than 35 PSI, the microprocessor 278 turns the pump 10 on at 50% power (at 404). In addition, the microcontroller 278 provides 50% power to the pump 10 when the pump is started. The microprocessor 278 checks the high-flow demand by determining (at 406) whether the pressure is less than a second threshold (e.g., about 28 PSI). If the pressure is less than about 28 PSI, the microprocessor 278 switches (at 408) the pump 10 to the high-flow mode (as shown in FIG. 22B at 410). In other words, the microprocessor 278 switches the pump 10 to the high-flow mode when the flow goes from low to high or the pressure drops below, for example, about 28 PSI at 50% power. The pressure will drop below 28 PSI if the flow demand is high. At this time, the microprocessor 278 can switch the pump 10 to high-flow mode and the pump 10 can stay in the high-flow mode until the pump 10 reaches the shut-off pressure (as further described below).

Referring to FIG. 22B, once the pump 10 is operating in high-flow mode, the microprocessor 278 determines (at 412) whether the current being provided to the pump 10 (the voltage signal at pin 18) is between two current thresholds (e.g., greater than about 9 amps but less than about 11 amps). If the current is not between about 9 amps and about 11 amps, the microprocessor 278 adjusts (at 414) the current until the current is between about 9 amps and about 11 amps. If the current is between about 9 amps and about 11 amps, the microprocessor 278 determines (at 416) whether the pressure is greater than a pressure threshold (e.g., about 2 PSI less than the shut-off pressure). If the pressure is greater than about 2 PSI less than the shut-off pressure, the microprocessor 278 provides (at 418) a "kick" or increased current to the pump 10 in order to help shut the pump off. For example, the "kick" current can include increasing the current provided to the pump from about 10 amps to about 13 amps within about 2 seconds. When the "kick" current has been provided to the pump 10, the microprocessor 278 determines (at 420) whether the pressure is greater than the shut-off pressure. If the pressure is greater than the shut-off pressure, the microprocessor 278 turns the pump off (at 422) and returns to START. If the pressure is less than the shut-off pressure, the microprocessor 278 again determines (at 412) whether the current is between two current thresholds (e.g., greater than about 9 amps but less than about 11 amps).

If the pressure is greater than about 28 PSI, the microprocessor 278 switches (at 424) the pump 10 to the low-flow mode (as shown in FIG. 22C at 426). In general, the microprocessor 278 can switch the pump 10 to low-flow mode when flow is low or the pressure stays at or above, for example, 28 PSI at 50% power. When the pump is started, the pump can be provided with 50% power. If the flow demand is low, the pressure will generally be greater than or equal to 28 PSI. At this time, the microprocessor 278 can switch the pump 10 to the low-flow mode and can stay in the low-flow mode until the pump 10 reaches the shut-off pressure (as will be further described below). However, the microprocessor 278 can switch the pump 10 to the high-flow mode anytime the flow demand becomes high again. In some embodiments, the shut-off pressure for the low-flow mode is lower than the shut-off pressure in the high-flow mode.

In the low-flow mode, the microprocessor 278 can use several thresholds, as shown in Table 1 below, for controlling the power provided to the pump 10. As discussed above, the shut-off pressure can vary depending on the length of the battery cable. In one embodiment, the shut-off pressure is about 65 PSI under normal conditions.

1 Low-flow mode pressure values. Threshold Pressure Value P1 20 PSI less than shut-off pressure P2 17 PSI less than shut-off pressure P3 14 PSI less than shut-off pressure P4 11 PSI less than shut-off pressure P5 8 PSI less than shut-off pressure P6 5 PSI less than shut-off pressure Referring to FIG. 22C, once in the low-flow mode, the microprocessor 278 determines whether the pressure is less than P1 (e.g., about 20 PSI less than the shut-off pressure). If the pressure is less than P1, the microprocessor 278 pauses (at 430) the power being provided to the pump 10 for about 1.5 seconds, for example, and then resumes providing the same level of power to the pump 10. The microprocessor 278 then determines (at 432) whether the pressure is less than P2 (e.g., about 17 PSI less than the shut-off pressure). If the pressure is less than P2, the microprocessor 278 pauses (at 434) the power being provided to the pump 10 for about 1.5 seconds, for example, and then resumes providing the same level of power to the pump 10. The microprocessor 278 continues determining (as shown by the dotted line between 434 and 436) whether the pressure is greater than each one of the pressure values shown above in Table 1. The microprocessor finally determines (at 436) whether the pressure is greater than P6 (e.g., about 5 PSI less than the shut-off pressure). If the pressure is greater than P6, the microprocessor 278 turns off the pump 10 (at 438) and returns to START. If at any point the microprocessor 278 determines that the pressure is not greater than P1 (at 428), P2 (at 432), P3 (not shown), P4 (not shown), P5 (not shown), or P6 (at 436), the microprocessor 278 maintains (at 440) the power to the pump 10. In other words, if the pressure in the outlet chamber 94 of the pump 10 does not continue to increase toward the shut-off pressure, the microprocessor 278 maintains (at 440) the power to the pump 10. The microprocessor 278 then returns (at 442) to determining (at 406) the high-flow demand.

It should be understood that although the above description refers to the steps shown in FIGS. 22A-22C in a particular order, that the scope of the appended claims is not to be limited to any particular order. The steps described above can be performed in various different orders and still fall within the scope of the invention. In addition, the various pressure and current thresholds, values, and time periods or durations discussed above are included by way of example only and are not intended to limit the scope of the claims.

Figure 23:
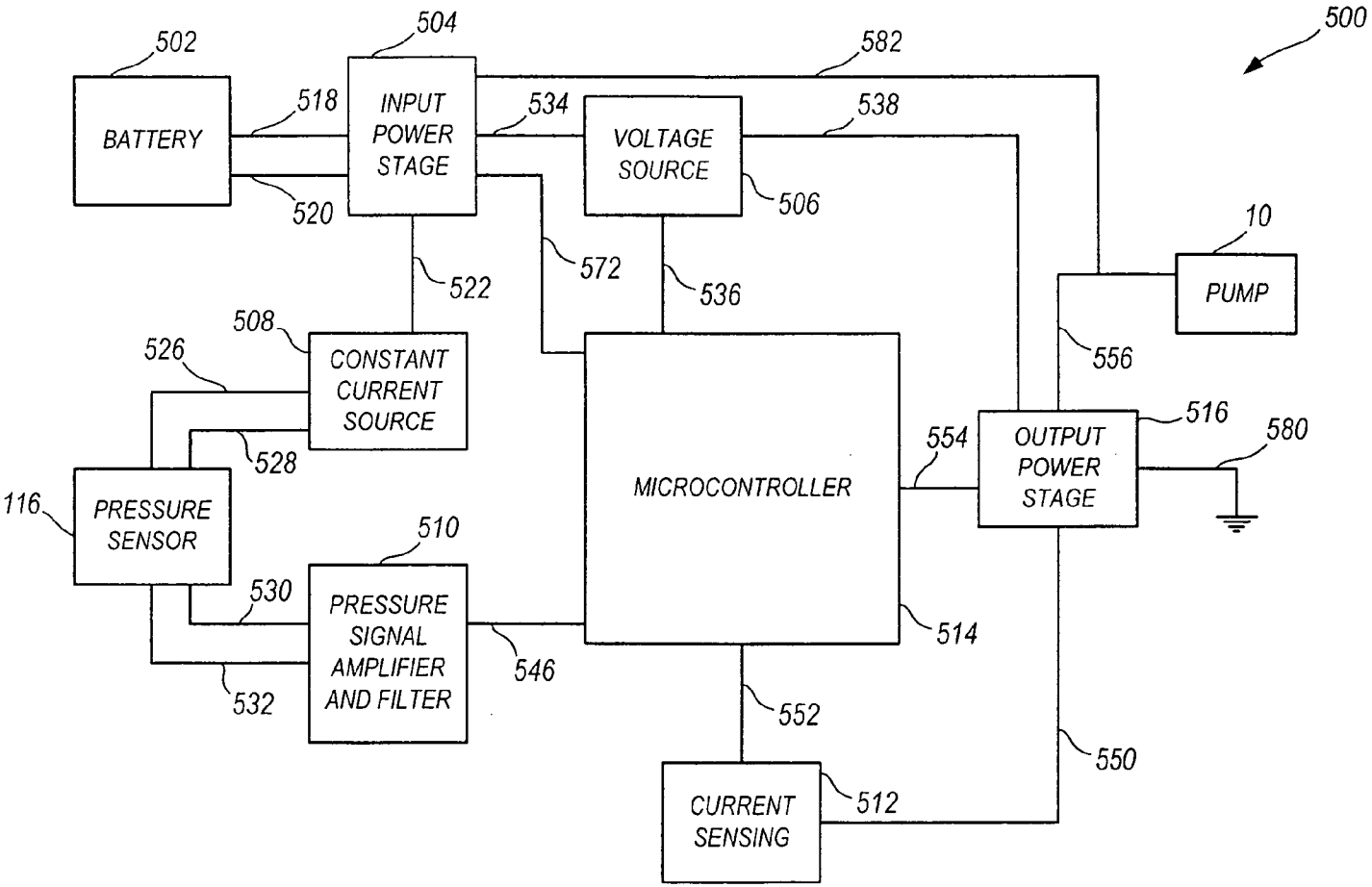
FIG. 23 is a schematic illustration of a pump control system according to an alternative embodiment of the present invention.

FIGS. 23-30 illustrate a pump control system 500 which is an alternative embodiment of the pump control system 200 shown in FIGS. 13-20. Elements and features of the pump control system 500 illustrated in FIGS. 23-30 having a form, structure, or function similar to that found in the pump control system 200 of FIGS. 13-20 are given corresponding reference numbers in the 500 series. As shown in FIG. 23, the pressure sensor 116 is included in the pump control system 500. The pump control system 500 can include a battery 502 or an AC power line (not shown) coupled to an analog-to-digital converter (not shown), an input power stage 504, a voltage source 506, a constant current source 508, a pressure signal amplifier and filter 510, a current sensing circuit 512, a microcontroller 514, and an output power stage 516 coupled to the pump 10. The components of the pump control system 500 can be made with integrated circuits mounted on a circuit board (not shown) that is positioned within the motor assembly 20.

In some embodiments, the battery 502 is a 12-volt, 24-volt, or 32-volt battery for use in automobiles, recreational vehicles, or marine craft. However, the battery 502 can be any suitable battery or battery pack. The voltage level of the battery 502 will vary during the life of the battery 502. Accordingly, the pump control system 500 can provide power to the pump as long as the voltage level of the battery 502 is between a low threshold and a high threshold. In one embodiment, the low threshold is approximately 8 volts and the high threshold is approximately 42 volts.

The battery 502 can be connected to the input power stage 504 via the connections 518 and 520. As shown in FIG. 22, the connection 518 can be designed to be coupled to the positive terminal of the battery 502 in order to provide a voltage of +V.sub.b to the pump control system 500. The connection 520 can be designed to be coupled to the negative terminal of the battery 502, which behaves as an electrical ground.

Figure 24:
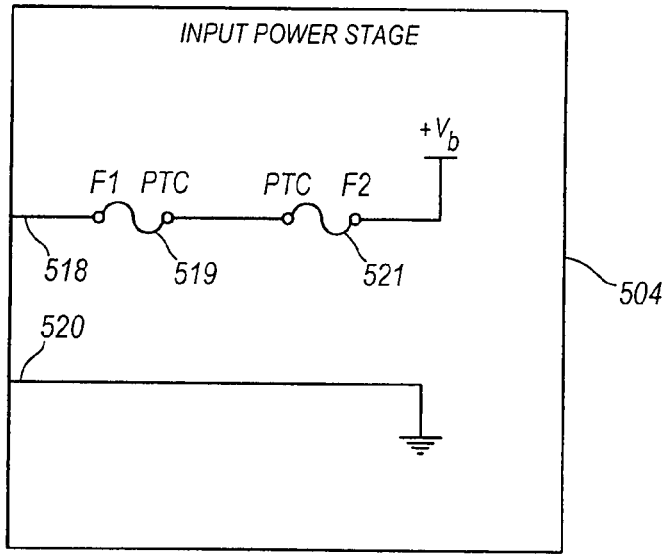
FIG. 24 is a schematic illustration of the input power stage illustrated in FIG. 23.

As shown in FIG. 24, a first power temperature control (PTC) device 519 and a second PTC device 521 can be connected in series with the connection 518 to act as fuses in order to protect against a reverse in polarity. In some embodiments, a first battery cable (e.g., represented by the connection 518) can be connected to a positive input of the input power stage 504 and a second battery cable (e.g., represented by the connection 520) can be connected to a negative input of the input power stage 504. The first battery cable can be designed to connect to the positive terminal of the battery and the second cable can be designed to connect to the negative terminal of the battery. However, the PTC devices 519 and 521 can protect against reverse polarity. If the first battery cable is initially connected to the negative terminal of the battery and the second battery cable is initially connected to the positive terminal of the battery, the electronics of the pump control system 500 will not be harmed. When the first and second cables are switched to the proper battery terminals, the pump 10 will operate normally.

Figure 25:
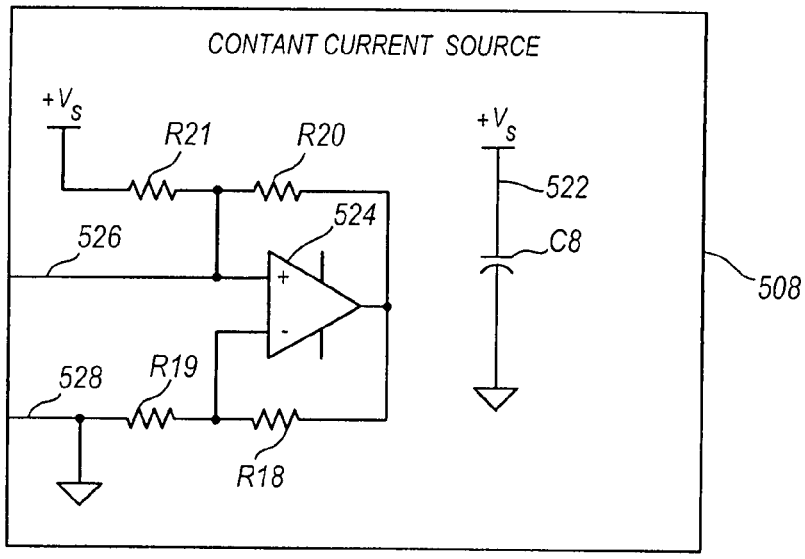
FIG. 25 is a schematic illustration of the constant current source illustrated in FIG. 23.

As shown in FIG. 24, the input power stage 504 can be coupled to a constant current source 508 via a connection 522, and the constant current source 508 can be coupled to the pressure sensor 116 via a connection 526 and a connection 528. As shown in FIG. 25, the constant current source 508 includes a decoupling and filtering capacitor C8, which prevents electromagnetic emissions from other components of the pump control circuit 500 from interfering with the constant current source 508. In some embodiments, the capacitance of C8 is 100 nF.

As shown in FIG. 25, the constant current source 508 includes an operational amplifier 524 coupled to a resistor bridge, including resistors R18, R19, R20 and R21. The operational amplifier 524 can be one of four operational amplifiers within a model LM324/SO or LM2904/SO integrated circuit manufactured by National Semiconductor, among others. The resistor bridge can be designed to provide a constant current and so that the output of the pressure sensor 116 can be a voltage differential value that is reasonable for use in the pump control system 500. The resistances of resistors R18, R19, R20, and R21 can be equal to one another, and can be 5 k.OMEGA. By way of example only, for a 5 k.OMEGA. resistor bridge, if the constant current source 508 provides a current of 1 mA to the pressure sensor 116, the voltages at the inputs 530 and 532 (as shown in FIG. 22) to the pressure signal amplifier and filter circuit 510 are between approximately 2 volts and 3 volts. In addition, the absolute value of the voltage differential between the inputs 530 and 532 can range from any non-zero value to approximately 100 mV or between 20 mV and 80 mV. In some embodiments, the absolute value of the voltage differential between the inputs 530 and 532 is designed to be approximately 55 mV. The voltage differential between the inputs 530 and 532 can be a signal that represents the pressure changes in the outlet chamber 94.

Figure 27:
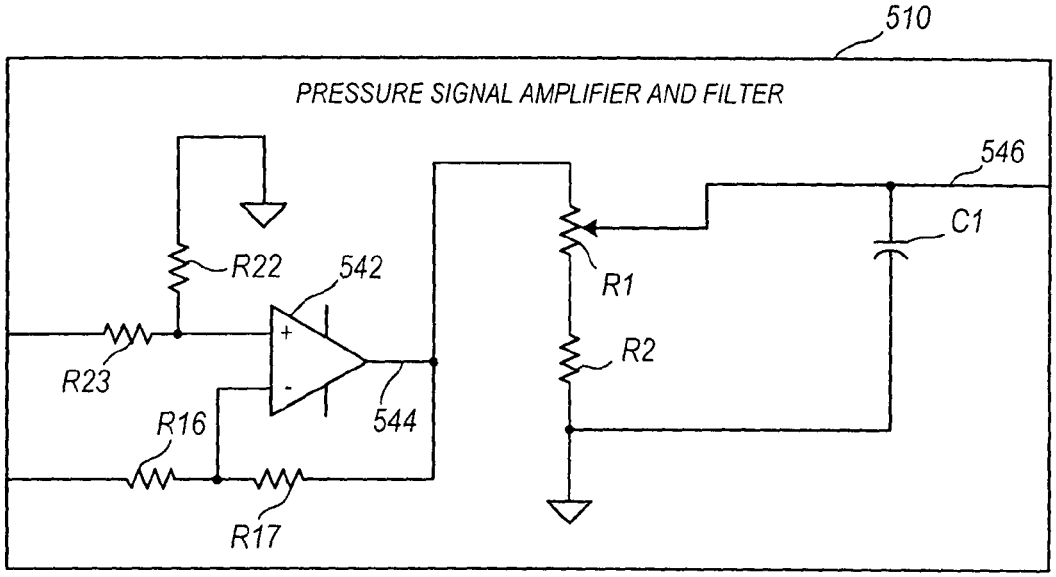
FIG. 27 is a schematic illustration of the pressure signal amplifier and filter illustrated in FIG. 23.

As shown in FIG. 27, the pressure signal amplifier and filter circuit 510 can include an operational amplifier 542 and a resistor network including R16, R17, R22 and R23. In some embodiments, the operational amplifier 542 can be a second of the four operational amplifiers within the integrated circuit. The resistor network can be designed to provide a gain of 100 for the voltage differential signal from the pressure sensor 116 (e.g., the resistance values are 1 k.OMEGA. for R16 and R23 and 100 k.OMEGA. for R17 and R22). The output 544 of the operational amplifier 542 can be coupled to a potentiometer R1 and a resistor R12. The potentiometer R1 for each individual pump 10 can be adjusted during the manufacturing process in order to calibrate the pressure sensor 116 of each individual pump 10. In some embodiments, the maximum resistance of the potentiometer R1 is 50 k.OMEGA., the resistance of the resistor R2 is 1 k.OMEGA., and the potentiometer R1 can be adjusted so that the shut-off pressure for each pump 10 is 65 PSI at 12 volts, 24 volts or 32 volts. The potentiometer R1 is coupled to a noise-filtering capacitor C1 having a capacitance value of 10 uF. An output 546 of the pressure signal amplifier and filter circuit 510 can be coupled to the microcontroller 514, providing a signal representative of the pressure within the outlet chamber 94 of the pump 10.

Figure 26:
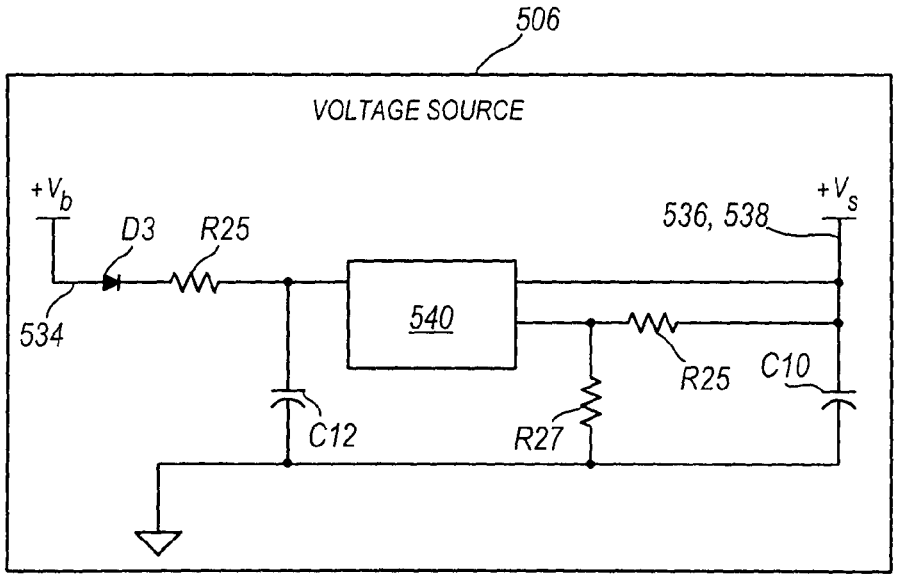
FIG. 26 is a schematic illustration of the voltage source illustrated in FIG. 23.

As shown in FIG. 23, the input power stage 504 can also be connected to the voltage source 506 via a connection 534. As shown in FIGS. 23 and 26, the voltage source 506 can convert the voltage from the battery (i.e., +V.sub.b) to a suitable voltage +V.sub.s (e.g., +5 volts) for use by the microcontroller 514 via a connection 536 and the output power stage 516 via a connection 538. The voltage source 506 can include an integrated circuit 540 (e.g., model LM317 manufactured by National Semiconductor, among others) for converting the battery voltage to +V.sub.s. The integrated circuit 540 can be coupled to resistors R25, R26 and R27 and capacitors C10 and C12. The resistors and capacitors provide a constant, suitable voltage output for use with the microcontroller 514 and the output power stage 516. In some embodiments, the resistance values are 330.OMEGA. for R25 and R26, 1 k.OMEGA. for R27 and the capacitance values are 100 nF for C10 and C12.

Figure 28:
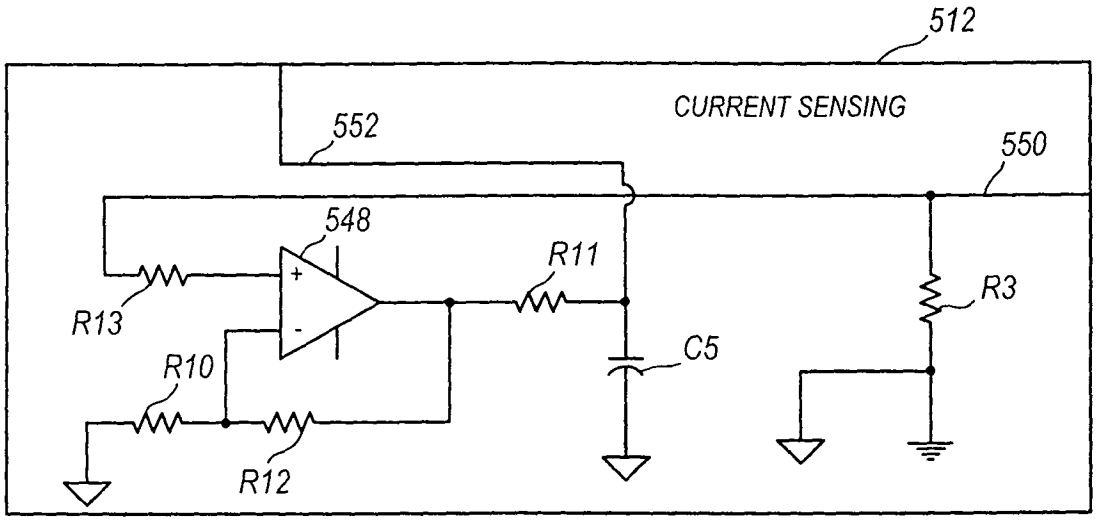
FIG. 28 is a schematic illustration of the current sensing circuit illustrated in FIG. 23.

As shown in FIG. 23, the current sensing circuit 512 can be coupled to the output power stage 516 via a connection 550 and to the microcontroller 514 via a connection 552. The current sensing circuit 512 can provide the microcontroller 514 a signal representative of the level of current being provided to the pump 10. As shown in FIG. 28, the current sensing circuit 512 can include a resistor R3, which has a low resistance value (e.g., 0.005.OMEGA.) in order to reduce the value of the current signal being provided to the microcontroller 514. The resistor R3 can be coupled to an operational amplifier 548 and a resistor network, including resistors R10, R11, R12, and R13 (e.g., having resistance values of 1 k.OMEGA. for R10 and R13, 20 k.OMEGA. for R11, and 46.4 k.OMEGA. for R12). The output of the amplifier 548 can also be coupled to a filtering capacitor C5, having a capacitance of 10 uF and a maximum working-voltage rating of 16V.sub.dc. In some embodiments, the operational amplifier 548 can be the third of the four operational amplifiers within the integrated circuit. The signal representing the current can be divided by approximately 100 by the resistor R3 and then amplified by approximately 46.4 by the operational amplifier 548, as biased by the resistors R10, R11, R12, and R13, so that the signal representing the current provided to the microcontroller 514 has a voltage amplitude of approximately 1.2 volts.

As shown in FIG. 23, the output power stage 516 can be coupled to the voltage source 506 via the connection 538, to the current sensing circuit 512 via the connection 550, to the microcontroller 514 via a connection 554, and to the pump 10 via a connection 556. The output power stage 516 receives a control signal from the microcontroller 514. As will be described in greater detail below, the control signal can cycle between 0 volts and 5 volts.

Figure 29:
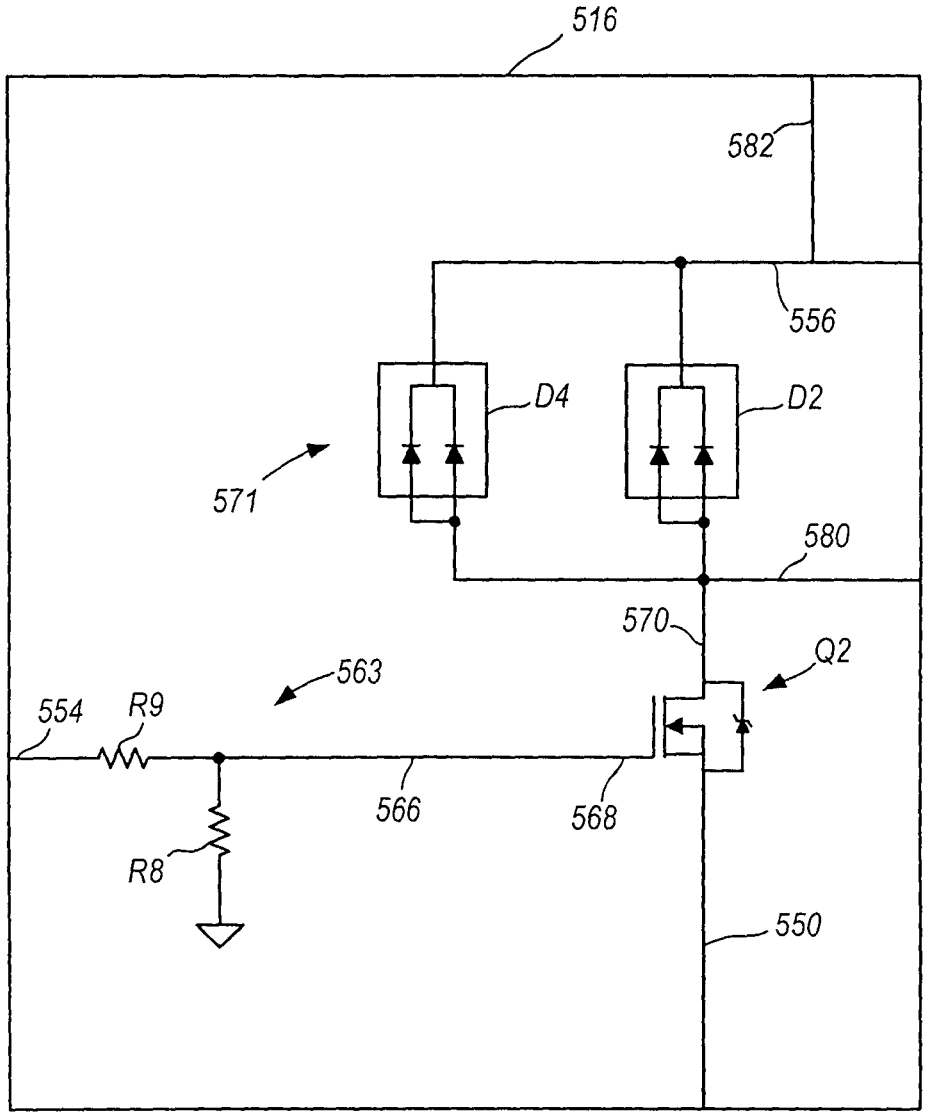
FIG. 29 is a schematic illustration of the output power stage illustrated in FIG. 23.

As shown in FIG. 29, the output power stage 516 can include a resistance circuit 563 including R8 and R9. The resistance circuit 563 can be coupled directly to the microcontroller 514 via the connection 554. The microcontroller 514 can provide either a high control signal or a low control signal to the connection 554. An output 566 of the resistance circuit 563 can be coupled to a gate 568 of a transistor Q1. In some embodiments, the transistor Q1 is a single-gate, n-channel, metal-oxide semiconductor field-effect transistor (MOSFET) capable of operating at a frequency of 1 kHz (e.g., model IRF1407 manufactured by International Rectifier). The transistor Q1 can act like a switch in order to selectively provide power to the motor assembly 20 of the pump 10 when an appropriate signal is provided to the gate 568. For example, if the voltage provided to the gate 568 of the transistor Q1 is positive, the transistor Q1 is "on" and provides power to the pump 10 via a connection 570. Conversely, if the voltage provided to the gate 568 of the transistor Q1 is negative, the transistor Q1 is "off" and does not provide power to the pump 10 via the connection 570.

The drain of the transistor Q1 can be connected via the connection 570 to a free-wheeling diode circuit 571 including a diode D2 and a diode D4. The diode circuit 571 can release the inductive energy created by the motor of the pump 10 in order to prevent the inductive energy from damaging the transistor Q1. In some embodiments, the diode D2 and the diode D4 are Scholtky diodes having a 100 volt and a 40 amp capacity and manufactured by International Rectifier. The diode circuit 571 can be connected to the pump 10 via the connection 556. The drain of the transistor Q1 can be connected to a ground via a connection 580.

As shown in FIGS. 23 and 29, the input power stage 504 can be coupled between the diode circuit 571 and the pump 10 via a connection 582. By way of example only, if the control signal from the microcontroller 514 is 5 volts, the transistor Q1 is "on" and approximately +V.sub.b is provided to the pump 10 from the input power stage 504. However, if the control signal is 0 volts, the transistor Q1 is "off" and +V.sub.b is not provided to the pump 10 from the input power stage 504.

Figure 30:
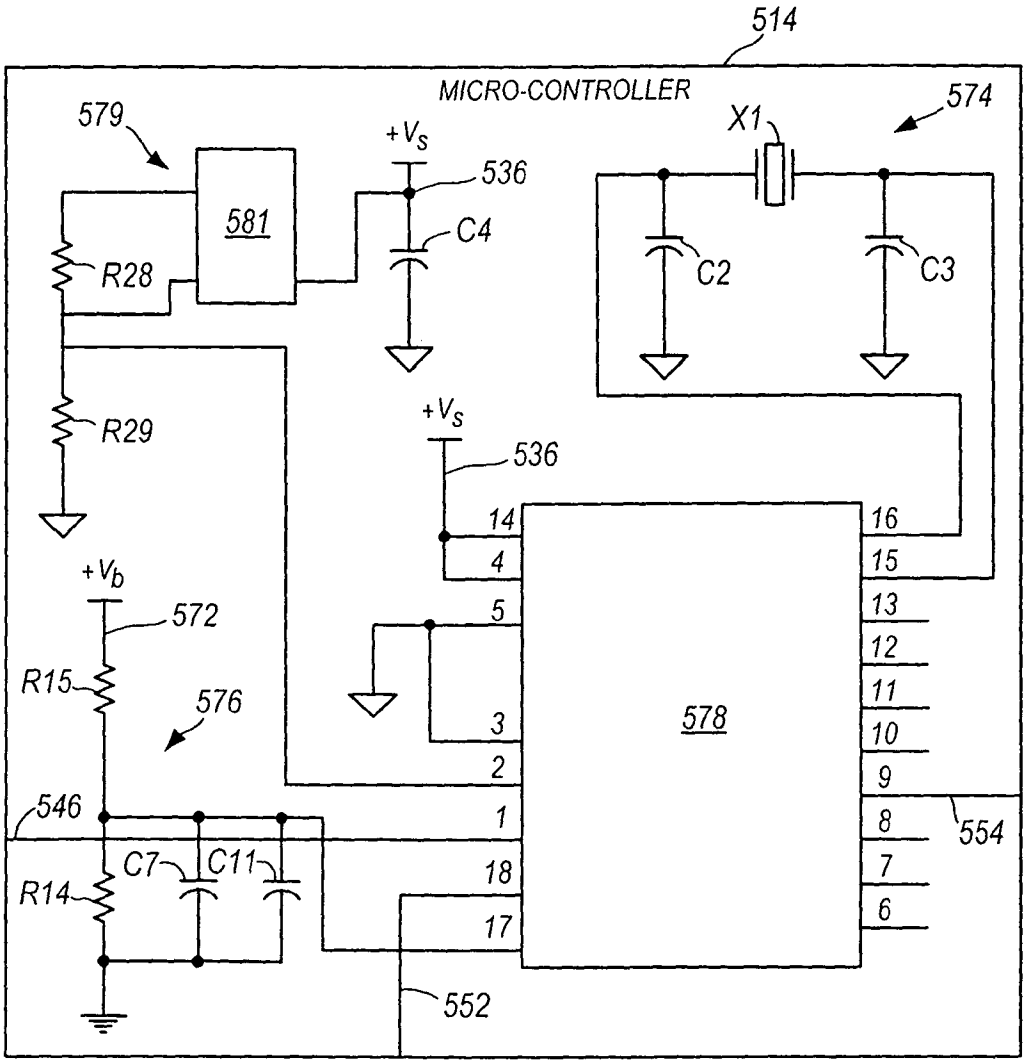
FIG. 30 is a schematic illustration of the microcontroller illustrated in FIG. 23.

As shown in FIG. 30, the microcontroller 514 can include a microprocessor integrated circuit 578, which is programmed to perform various functions, as will be described in detail below. As used herein and in the appended claims, the term "microcontroller" is not limited to just those integrated circuits referred to in the art as microcontrollers, but broadly refers to one or more microcomputers, processors, application-specific integrated circuits, or any other suitable programmable circuit or combination of circuits. In some embodiments, the microprocessor 578 is a model family number PIC16C71X or any other suitable product family (e.g., model numbers PIC16C711, PIC16C712, and PIC16C715) manufactured by Microchip Technology, Inc.

The microcontroller 514 can include a temperature sensor circuit 579 between the voltage source 506 and the microprocessor 578 (at pins 4 and 14). Rather than or in addition to the temperature sensor circuit 579, the pump control system 500 can include a temperature sensor located in any suitable position with respect to the pump 10 in order to measure, either directly or indirectly, a temperature associated with or in the general proximity of the pump 10 in any suitable manner. For example, the temperature sensor can include one or more (or any suitable combination) of the following components or devices: a resistive element, a strain gauge, a temperature probe, a thermistor, a resistance temperature detector (RTD), a thermocouple, a thermometer (liquid-in-glass, filled-system, bimetallic, infrared, spot radiation), a semiconductor, an optical pyrometer (radiation thermometer), a fiber optic device, a phase change device, a thermowell, a thermal imager, a humidity sensor, or any other suitable component or device capable of providing an indication of a temperature associated with the pump 10.

In one embodiment, the temperature sensor circuit 579 can include resistors R28 (e.g., 232.OMEGA.) and R29 (e.g., 10 k.OMEGA.), a semiconductor temperature sensor integrated circuit 579 (e.g., Model No. LM234 manufactured by National Semiconductor), and a capacitor C4 (e.g., 1 uF). The temperature sensor circuit 579 can be capable of producing a signal representative of changes in a temperature of the pump 10 (e.g., the temperature on the surface of the pump 10). In some embodiments, the microprocessor 578 can access a look-up table that correlates the temperature sensed by the temperature sensor integrated circuit 581 to an estimated surface temperature of the pump 10. The microprocessor 578 can receive the signal from the temperature sensor integrated circuit 579 and can be programmed to control a current provided to the pump 10 based on the sensed temperature.

In some embodiments, the microprocessor 578 can be programmed to stabilize the surface temperature of the pump 10. The microprocessor 578 can calculate a current limit value based on the surface temperature of the pump 10. In general, the current limit value is inversely proportional to the surface temperature of the pump 10, so that as the surface temperature of the pump 10 rises, the current limit value decreases. In one embodiment, the current limit value is approximately 5 amps when the temperature of the pump is approximately 70.degree. F. In one embodiment, the microprocessor 578 controls the current provided to the pump 10 in order to stabilize the surface temperature of the pump 10 and to maintain the surface temperature of the pump 10 below approximately 160.degree. F.

The microcontroller 514 can include a clocking signal generator 574 comprised of a crystal or oscillator X1 and loading capacitors C2 and C3. In some embodiments, the crystal X1 can operate at 20 MHz and the loading capacitors C2 and C3 can each have a capacitance value of 15 pF. The clocking signal generator 574 can provide a clock signal input to the microprocessor 578 and can be coupled to pin 15 and to pin 16.

The microcontroller 514 can be coupled to the input power stage 504 via the connection 572 in order to sense the voltage level of the battery 502. A voltage divider circuit 576, including resistors R14 and R15 and capacitors C7 (e.g., with a maximum working voltage of 25V.sub.dc) and C11 (e.g., with a maximum working voltage of 16V.sub.dc), can be connected between the input power stage 504 and the microprocessor 578 (at pin 17). The capacitors C7 and C11 filter out noise in the voltage level signal from the battery 502. In some embodiments, the resistances of the resistors R14 and R15 are 1 k.OMEGA. and 10 k.OMEGA., respectfully, the capacitance of the capacitors C7 and C11 are 100 nF and 10 uF, respectfully. In this embodiment, the voltage divider circuit 576 can reduce the voltage from the battery 502 by one-tenth.

The microprocessor 578 (at pin 1) can be connected to the pressure signal amplifier and filter 510 via the connection 546. The microprocessor 578 (at pin 18) can be connected to the current sensing circuit 512 via the connection 552. The pins 1, 17, and 18 can be coupled to internal analog-to-digital converters. Accordingly, the voltage signals representing the pressure in the outlet chamber 94 (at pin 1), the voltage level of the battery 502 (at pin 17), and the current being supplied to the motor assembly 20 via the transistor Q1 (at pin 18) can each be converted into digital signals for use by the microprocessor 578. Based on the voltage signals at pins 1, 17, and 18, the microprocessor 578 can provide a control signal (at pin 9) to the output power stage 516 via the connection 554.

The pump control system 500 can operate similar to pump control system 200 as described above with respect to FIGS. 21A-21F and/or FIGS. 22A-22C. In addition, if the microcontroller 514 includes the temperature sensor circuit 579, the microcontroller 514 can also operate to maintain a stable temperature for the pump 10 (e.g., a stable surface temperature). The microprocessor 578 can correlate the surface temperature of the pump 10 to the temperature sensed by the temperature sensor circuit 579 within the pump control circuit 500 by accessing a look-up table. The microcontroller 514 can stabilize the pump temperature by reducing the current provided to the pump 10 depending on the surface temperature of the pump 10. In some embodiments, the microprocessor 578 can calculate a current limit value depending on the temperature sensed by the temperature sensor circuit 579. Even when the rotor of the pump's motor assembly 20 is locked or the pump 10 is running continuously, the microcontroller 514 can maintain a stable temperature by limiting the current to the pump 10 to less than the current limit value. For example, when the pump 10 is used in marine craft, an obstruction (such as seaweed) may get caught in the pump 10 causing a lock-rotor condition. In a lock-rotor condition, the microcontroller 514 in some embodiments, will not allow the pump 10 to overheat, but rather will limit the power provided to the pump 10 until the obstruction is removed. In some embodiments, the current provided to the pump 10 is inversely proportional to the surface temperature of the pump 10.

In some embodiments, the current limit value is approximately 5 amps when the surface temperature of the pump is approximately 70.degree. F. In one embodiment, the microcontroller 514 maintains a surface temperature of the pump 10 below 160.degree. F. As the surface temperature of the pump 10 approaches approximately 160.degree. F., the power to the pump 10 can decrease until the surface temperature drops to approximately 110.degree. F. The microcontroller 514 can oscillate the power provided to the pump 10 in order to maintain the surface temperature of the pump 10 between approximately 110.degree. F. and approximately 160.degree. F.

In some embodiments, the microcontroller 514 is programmed so that the pump 10 does not "cycle." Conventional pumps often cycle during low-flow states when the pressure in the pump approaches the shut-off pressure but there is still flow through the pump. For example, if a faucet is only slightly open, the sensed pressure may approach the shut-off pressure causing the microcontroller to shut off the pump even though the faucet is still on. The microcontroller will then quickly turn the pump back on to keep water flowing through the faucet. The microcontroller will turn the pump off and on or "cycle" the pump in this manner until the faucet is shut completely and the pressure stabilizes at or above the shut-off pressure.

In order to prevent cycling, the microcontroller 514 can be programmed to slowly oscillate the power provided to the pump 10 when the pressure sensed by the pressure sensor 116 is approaching the shut-off pressure. For example, at a low-flow state when the sensed pressure starts to reach the shut-off pressure, the microcontroller 514 can slowly reduce the current to the pump 10 until the pressure falls below the shut-off pressure. The microcontroller 514 can then increase the current to the pump 10 until the pressure rises toward the shut-off pressure. In some embodiments, the microcontroller 514 can increase and decrease the current to the pump 10 causing the pump 10 to slowly oscillate near the shut-off pressure. In one embodiment, the microcontroller 514 can oscillate the power to the pump 10 so that the sensed pressure oscillates within about 1 or 2 PSI of the shut-off pressure or, for example, between approximately 59 PSI and 61 PSI if the shut-off pressure is 60 PSI. However, the pump 10 will not shut off or cycle as long as the faucet is open. As soon as the faucet is closed (assuming that there are no leaks in the system), the sensed pressure reaches the shut-off pressure and the microcontroller 514 does not provide power to the pump 10 to shut the pump 10 off.

Figure 31A:
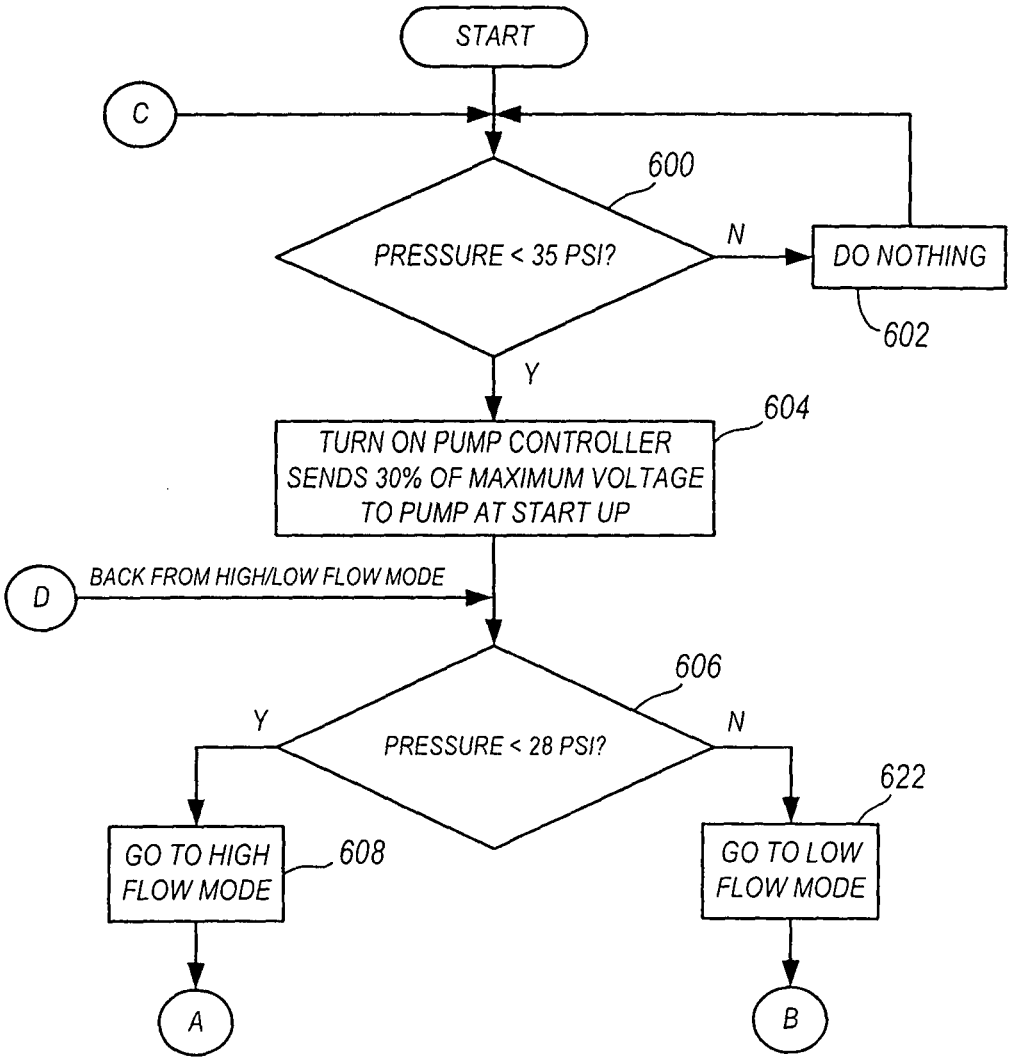
FIGS. 31A-31C are flowcharts illustrating the operation of the pump control circuit of FIG. 23.
Figure 31B:
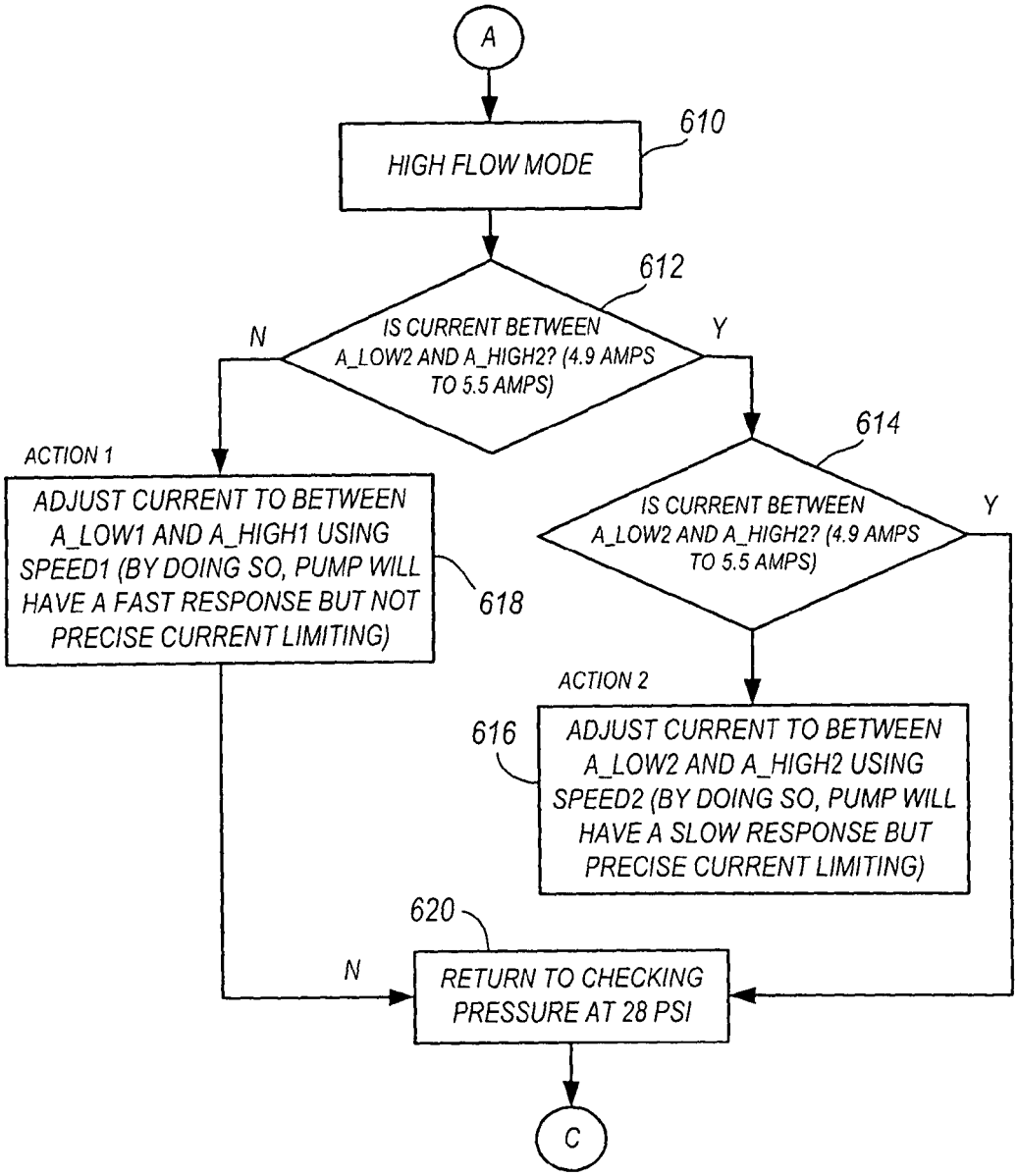
Figure 31C:
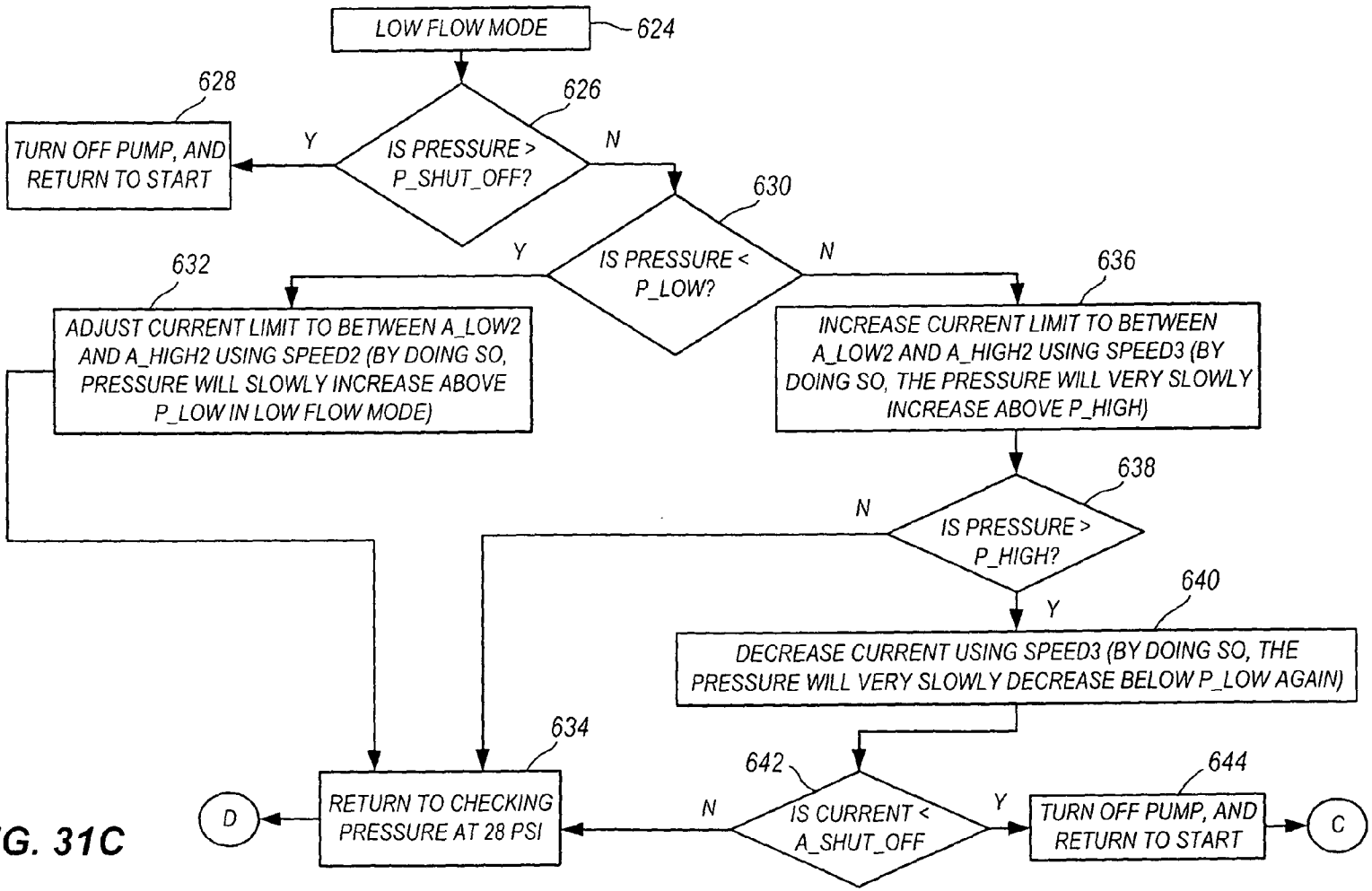

Referring to FIGS. 31A-31C, the microprocessor 578 can be programmed, in some embodiments, to operate the pump control system 500 in a high-flow mode and a low-flow mode. In some embodiments, the method of controlling the pump 10 shown and described with respect to FIGS. 31A-31C allows precise current limiting, fast response to high flow demand, slow response at low flow demand, and no pump cycling. Referring first to FIG. 31A, the microprocessor 578 determines (at 600) whether the pressure within the outlet chamber 94 as sensed by the pressure sensor 116 is less than a first threshold (e.g., about 35 PSI). If the pressure is greater than about 35 PSI, the microprocessor 578 does nothing (at 602) and the pump continues to operate in the current mode. If the pressure is less than 35 PSI, the microprocessor 578 turns the pump 10 on and sends (at 604) 30% of the maximum voltage to start the pump 10. The microprocessor 578 determines (at 606) whether the pressure is less than a second threshold (e.g., about 28 PSI). If the pressure is less than about 28 PSI, for example, the microprocessor 578 switches (at 608) the pump 10 to the high-flow mode (as shown in FIG. 31B at 610).

In some embodiments, the microprocessor 578 can use multiple speeds for fast response and precise current limiting. Multiple speeds that can be used by the microprocessor 578 include Speed 1: Fast Response, Speed 2: Slow Response, and Speed 3: Very Slow Response. The current variables and their definitions shown in Table 2 below can be used by the microprocessor 578 to control the pump 10 at each of the multiple speeds (as will be further described below).

TABLE 2

Variables and their definitions used by microprocessor 578.

| Variable | Definition |
|---|---|
| A_Limit | Current limit (e.g., 4 amps for 32 volt battery and 5 amps for 24 volt battery) |
| A_Low1 | 90% of A_Limit (e.g., 4.5 amps for 24 volt battery) |
| A_Low2 | 98% of A_Limit (e.g., 4.9 amps for 24 volt battery) |
| A_High1 | 110% of A_Limit (e.g., 5.5 amps for 24 volt battery) |
| A_High2 | 102% of A_Limit (e.g., 5.1 amps for 24 volt battery) |
| A_Shut_off | 20% of A_Limit (e.g., 2.0 amps for 24 volt battery) |

In general, in the high-flow mode, when the current value is far below or far above the current limit (A_Limit), the microprocessor 578 can respond quickly to bring the current close to, but not too close to, the current limit. When the current is somewhat close to the current limit, the microprocessor 578 can respond more slowly to bring the current even closer to the current limit without overshooting the current limit, resulting in precise current limiting.

More specifically, referring to FIG. 31B, the microprocessor 578 determines (at 612) whether the current is between A_Low1 and A_High1 (e.g., between about 4.5 amps and 5.5 amps). If the current is between A_Low1 and A_High1, the microprocessor 578 determines (at 614) whether the current is between A_Low2 and A_High2 (e.g., between about 4.9 amps and 5.1 amps). If the current is not between A_Low2 and A_High2, the microprocessor 578 adjusts (at 616) the current until the current is between A_Low2 and A_High2 using Speed 2. By using Speed 2, the pump 10 generally responds more slowly, but the current is limited more precisely. If the current is not between A_Low1 and A_High1, the microprocessor 578 adjusts (at 618) the current until the current is between A_Low1 and A_High1 using Speed 1. By using Speed 1, the pump 10 generally responds more quickly, but the current is not limited as precisely. In some embodiments, the microprocessor 578 can combine Action 1 (at 618) with Action 2 (at 616) so that the pump 10 responds quickly and the current is limited precisely. Once the microprocessor 578 performs Action 1 (at 618) and/or Action 2 (at 616), the microprocessor 578 returns (at 620) to determining (at 606) whether the pressure is less than, for example, 28 PSI. If the pressure is greater than about 28 PSI, the microprocessor 578 switches (at 622) the pump 10 to the low-flow mode (as shown in FIG. 31C at 624).

In low-flow mode (as shown in FIG. 31C), the microprocessor 578 can oscillate the pressure within the outlet chamber 94 of the pump 10 in order to prevent the pump 10 from cycling. In some embodiments, the microprocessor 578 oscillates the pressure very slowly between about 2 PSI above the shut-off pressure and about 2 PSI below the shut-off pressure in order to determine whether the faucets are completely closed or slightly opened for low-flow demand. When the microprocessor 578 senses low-flow demand, the microprocessor 578 can send a signal in order to oscillate the pressure between about 2 PSI above the shut-off pressure and about 2 PSI below the shut-off pressure. If the faucet stays open, the microprocessor 578 can continue to oscillate the pressure. If the faucet is completely closed, the microprocessor 578 can sense that the pressure continues to increase toward the shut-off pressure and the microprocessor 578 can turn the pump 10 off.

The pressure variables and their definitions shown in Table 3 below can be used by the microprocessor 578 to control the pump 10 in low-flow mode (as will be further described below).

TABLE 3

Variables and their definitions used by microprocessor 578.

| Variable | Definition |
|---|---|
| P_Shut_off | Shut-off pressure |
| P_Low | P_Shut_off − 1.5 PSI |
| P_High | P_Shut_off + 1.5 PSI |
| P_Off | P_Shut_off + 4 PSI |

Referring to FIG. 31C, the microprocessor 578 determines (at 626) whether the pressure is greater than the shut-off pressure. If the pressure is greater than the shut-off pressure, the microprocessor 578 turns the pump 10 off (at 628) and returns to START. This condition generally only occurs when a faucet is closed after having been wide open. If the pressure is less than the shut-off pressure, the microprocessor 578 determines (at 630) if the pressure is less than P_Low. If the pressure is less than P_Low, the microprocessor 578 adjusts (at 632) the current limit to between A_Low2 and A_High2 using Speed 2 so that the pressure slowly increases above P_Low in the low-flow mode. The microprocessor 578 then returns (at 634) to determining (as shown in FIG. 31A at 606) whether the pressure is less than about 28 PSI, for example. If the pressure is greater than P_Low, the microprocessor 578 increases (at 636) the current limit to between A_Low2 and A_High2 using Speed 3 so that the pressure increases very slowly above P_High. The microprocessor 578 then determines (at 638) whether the pressure is greater than P_High. If the pressure is less than P_High, the microprocessor 578 then returns (at 634) to determining (as shown in FIG. 31A at 606) whether the pressure is less than about 28 PSI. If the pressure is greater than P_High, the microprocessor 578 decreases (at 640) the current using Speed 3 so that the pressure decreases very slowly below P_Low. The microprocessor 578 then determines (at 642) whether the current is less than A_Shut_off. If the current is less than A_Shut_off, the microprocessor 578 turns the pump 10 off (at 644) and returns to START.

It should be understood that although the above description refers to the steps shown in FIGS. 31A-31C in a particular order, that the scope of the appended claims is not to be limited to any particular order. The steps described above can be performed in various different orders and still fall within the scope of the invention. In addition, the various pressure and current thresholds, values, and time periods or durations discussed above are included by way of example only and are not intended to limit the scope of the claims.

In general, all the embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

We claim:

1. A method of controlling a pump in a system including at least one faucet, the method comprising:

sensing a pressure in the pump;

determining whether the at least one faucet downstream from the pump is open enough to require one of high flow and low flow through the at least one faucet based on the sensed pressure in the pump;

entering a low-flow mode when the sensed pressure in the pump is greater than a low pressure threshold, indicating low flow demand by the at least one faucet, the low-flow mode including operations specific to low flow conditions of the pump;

reducing power to the pump, when the sensed pressure is greater than a shut-off pressure during the low-flow mode and the at least one faucet is still open and demanding flow, until the sensed pressure is less than the shut-off pressure in order to prevent the pump from being shut down during low flow demands; and turning the pump off when in the low-flow mode the sensed pressure is greater than the shut-off pressure and the at least one faucet is closed and no longer demanding flow.

2. The method of claim 1, wherein sensing a pressure in the pump includes sensing a pressure in an outlet chamber in the pump.

3. The method of claim 1, and further comprising generating a pulse-width modulation control signal based on the sensed pressure.

4. The method of claim 3, and further comprising generating the pulse-width modulation control signal having a duty cycle, reducing the duty cycle in order to reduce power supplied to the pump, and increasing the duty cycle in order to increase power supplied to the pump.

5. The method of claim 3, and further comprising amplifying and filtering the sensed pressure before generating the pulse-width modulation control signal based on the sensed pressure.

* * * * *